US010974921B2

(12) United States Patent
Fukasawa et al.

(10) Patent No.: US 10,974,921 B2
(45) Date of Patent: Apr. 13, 2021

(54) SHEET FOLDING BASED ON A SINGLE FOLDING ROLLER

(71) Applicant: HEWLETT-PACKARD DEVELOPMENT COMPANY, L.P., Spring, TX (US)

(72) Inventors: Eiji Fukasawa, Pangyo (KR); Su Yeon Kim, Suwon (KR); Jae Hyun Shin, Pangyo (KR); Jung Kyu Park, Pangyo (KR)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 16/694,247

(22) Filed: Nov. 25, 2019

(65) Prior Publication Data

US 2020/0087100 A1 Mar. 19, 2020

Related U.S. Application Data

(63) Continuation of application No. PCT/KR2018/000420, filed on Jan. 9, 2018.

(30) Foreign Application Priority Data

May 26, 2017 (KR) ..... 10-2017-0065627

(51) Int. Cl.
*B65H 37/06* (2006.01)
*B65H 45/18* (2006.01)
(Continued)

(52) U.S. Cl.
CPC ..... *B65H 45/18* (2013.01); *B65H 29/125* (2013.01); *B65H 45/04* (2013.01)

(58) Field of Classification Search
CPC ..... B65H 37/06; B65H 45/18; B65H 29/125; B65H 45/04; B65H 29/52; B65H 29/58
See application file for complete search history.

(56) References Cited

U.S. PATENT DOCUMENTS 5,076,556 A * 12/1991 Mandel ..... B65H 45/144 270/45
5,769,774 A * 6/1998 Beck ..... B65H 45/144 493/419

(Continued)

FOREIGN PATENT DOCUMENTS

JP 2011168387 9/2011
JP 2014125312 A * 7/2014 ..... B65H 45/14

*Primary Examiner* — Patrick H Mackey
(74) *Attorney, Agent, or Firm* — Staas & Halsey LLP

(57) ABSTRACT

A sheet folding apparatus including a folding roller, a positioning member, a push member, and a shift member. The folding roller including a pair of rollers to rotatably engage with each other to form a folding nip. The positioning member to support a first end of a printing medium which is fed along a folding path and to arrange the printing medium in an initial folding location. The push member to move to an insertion location to push the printing medium on the folding path into the folding nip, and to move to a retreat location. The shift member, located at an exit of the folding nip, to selectively guide the printing medium to a guide path to return the printing medium having passed through the folding nip to the folding path, the guide path being provided around at least one of the pair of rollers.

13 Claims, 85 Drawing Sheets

(51) Int. Cl.
*B65H 29/12* (2006.01)
*B65H 45/04* (2006.01)

(56) References Cited

U.S. PATENT DOCUMENTS

| | | | | |
|---|---|---|---|---|
| 6,592,506 | B1 * | 7/2003 | Lyga | B31F 1/0009 493/424 |
| 9,533,853 | B2 * | 1/2017 | Nakagawa | B65H 45/161 |
| 2002/0046666 | A1 | 4/2002 | Bialek | |
| 2005/0037906 | A1 | 2/2005 | Sparano et al. | |
| 2005/0079968 | A1 | 4/2005 | Trovinger | |
| 2007/0108690 | A1 * | 5/2007 | Hayashi | B65H 31/36 270/58.27 |
| 2008/0234118 | A1 | 9/2008 | Ishida et al. | |
| 2014/0171285 | A1 * | 6/2014 | Farlotti | B65H 45/18 493/444 |
| 2019/0284011 | A1 * | 9/2019 | Furuhashi | B65H 29/145 |

* cited by examiner

SHEET FOLDING BASED ON A SINGLE FOLDING ROLLER

CROSS REFERENCE PARAGRAPH

This application is a continuation application of International Patent Application No.: PCT/KR2018/000420, filed Jan. 9, 2018, which claims the benefit of Korean Patent Application No.: 10-2017-0065627, filed May 26, 2017 in the Korean Intellectual Property Office, and the disclosures of which are incorporated by reference herein in its entirety.

BACKGROUND

A sheet folding apparatus folds a sheet-type medium (hereinafter referred to as 'paper') in various forms. The sheet folding apparatus may be used in a finisher with respect to paper which is discharged from a copier, a printer, etc., or may be a stand-alone apparatus.

The sheet folding apparatus may fold paper once, or two or more times. Two or more pairs of rollers may be used to fold paper two or more times. Pairs of rollers that number as many as the number of times paper is folded are used.

DETAILED DESCRIPTION

Figure 1:
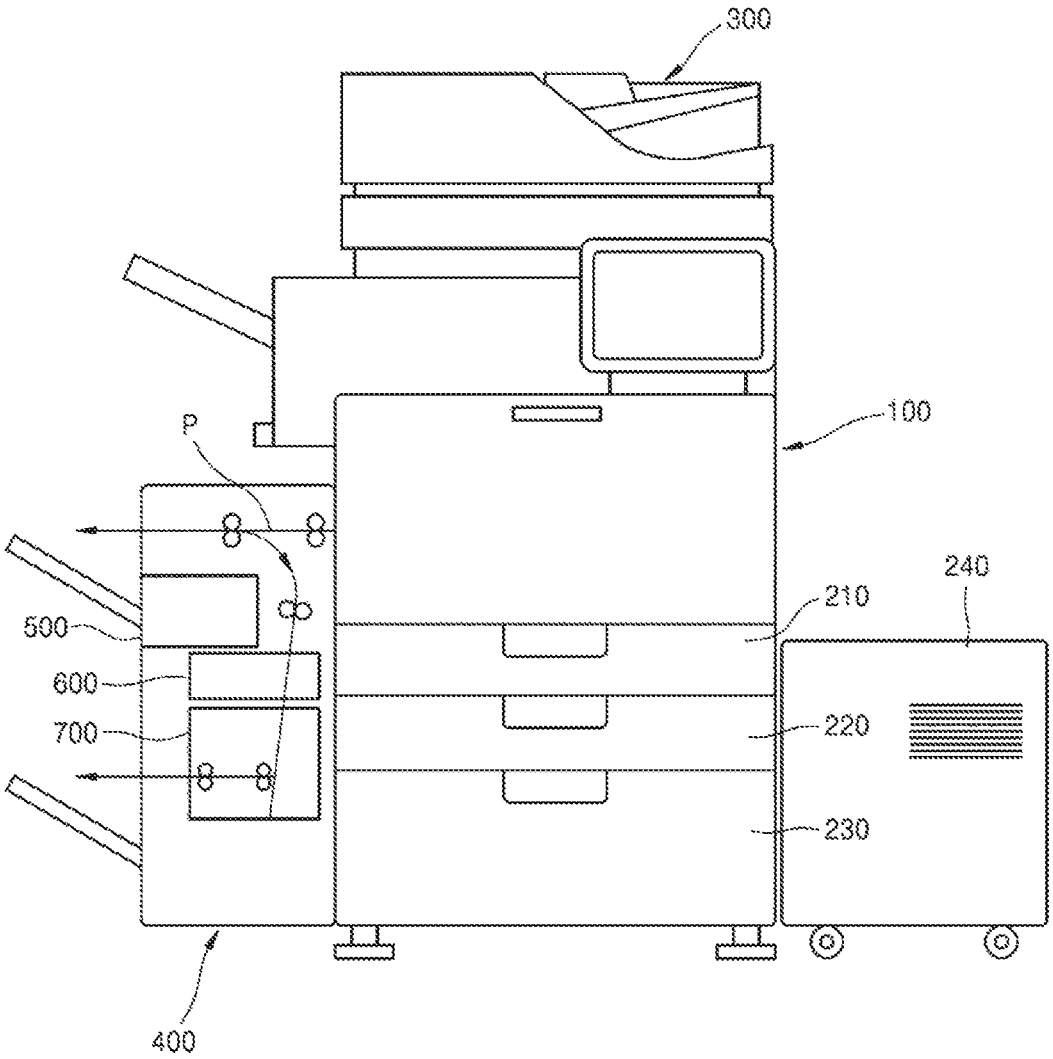
FIG. 1 is a schematic configuration diagram of an image forming apparatus according to an example.

Hereinafter, examples of a sheet folding apparatus and method and a finisher and image forming apparatus using the sheet folding apparatus and method will be described with reference to the accompanying drawings. In the drawings, like reference numerals denote like elements, and a size or thickness of each component may be exaggerated for clarity of description.

FIG. 1 is a schematic configuration diagram of an image forming apparatus according to an example.

Referring to FIG. 1, the image forming apparatus may include a printer 100 and a finisher 400. The printer 100 prints an image on a printing medium such as a sheet-type medium (hereinafter referred to as 'paper') supplied from a paper feeder. The paper feeder may be, for example, a main cassette feeder 210 which is installed under the printer 100, a secondary cassette feeder 220 which is installed under the main cassette feeder 210, a high capacity feeder 230 which is installed under the main cassette feeder 210 or under the secondary cassette feeder 220, a high capacity feeder 240 which is installed at a side of the printer 100, or the like. Although not shown, the paper feeder may be a multi-purpose tray (MPT).

The printer 100 may print an image on paper P by using various printing methods such as an electrophotography method, an inkjet method, a thermal transfer method, or a thermal sublimation method. For example, the image forming apparatus according to the present example prints a color image on the paper P by using an electrophotography method. The above printing methods are well-known in the art, and thus, a detailed description thereof will be omitted herein.

The image forming apparatus may further include a scanner 300 for reading an image recorded on a document. The scanner 300 may have various structures such as a flatbed mechanism where a document is located at a fixed position and an image is read while a reading member moves, a document feeding mechanism where a reading member is located at a fixed position and a document is fed, or a combination structure thereof. The principle and structure of the scanner 300 are well-known in the art, and thus, a detailed description thereof will be omitted herein.

The finisher 400 may include a sheet folding apparatus 700 for folding, the paper P discharged from the printer 100. The finisher 400 may further include an alignment apparatus 500 for aligning the paper P discharged from the printer 100. The alignment apparatus 500 may have a structure for stapling the paper P at an end portion thereof or punching a hole in an end portion of the paper P. The finisher 400 may further include a middle stapler 600 for stapling the paper P at a center portion thereof. Structures of the alignment apparatus 500 and the middle stapler 600 are well-known in the art, and thus, a detailed description thereof will be omitted herein.

Hereinafter, examples of a sheet folding apparatus will be described.

Figure 2:
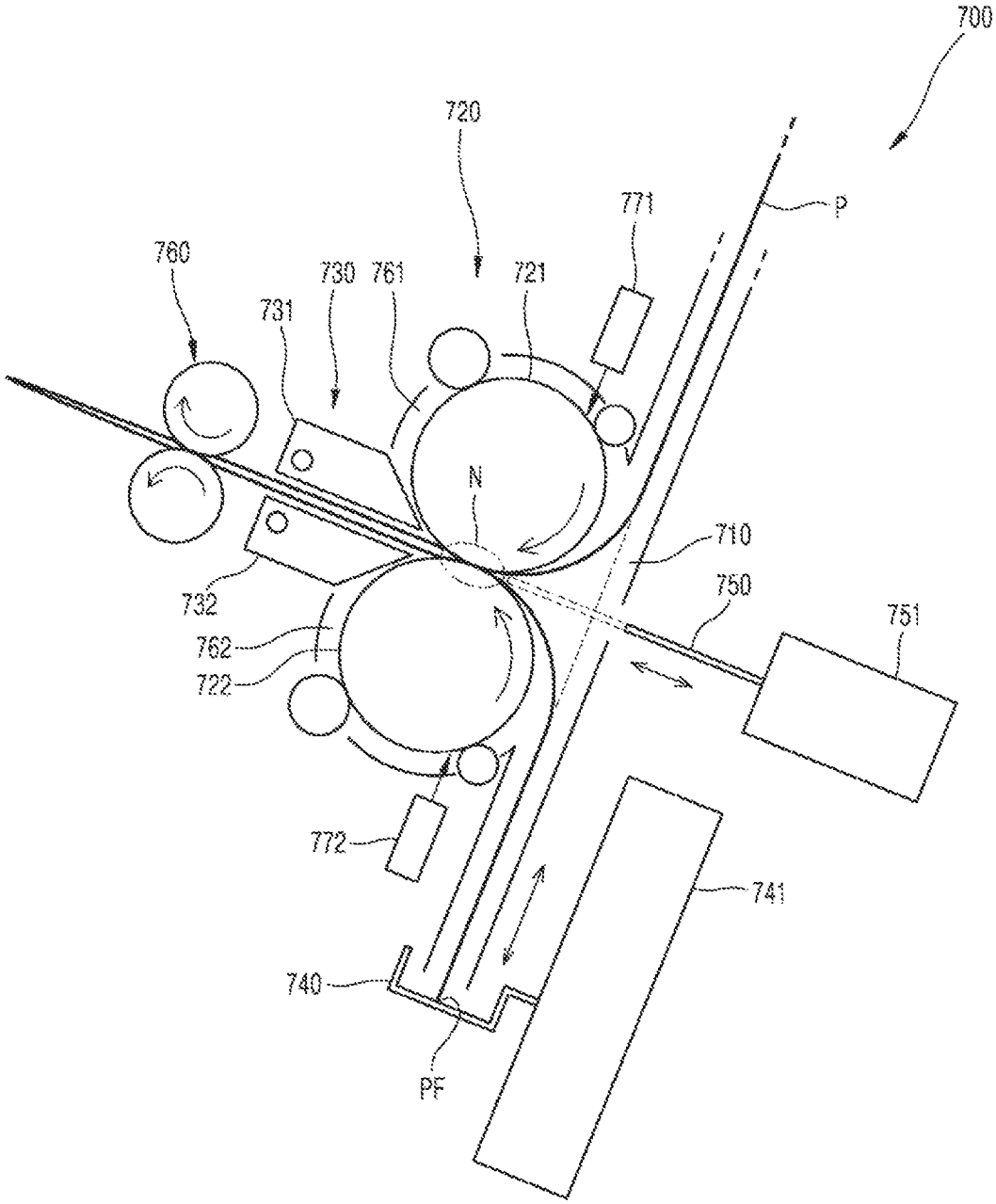
FIG. 2 is a configuration diagram of a sheet folding apparatus according to an example.

FIG. 2 is a configuration diagram of a sheet folding apparatus 700 according to an example.

FIG. 2 shows a folding path 710 and a folding roller 720. The folding roller 720 is on the folding path 710. The folding roller 720 includes first and second rollers 721 and 722 rotatably engaging with each other to form a folding nip N. The first roller 721 is at an upstream side of the folding path 710, and the second roller 722 is at a downstream side thereof.

The sheet folding apparatus 700 may include a folding roller 720 including a pair of rollers 721 and 722 to rotatably engage with each other to form a folding nip N.

The sheet folding apparatus 700 may include a positioning member 740 to support a first end of a printing medium which is fed along a folding path 710 and to arrange the printing medium in an initial folding location.

The sheet folding apparatus 700 may include a push member 750 to move to an insertion location (dashed line of FIG. 2) to push the printing medium on the folding path 710 into the folding nip N, and to move to a retreat location (solid line of FIG. 2) to escape from the folding path 710.

The sheet folding apparatus 700 may also include a shift member, located at an exit of the folding nip, to selectively guide the printing medium to a guide path 730 to return the printing medium having passed through the folding nip N to the folding path 710, the guide path being provided around at least one of the pair of rollers 721, 722.

A push member 750, which may be moved from an insertion location (dashed line of FIG. 2) to push paper P on the folding path 710 into the folding nip N to a retreat location (solid line of FIG. 2) to escape from the folding path 710, is positioned at an entrance of the folding nip N. The push member 750 may comprise a rod, a shaft, a dowel, or similar structure and be moved between the insertion location and the retreat location, for example, by an actuator 751. The actuator 751 may be, for example, a linear motor. In FIG. 2, the push member 750 linearly moves to the insertion location and the retreat location. However, the present disclosure is not limited thereto, and the push member 750 may rotate to the insertion location and the retreat location.

A positioning member 740 arranges the paper P on the folding path 710 in an initial folding location. A first end (e.g., a fore-end) PF of the paper P fed along the folding path 710 is supported by the positioning member 740. The positioning member 740 is moved along the folding path 710 by an escalating member 741. At least the initial folding location of the paper P is determined by a location of the positioning member 740. The location of the positioning member 740 may be detected by a location detecting sensor (not shown). The positioning member 740 may be implemented by various structures, for example, a plate, a bracket having at least one retaining side, an indentation, or the like. The escalating member 741 may be implemented by various structures, for example, a linear motor, a combination of a rotation motor and a linear movement mechanism, a combination of a rotation motor and a rotary belt or chain, or the like.

By the above configuration, the paper P may be folded once. For example, one piece or a plurality of pieces of paper P is fed along the folding path 710, and the first end PF thereof is supported by the positioning member 740. As the push member 750 moves to the insertion location, the push member 750 pushes a center portion of the paper P into the folding nip N. The paper P is folded once while being pushed into the folding nip N and is pushed out through an exit of the folding nip N. The folded paper P is externally discharged by a discharge roller 760. Thus, a V-fold may be performed. A folding location may be determined by the positioning member 740.

Figure 3:
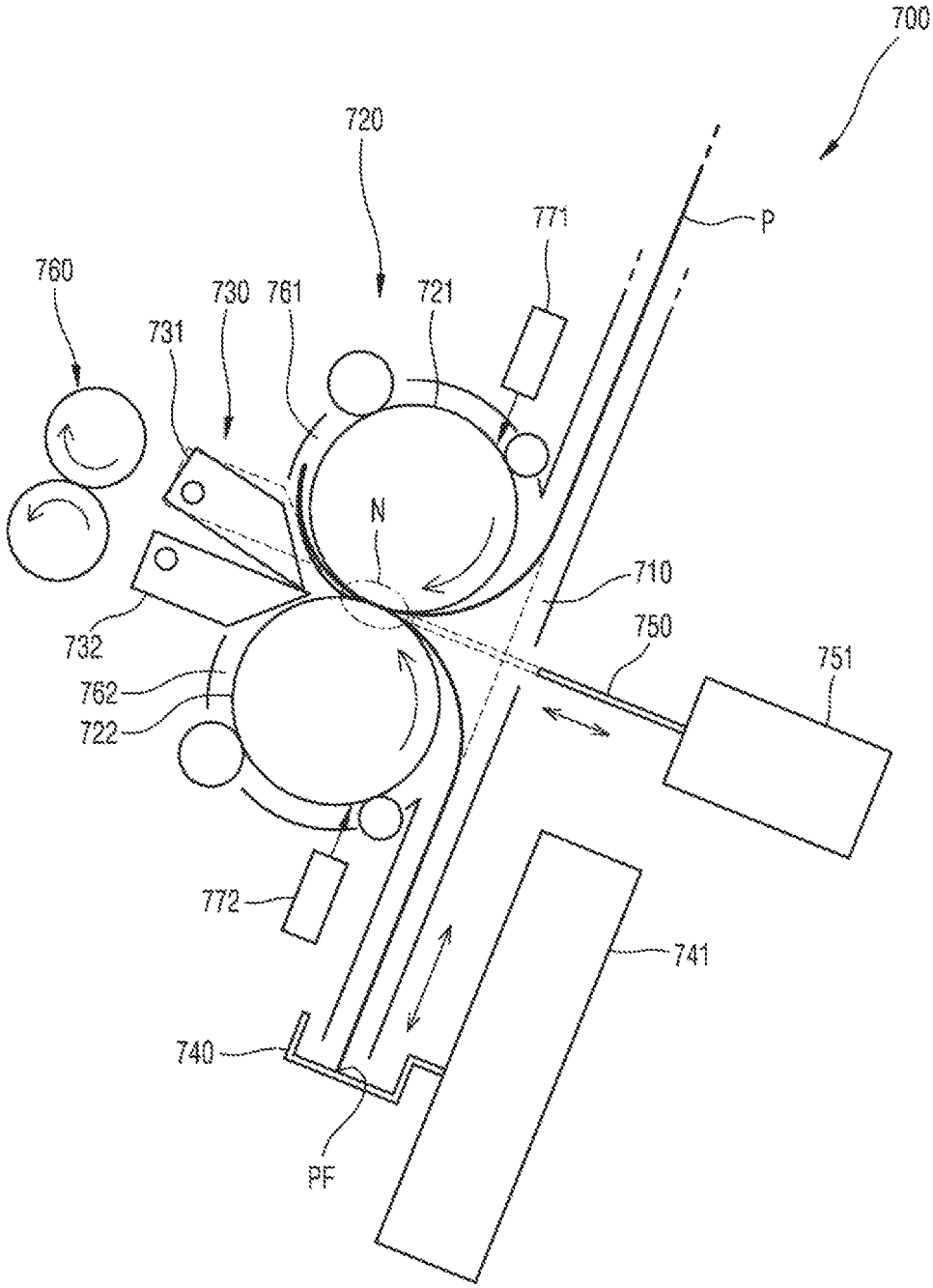
FIG. 3 shows a first shift member in a first shift location.
Figure 4:
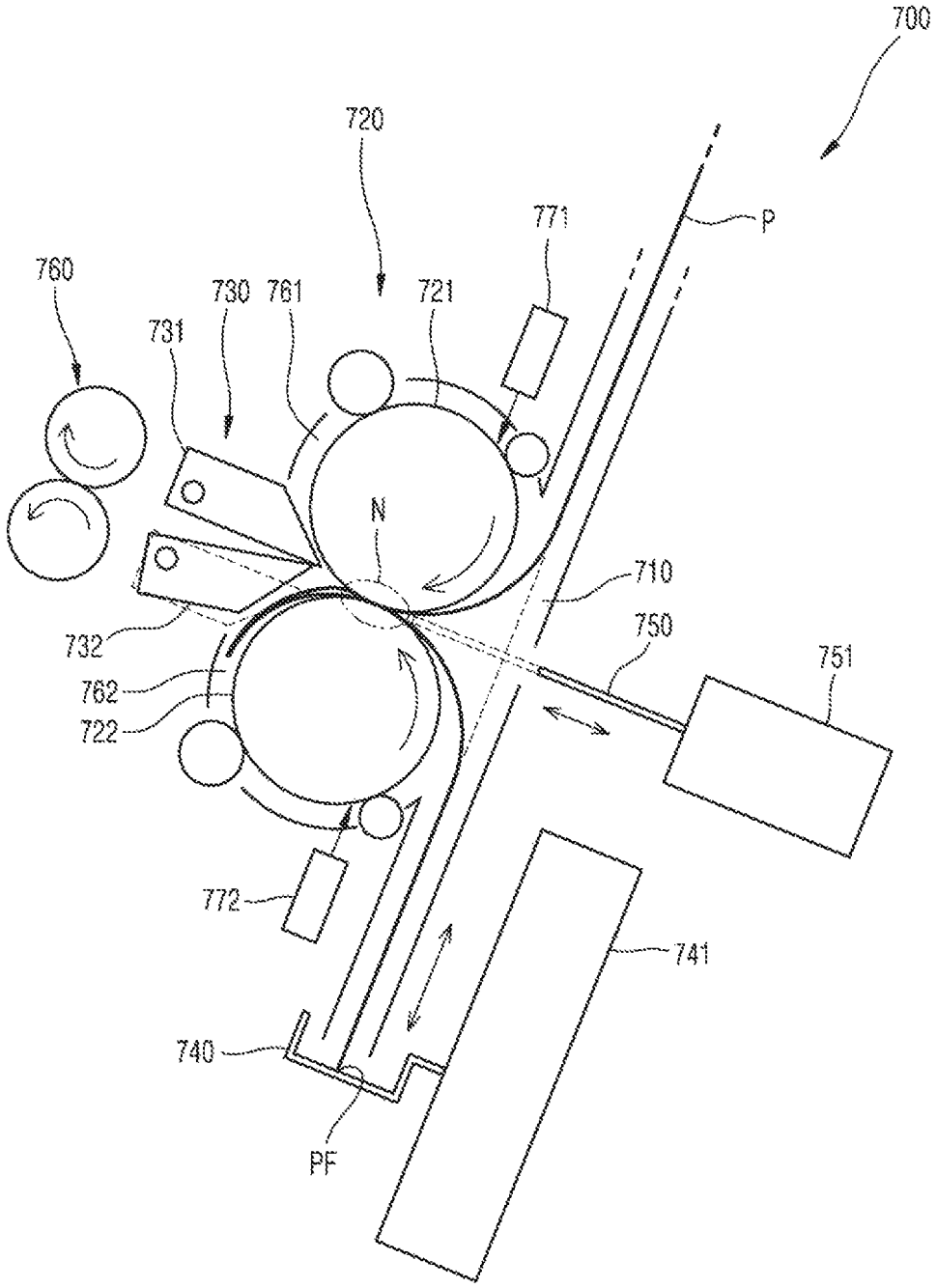
FIG. 4 shows a second shift member in a second shift location.

The sheet folding apparatus 700 according to the present example may perform folding two or more times by using one folding roller 720. To achieve this, the sheet folding apparatus 700 includes a guide path to guide the paper P having passed through the folding nip N to the folding path 710 again and returning the paper P to the entrance of the folding nip N, and a shift member 730 for selectively guiding the paper P to the discharge roller 760 or the guide path, the shift member 730 located at the exit of the folding nip N. The guide path is provided around at least one of the first roller 721 or the second roller 722. In the present example, the guide path includes a first guide path 761 and a second guide path 762 respectively provided around the first roller 721 and the second roller 722, and the shift member 730 includes a first shift member 731 for selectively guiding the paper P to the first guide path 761, and a second shift member 732 for selectively guiding the paper P to the second guide path 762. Although not illustrated, an actuator for driving the first and second shift members 731 and 732 may be provided. The actuator may be, for example, a solenoid actuator. First and second sensors 771 and 772 to detect the paper P may be respectively arranged in the first and second guide paths 761 and 762. The first and second sensors 771 and 772 provide a reference for determining second, third, or subsequent folding timing, that is, driving timing of the push member 750. Although not denoted by reference numerals in FIG. 2, but denoted with numeral 770 in FIGS. 6D, 6E, 6F, etc., driven rollers engaging with the first and second rollers 721 and 722 to feed the paper P may be provided in the first and second guide paths 761 and 762. In the present example, the first roller 721 and the second roller 722 define side guides (inner guides) of the first and second guide paths 761 and 762. That is, the paper P having passed through the folding nip N is fed along the first and second guide paths 761 and 762 in a direction winding around the first and second rollers 721 and 722 and is returned in a direction toward the entrance of the folding nip N. Referring to FIG. 2, the first and second shift members 731 and 732 are in discharge locations to guide the paper P to the discharge roller 760. FIGS. 3 and 4 show states of the shift member 730. Referring to FIG. 3, the first shift member 731 is in a first shift location. The paper P having come out from the folding nip N is guided to the first guide path 761 by the first shift member 731. Referring to FIG. 4, the second shift member 732 is in a second shift location. The paper P having come out from the folding nip N is guided to the second guide path 762 by the second shift member 732.

By the above configuration, folding may be performed twice by returning the paper P folded once to the entrance of the folding nip N via the first guide path 761 or the second guide path 762 and pushing the paper P into the folding nip N by using the push member 750 again. A 4-fold may be performed by once again folding a central portion of the paper P that has already been folded once. Also, a C-fold or a Z-fold, which is a 3-fold outside, may be performed by performing folding twice by using the first guide path 761 or the second guide path 762. Also, a double gate fold, a roll-fold, a W-fold, etc. may be performed by performing folding three times while allowing the paper P to sequentially pass through the first guide path 761 and the second guide path 762.

Hereinafter, paper folding methods according to the examples illustrated in FIGS. 2 to 4 will be described.

[V-Fold]

Figure 5A:
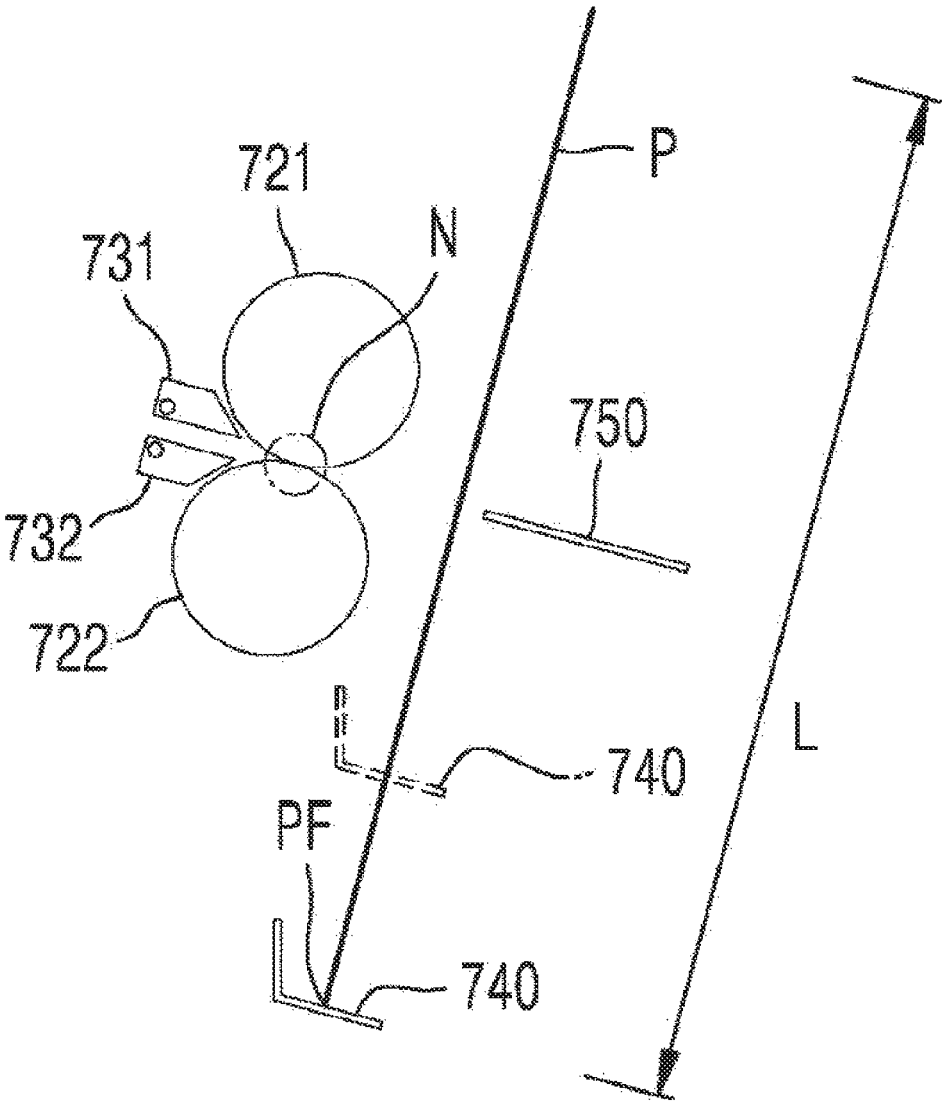
FIGS. 5A-5C show an example of a V-fold process.
Figure 5B:
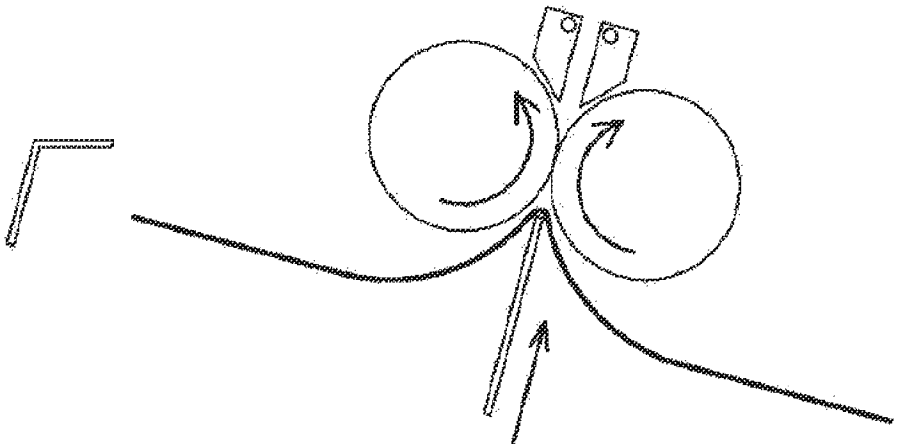
Figure 5C:
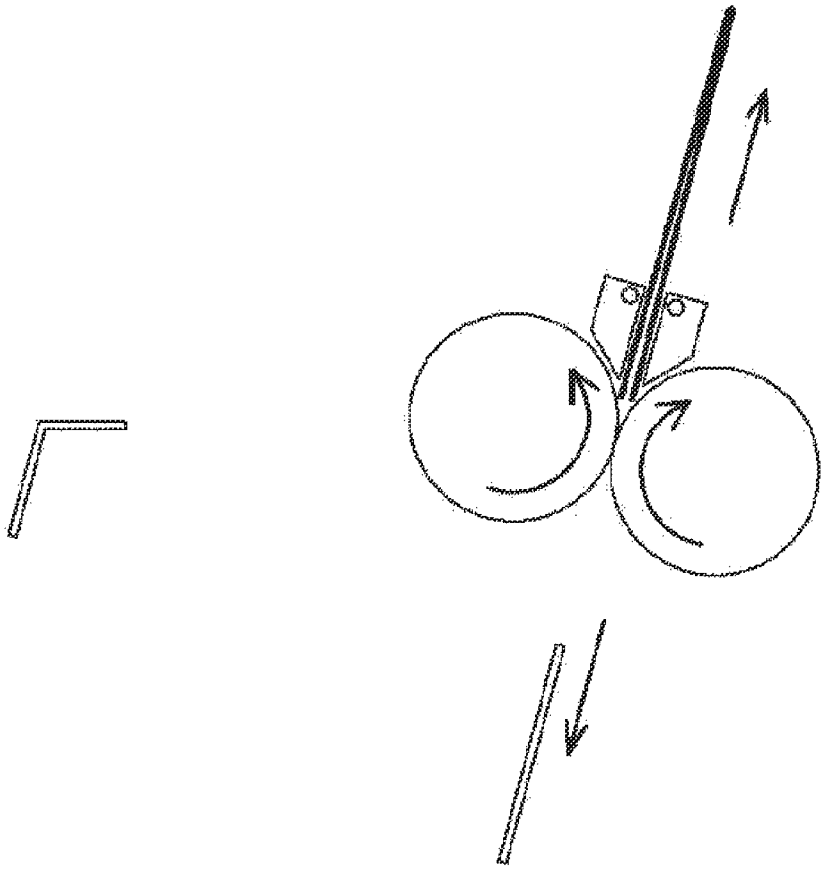

FIGS. 5A-5C show an example of a V-fold process. In FIGS. 5A-5C, the first and second rollers 721 and 722, the positioning member 740, the push member 750, and the first and second shift members 731 and 732 are illustrated.

As illustrated in FIG. 5A, the positioning member 740 is located such that a central portion of the paper P is located at an entrance of the folding nip N. That is, a distance from the folding nip N to the positioning member 740 is ½ of a length L of the paper P. The paper P is fed along the folding path 710. In an example, the paper P may be discharged from a printer, such as printer 100, and fed along the folding path 710. The first end PF of one piece or a plurality of pieces of paper P is supported by the positioning member 740. A ½L point of the paper P is pushed into the folding nip N by moving the push member 750 to an insertion location (FIG. 5B). As the paper P passes through the folding nip N, the ½L point is folded. The first and second shift members 731 and 732 are placed in discharge locations. Accordingly, the paper P folded in the form of a V is discharged by the discharge roller 760 (FIG. 5C).

A plurality of pieces of paper P may be in a state of being stapled at a central portion thereof by a stapler, such as the middle stapler 600. In this case, the positioning member 740 is moved to a location denoted by dashed lines in FIG. 5A. When, in this state, the first end PF of the plurality of pieces of paper P is supported by the positioning member 740, a ½L point of the plurality of pieces of paper P is placed at the stapler. The plurality of pieces of paper P may be stapled at the ½L point thereof by using the stapler. The positioning member 740 is moved to a location denoted by solid lines in FIG. 5A. The ½L point of the plurality of pieces of paper P is pushed into the folding nip N by moving the push member 750 to an insertion location (FIG. 5B). The push member 750 returns to a retreat location. As the plurality of pieces of paper P pass through the folding nip N, the ½L point is folded. The first and second shift members 731 and 732 are placed in discharge locations. Accordingly, the plurality of pieces of paper P folded in the form of a V are discharged by the discharge roller 760 (FIG. 5C).

[4-Fold]

FIGS. 6A-6G show an example of a 4-fold process. In FIGS. 6A-6G, the first and second rollers 721 and 722, the positioning member 740, the push member 750, and the first and second shift members 731 and 732 are illustrated.

Figure 6A:
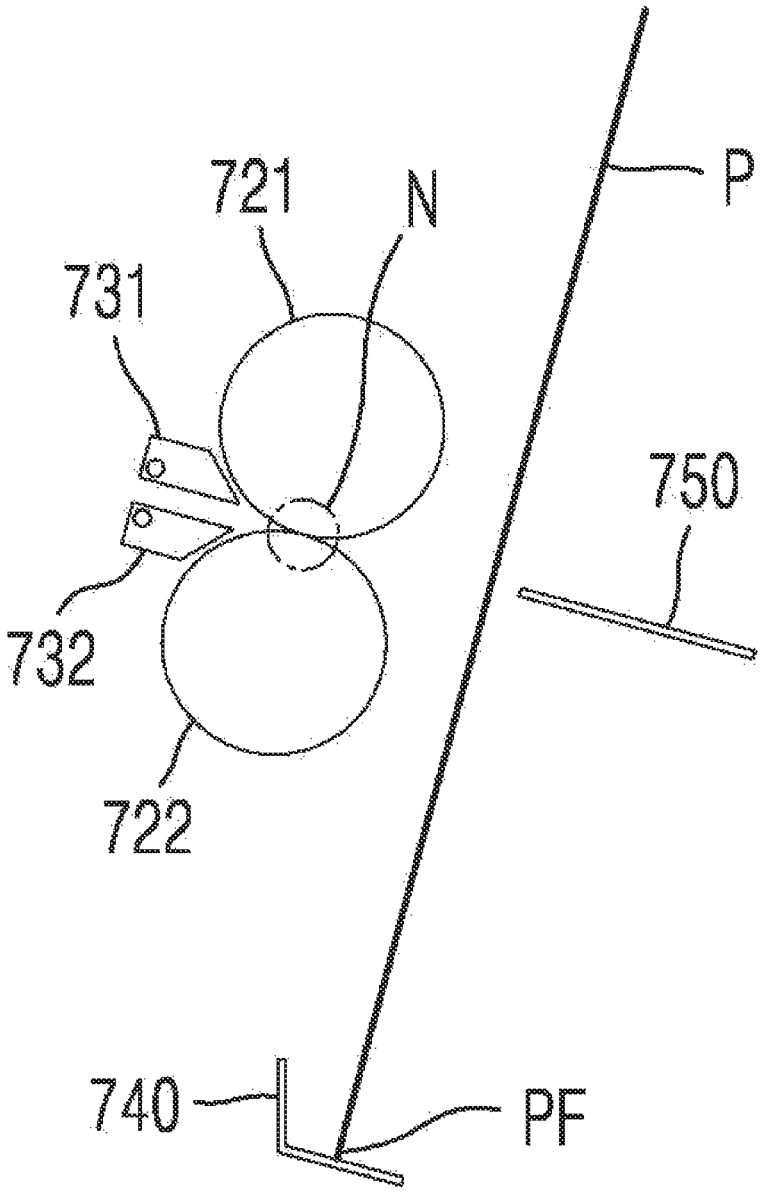
FIGS. 6A-6G show an example of a 4-fold process.
Figure 6B:
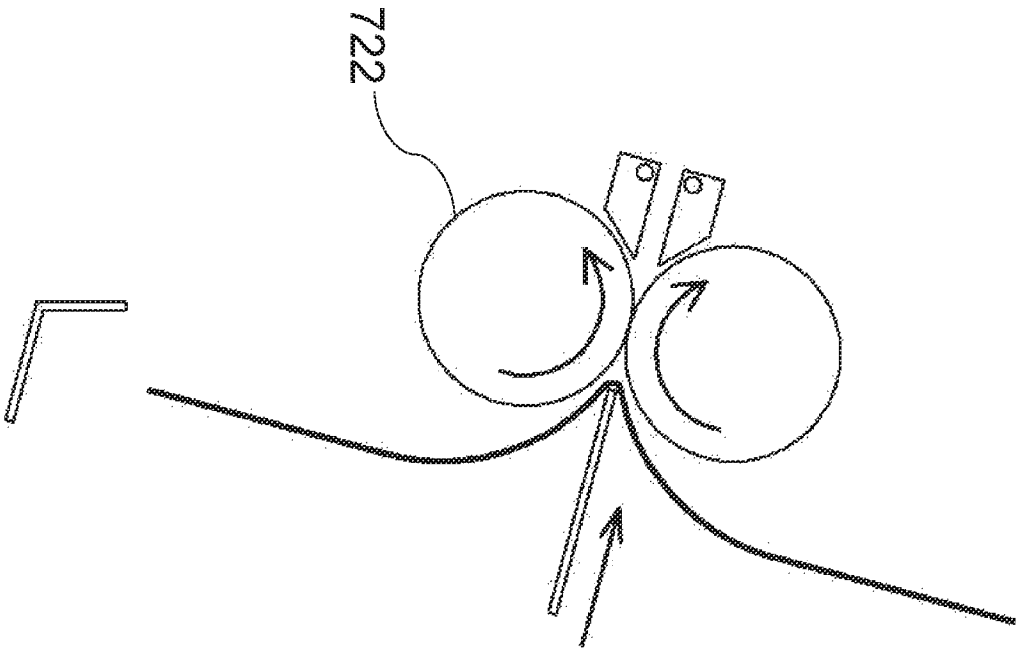

As illustrated in FIG. 6A, the positioning member 740 is located such that a ½L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ½L point of the paper P is pushed into the folding nip N by moving the push member 750 to an insertion location (FIG. 6B). As the paper P passes through the folding nip N, the ½L point is folded. The push member 750 returns to a retreat location.

Figure 6C:
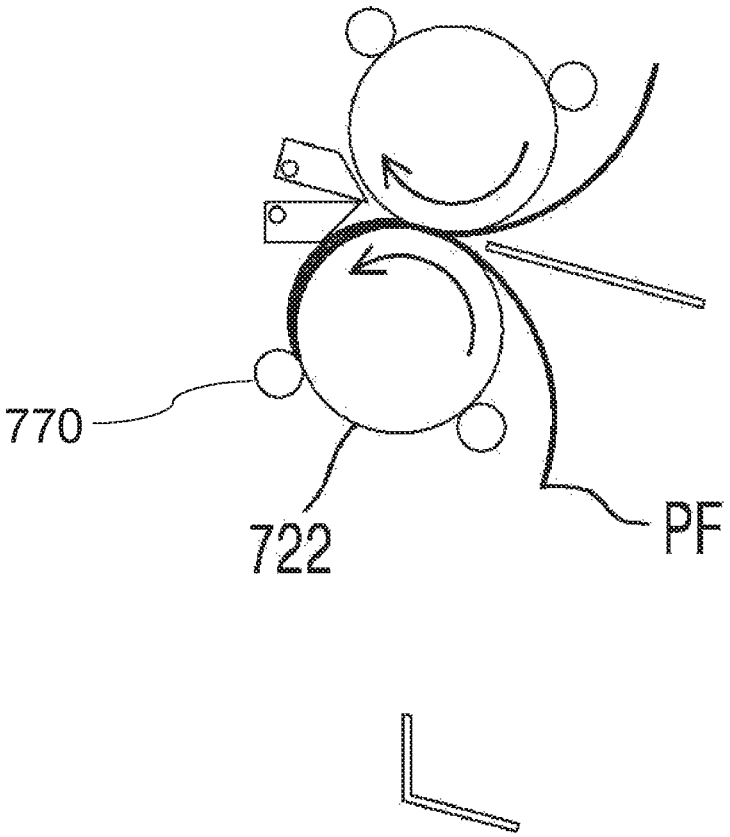
Figure 6D:
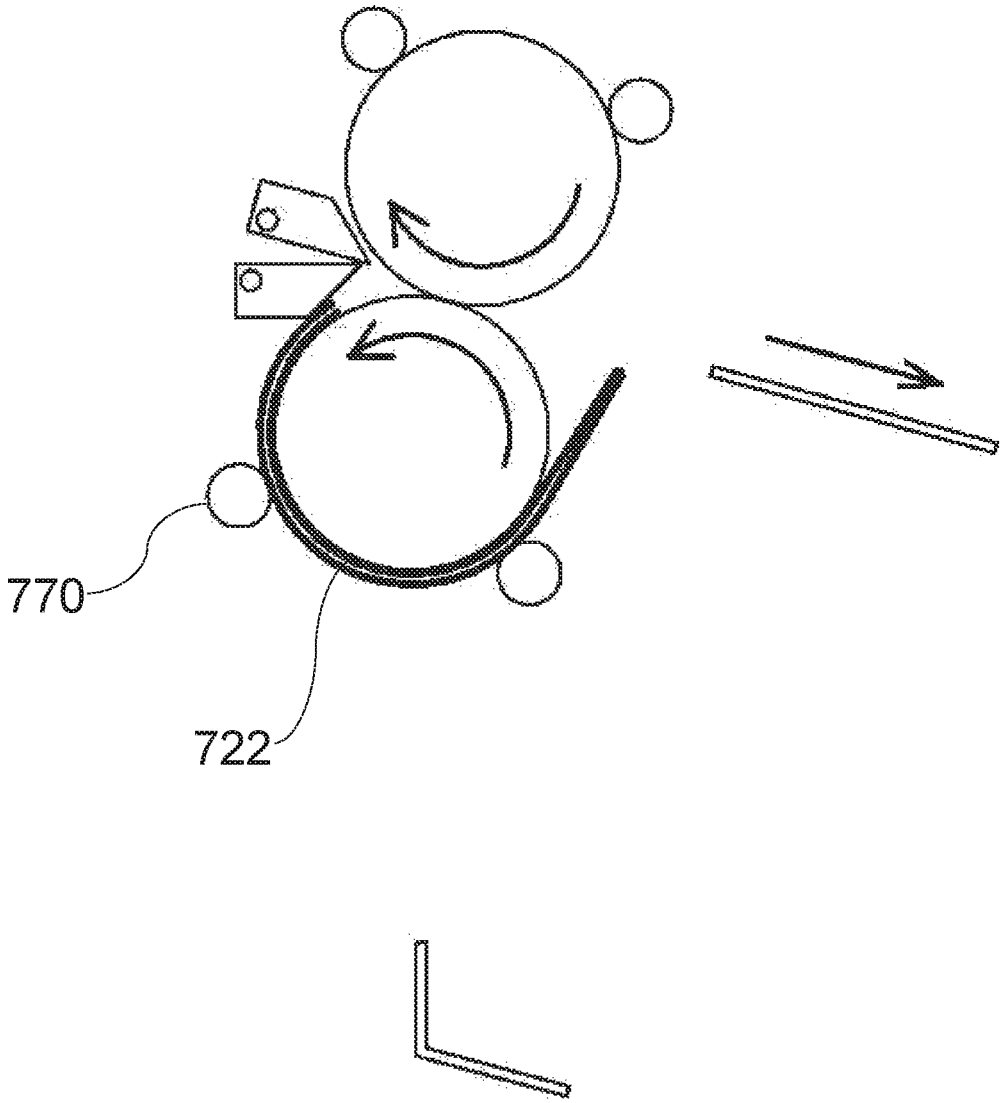

The paper P having passed through the folding nip N is fed along the first guide path 761 or the second guide path 762 and is returned to the entrance of the folding nip N. In the present example, the second shift member 732 is placed in a second shift location, and the paper P having passed through the folding nip N is returned to the entrance of the folding nip N along the second guide path 762 (FIG. 6C and FIG. 6D). The driven rollers 770 are to rotatably engage with the first and second rollers 721, 722 to feed the paper P along the first guide path 761 or the second guide path 762.

Figure 6E:
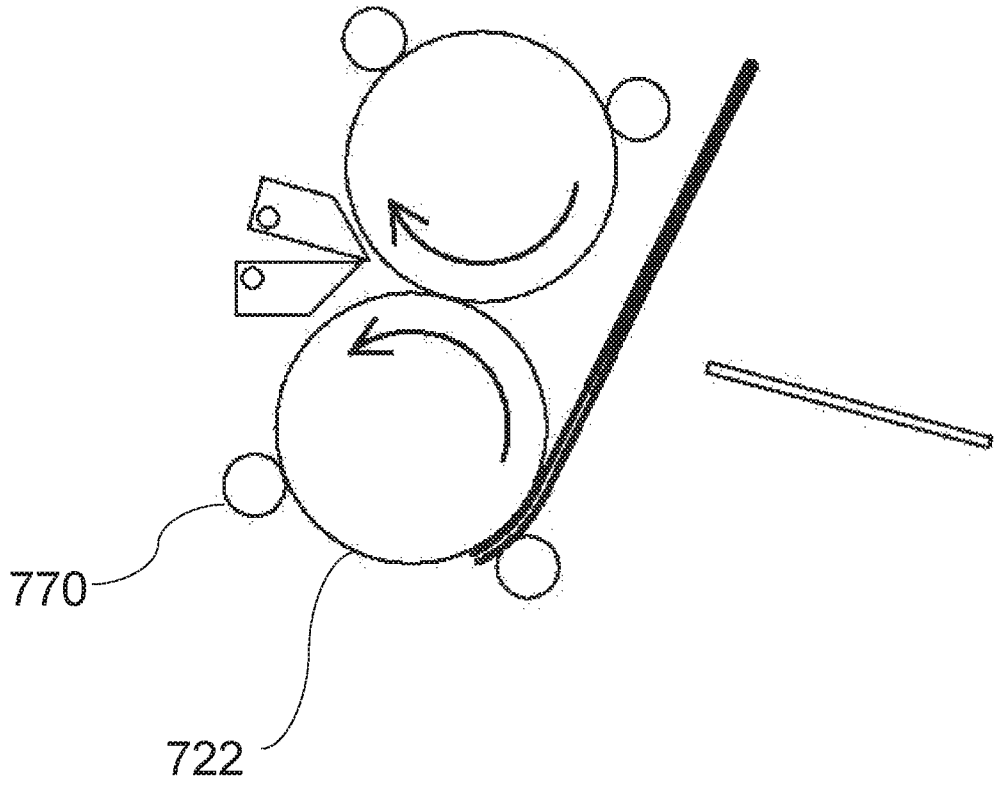
Figure 6F:
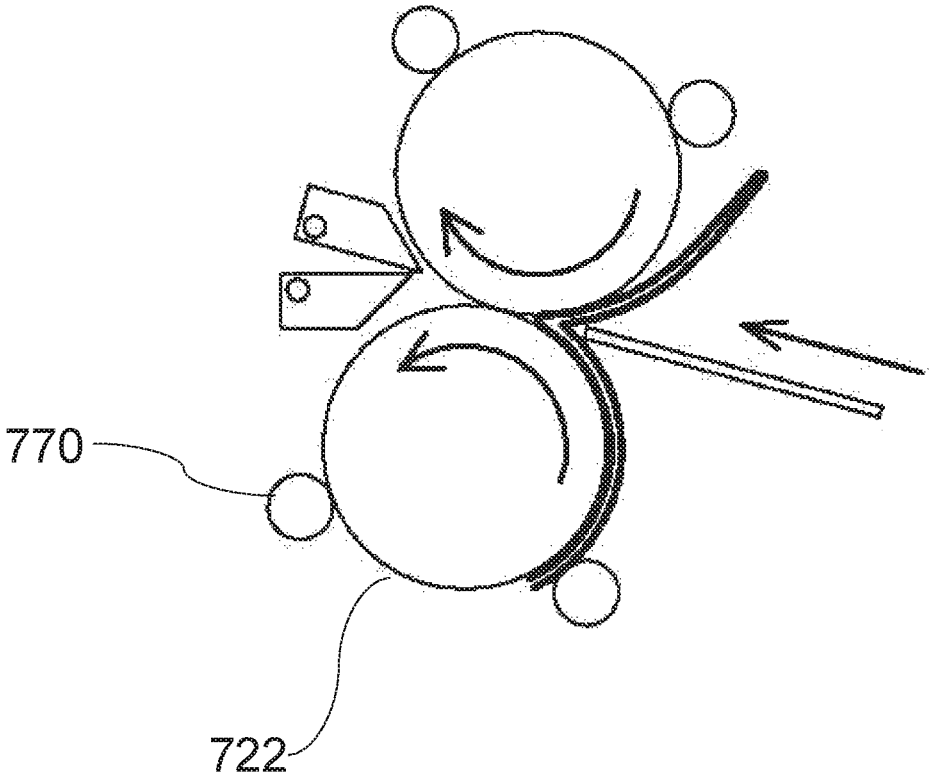
Figure 6G:
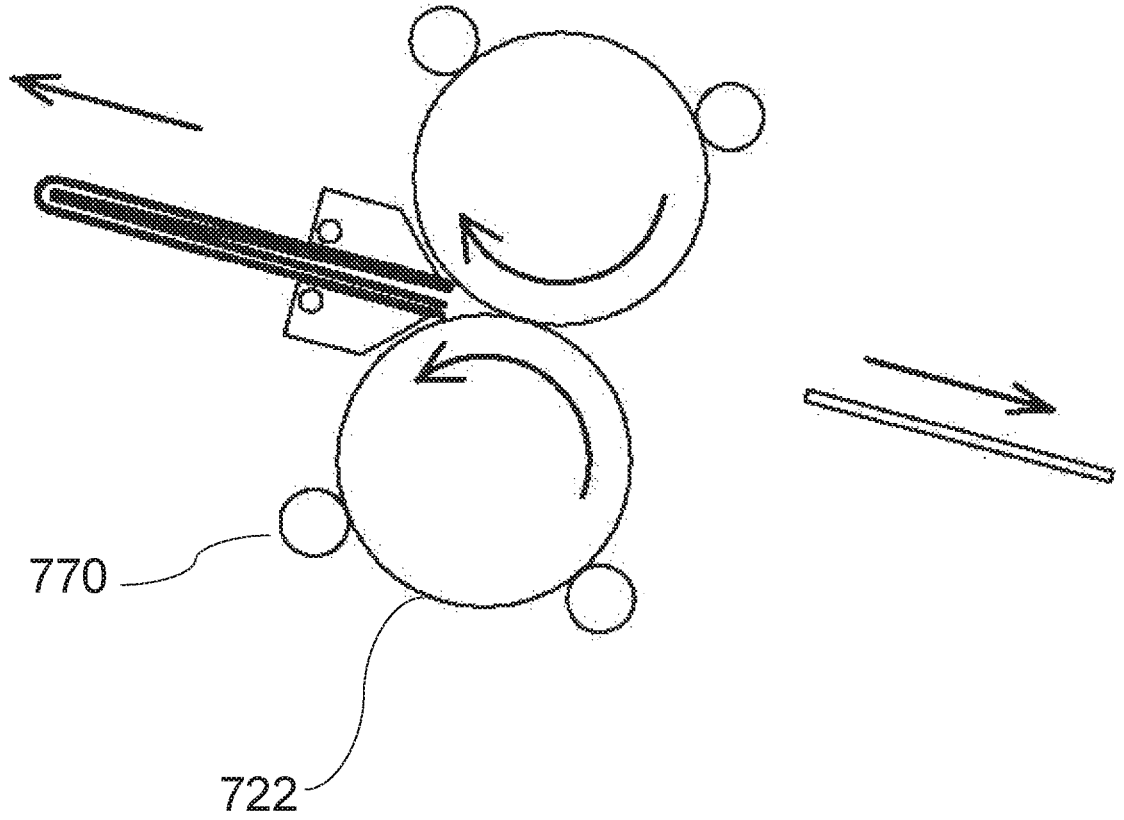

When the paper P is fed along the folding path 710 in a reverse direction, and a central portion of the paper P that is folded once, that is, a ¼L point of the paper P, reaches the vicinity of the folding nip N (FIG. 6E), the ¼L point of the paper P is pushed into the folding nip N by moving the push member 750 to the insertion location (FIG. 6F). The first and second shift members 731 and 732 are placed in discharge locations. Accordingly, the paper P that is folded twice is discharged by the discharge roller 760 (FIG. 6(*g*)). The push member 750 returns to the retreat location.

[Z-Fold or 3-Fold Outside]

FIGS. 7A-7G shows an example of a Z-fold or 3-fold outside process. In FIGS. 7A-7G, the first and second rollers 721 and 722, the positioning member 740, the push member 750, and the first and second shift members 731 and 732 are illustrated.

Figure 7A:
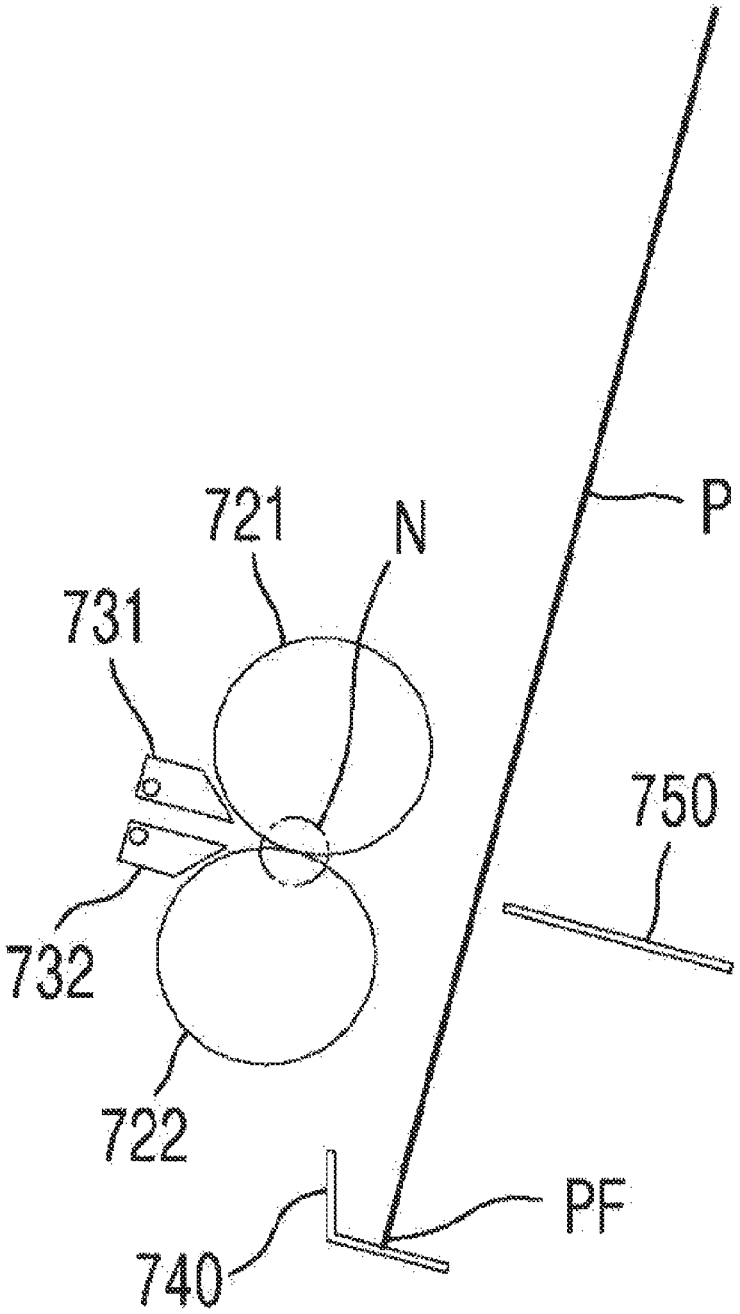
FIGS. 7A-7G show an example of a Z-fold or 3-fold outside process.
Figure 7B:
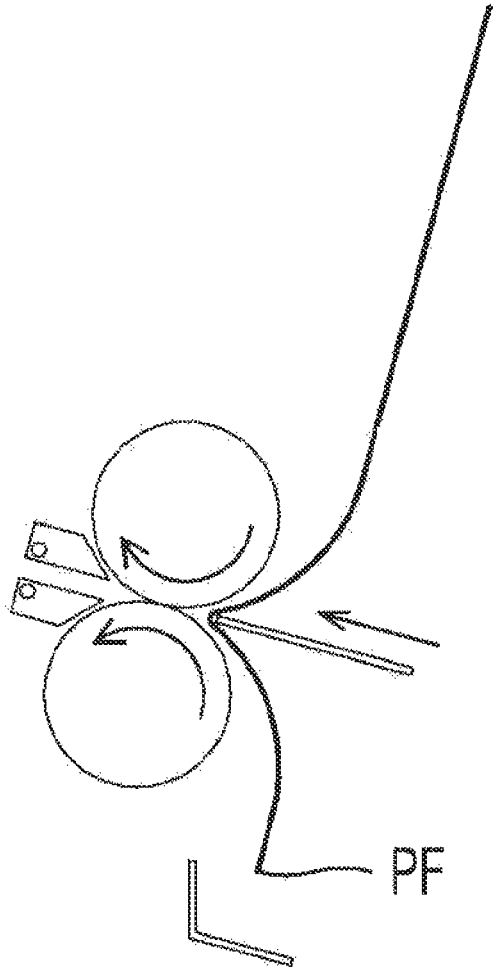

As illustrated in FIG. 7A, the positioning member 740 is located such that a ¼L point (in the case of the 3-fold outside, a ⅓L point) of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ¼L point (in the case of the 3-fold outside, the ½L point) of the paper P is pushed into the folding nip N by moving the push member 750 to an insertion location (FIG. 7B). As the paper P passes through the folding nip N, the ¼L point (in the case of the 3-fold outside, the ⅓L point) is folded. The push member 750 returns to a retreat location.

Figure 7C:
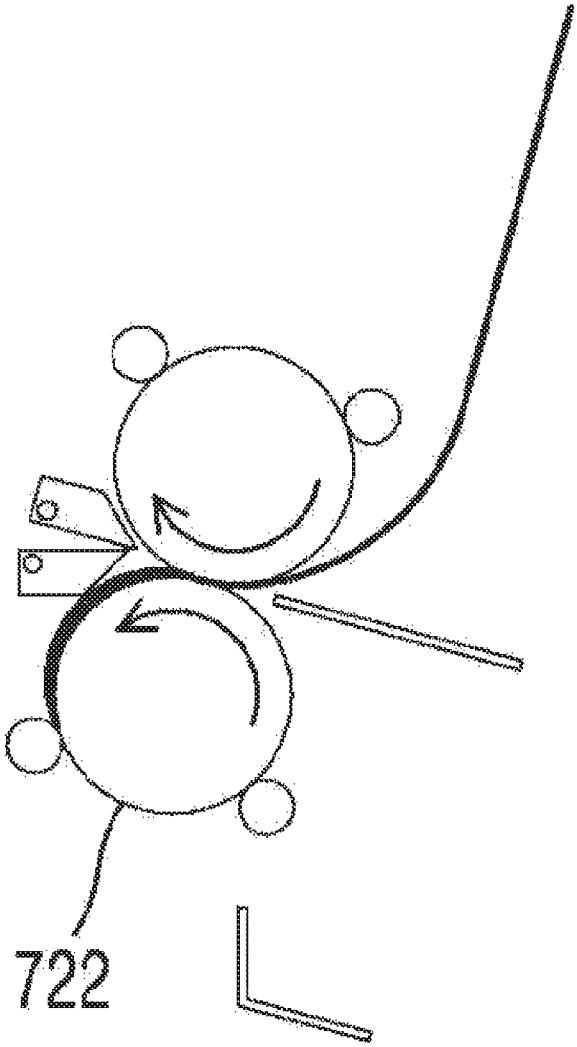
Figure 7D:
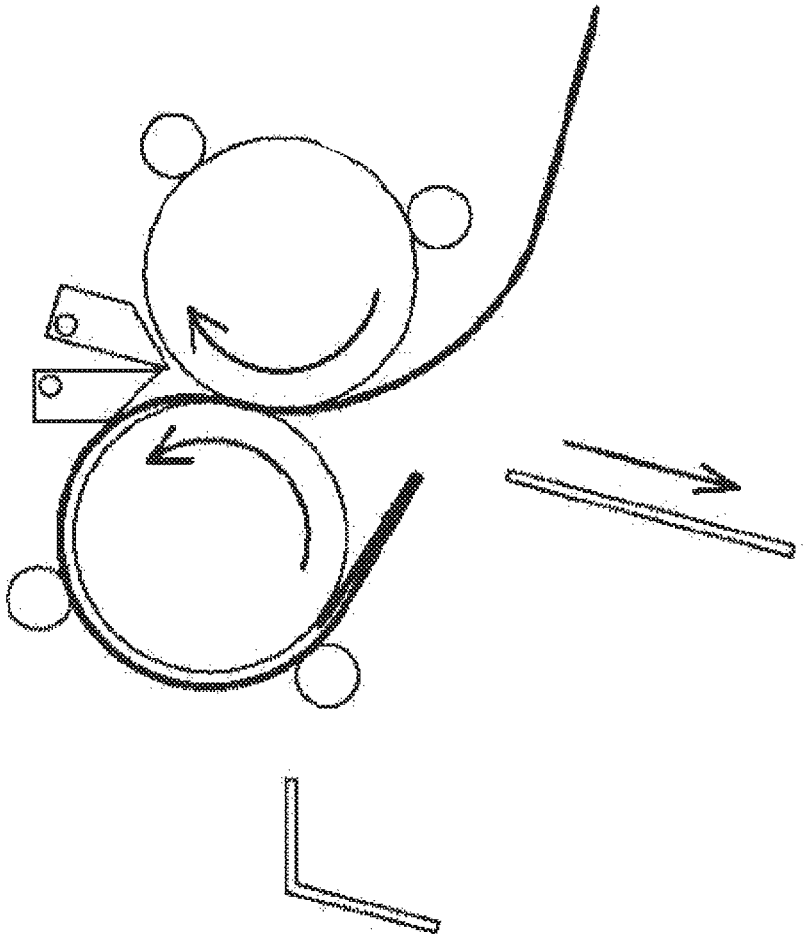
Figure 7E:
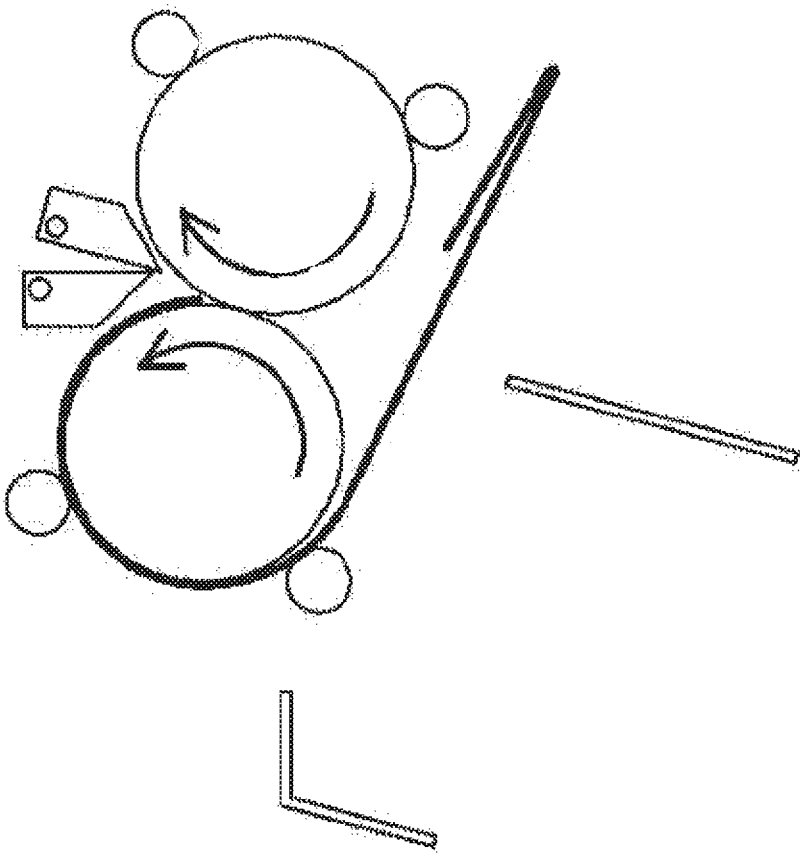
Figure 7F:
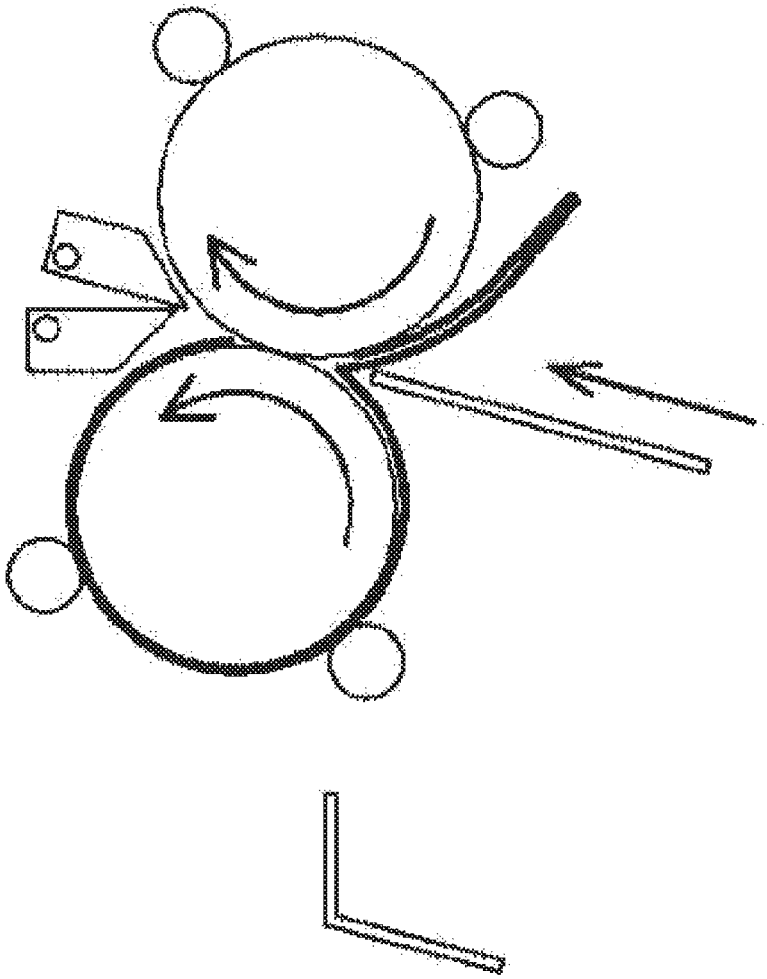
Figure 7G:
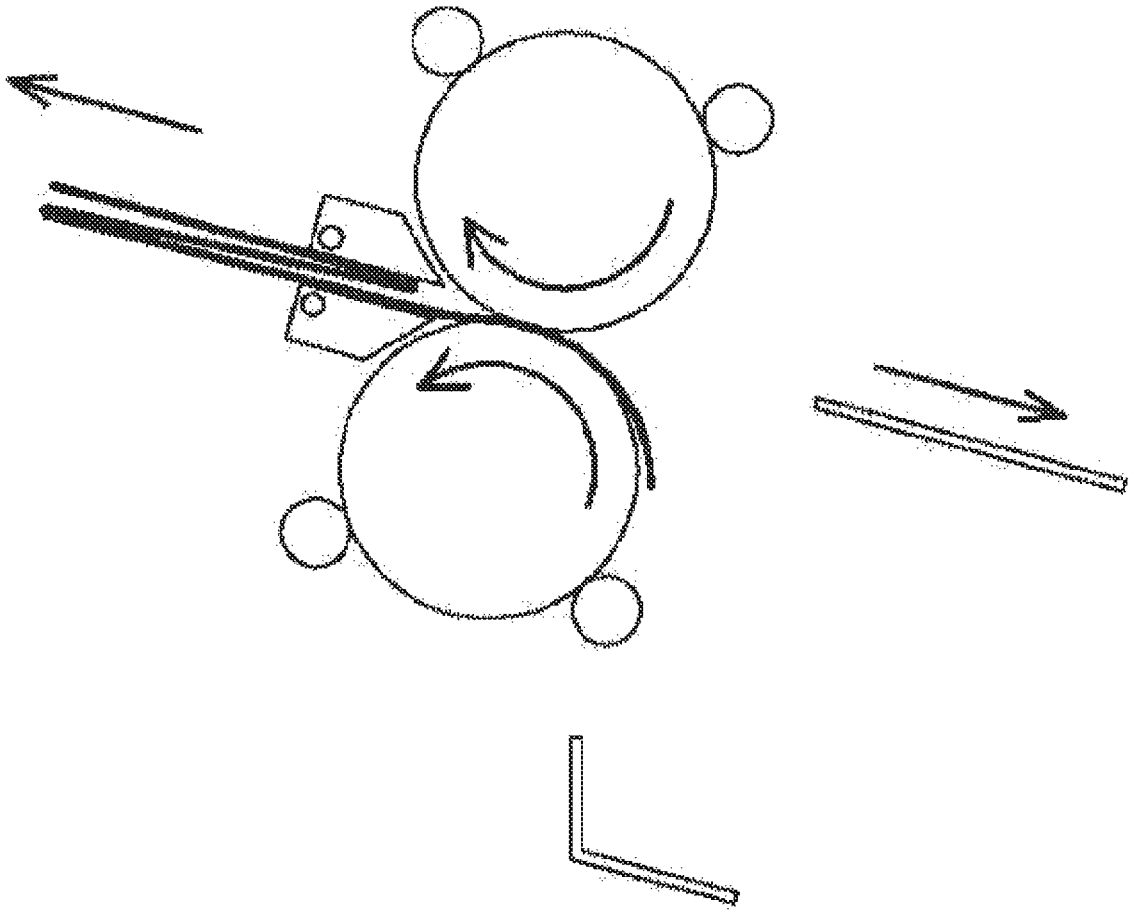

The paper P having passed through the folding nip N is fed around a roller on a side of the first end PF of the paper P from among the first and second rollers 721 and 722, that is, the second roller 722, and is returned to the entrance of the folding nip N. To achieve this, the second shift member 732 is placed in a second shift location, and the paper P having passed through the folding nip N is returned to the entrance of the folding nip N along the second guide path 762 (FIG. 7C and FIG. 7D). When the paper P is fed along the folding path 710 in a reverse direction, and a ½L point (in the case of the 3-fold outside, a ⅔L point) of the paper P reaches the vicinity of the folding nip N (FIG. 7E), the ½L point (in the case of the 3-fold outside, the ⅔L point) of the paper P is pushed into the folding nip N by moving the push member 750 to the insertion location (FIG. 7F). The first and second shift members 731 and 732 are placed in discharge locations. Accordingly, the paper P folded in the form of a Z (in the form of a 3-fold) is discharged by the discharge roller 760 (FIG. 7G). The push member 750 returns to the retreat location.

[C-Fold]

FIGS. 8A-8G show an example of a C-fold process. In FIGS. 8A-8G, the first and second rollers 721 and 722, the positioning member 740, the push member 750, and the first and second shift members 731 and 732 are illustrated.

Figure 8A:
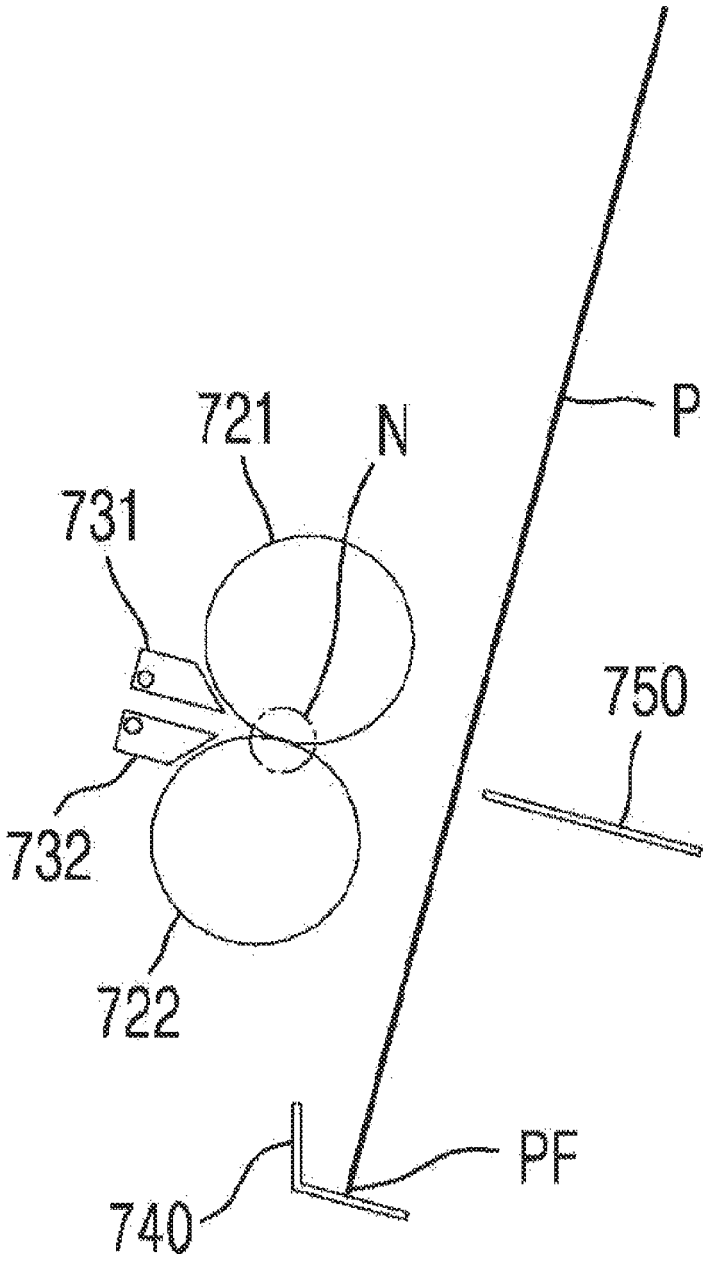
FIGS. 8A-8G show an example of a C-fold process.
Figure 8B:
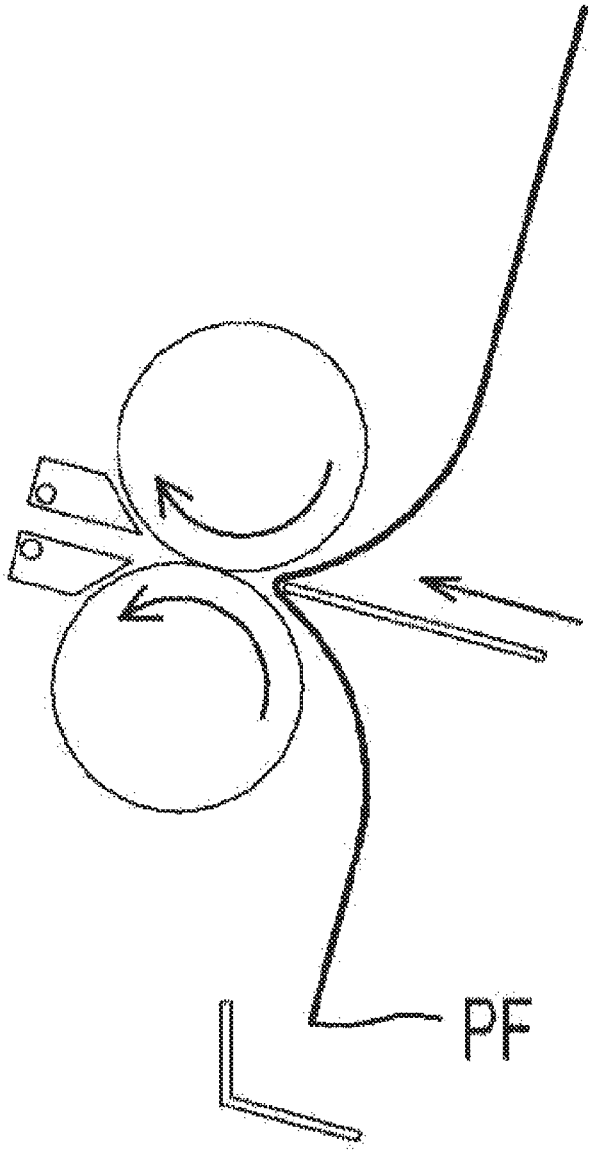

As illustrated in FIG. 8A, the positioning member 740 is located such that a ⅓L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ⅓L point of the paper P is pushed into the folding nip N by moving the push member 750 to an insertion location (FIG. 8B). As the paper P passes through the folding nip N, the ⅓L point is folded. The push member 750 returns to a retreat location.

Figure 8C:
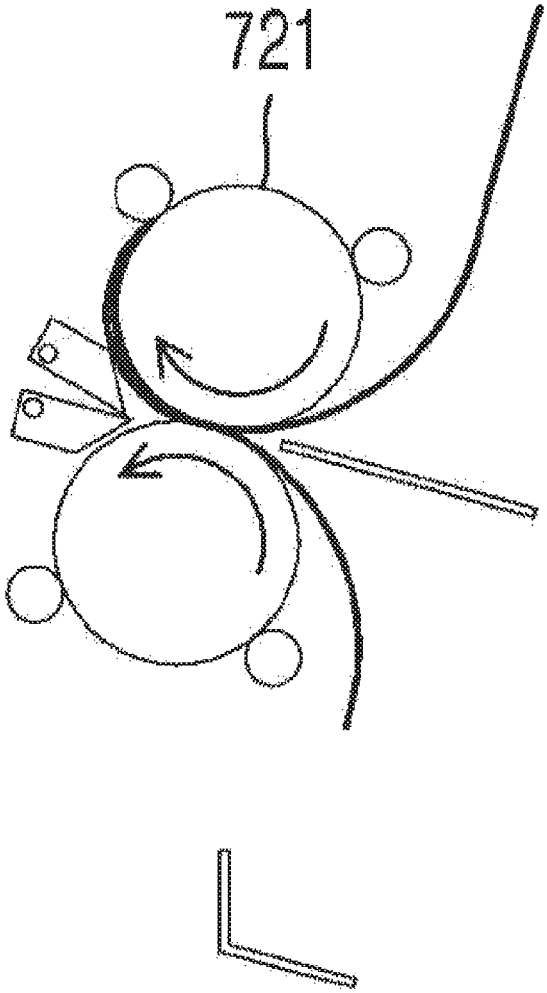
Figure 8D:
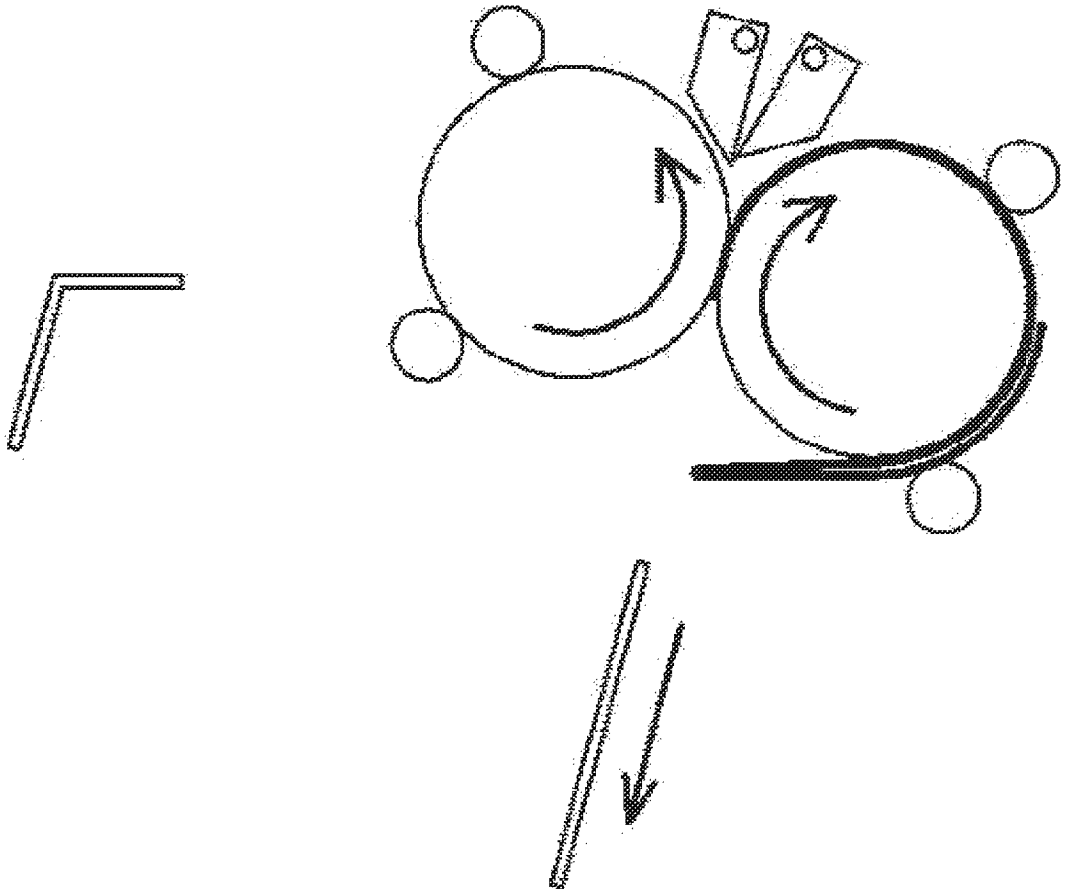
Figure 8E:
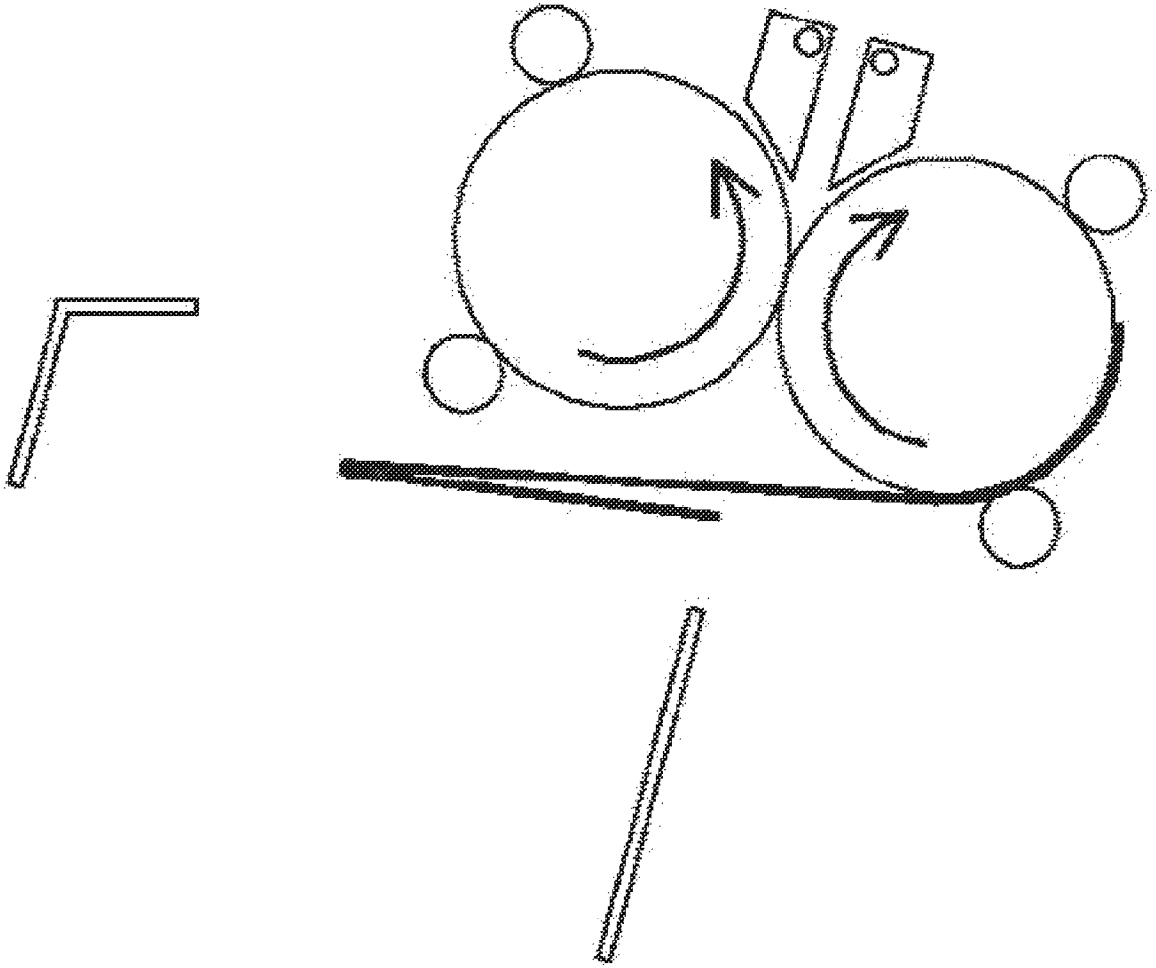
Figure 8F:
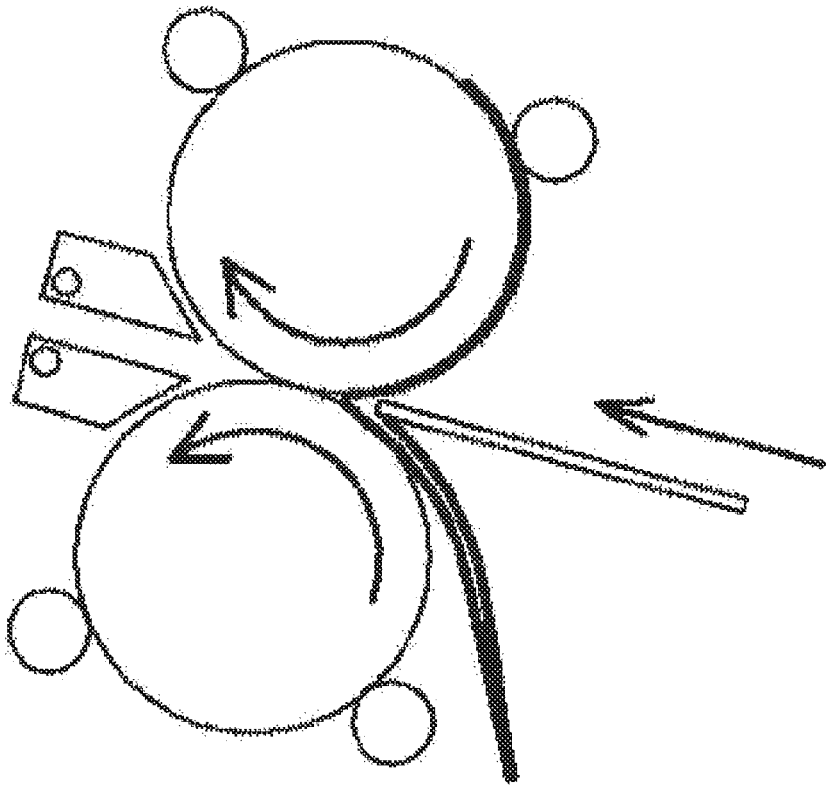
Figure 8F:
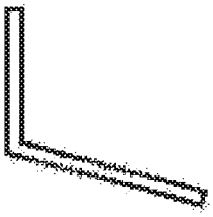
Figure 8G:
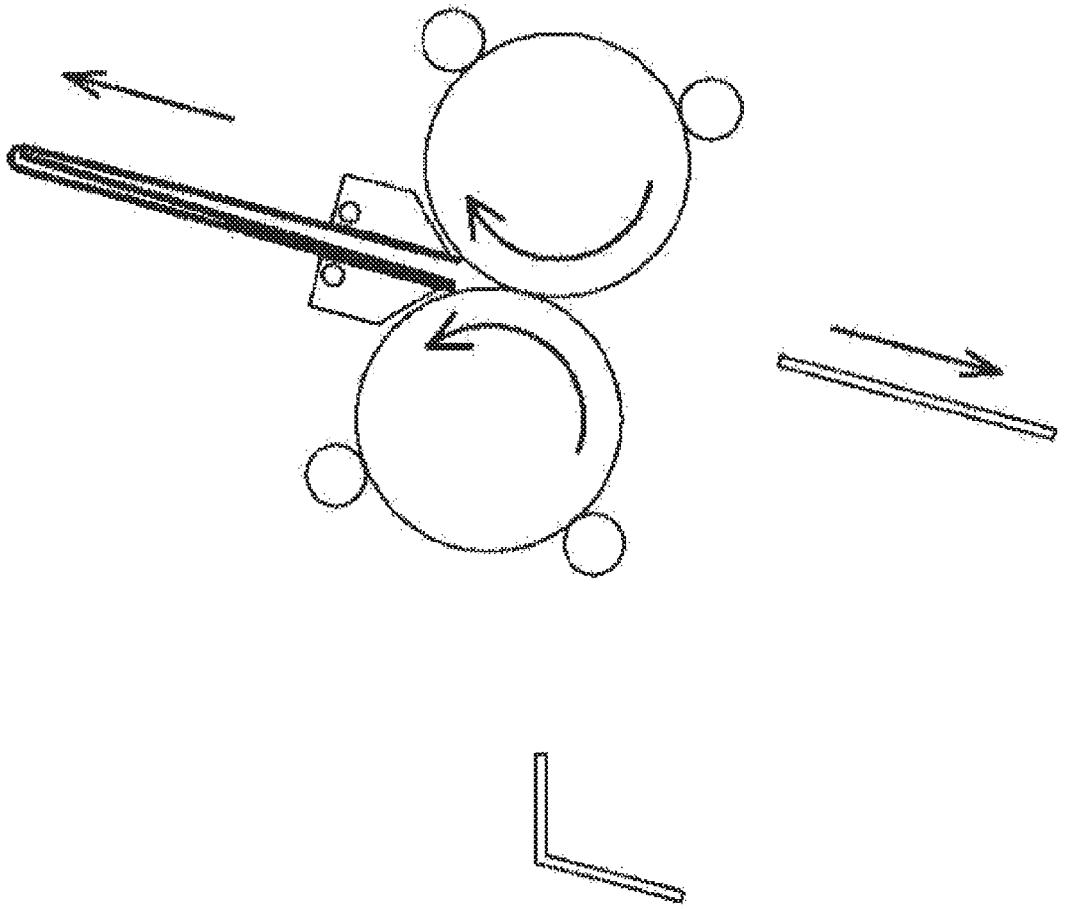

The paper P having passed through the folding nip N is fed around a roller on an opposite side of the first end PF of the paper P from among the first and second rollers 721 and 722, that is, the first roller 721, and is returned to the entrance of the folding nip N. To achieve this, the first shift member 731 is placed in a first shift location, and the paper P having passed through the folding nip N is returned to the entrance of the folding nip N along the first guide path 761 (FIG. 8C and FIG. 8D). When the paper P is fed along the folding path 710 in a forward direction, and a ⅔L point of the paper P reaches the vicinity of the folding nip N (FIG. 8E, the ⅔L point of the paper P is pushed into the folding nip N by moving the push member 750 to the insertion location (FIG. 8F). The first and second shift members 731 and 732 are placed in discharge locations. Accordingly, the paper P folded in the form of a C is discharged by the discharge roller 760 (FIG. 8G). The push member 750 returns to the retreat location.

[Double Gate Fold]

FIGS. 9A-9J show an example of a double gate fold process. In FIGS. 9A-9J, the first and second rollers 721 and 722, the positioning member 740, the push member 750, and the first and second shift members 731 and 732 are illustrated.

Figure 9A:
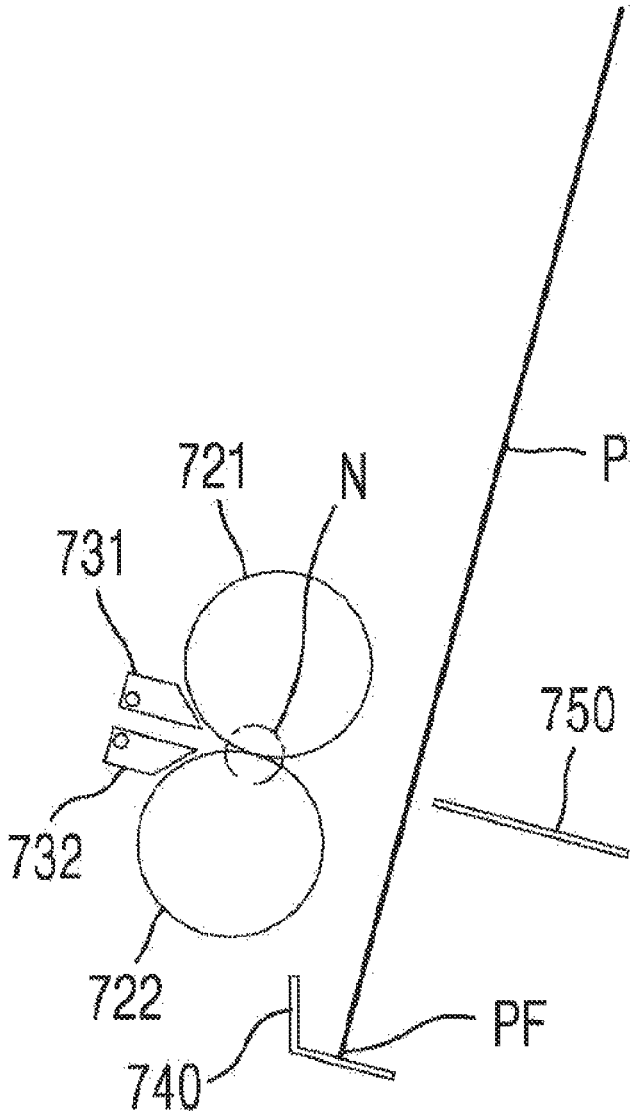
FIGS. 9A-9J show an example of a double gate fold process.
Figure 9B:
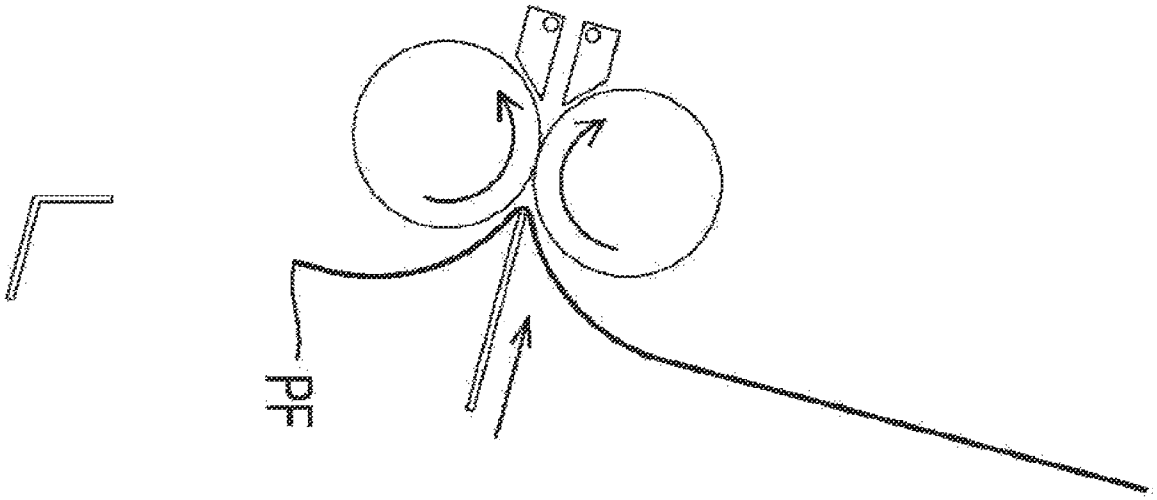

As illustrated in FIG. 9A, the positioning member 740 is located such that a ¼L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ¼L point of the paper P is pushed into the folding nip N by moving the push member 750 to an insertion location (FIG. 9B). As the paper P passes through the folding nip N, the ¼L point is folded. The push member 750 returns to a retreat location.

Figure 9C:
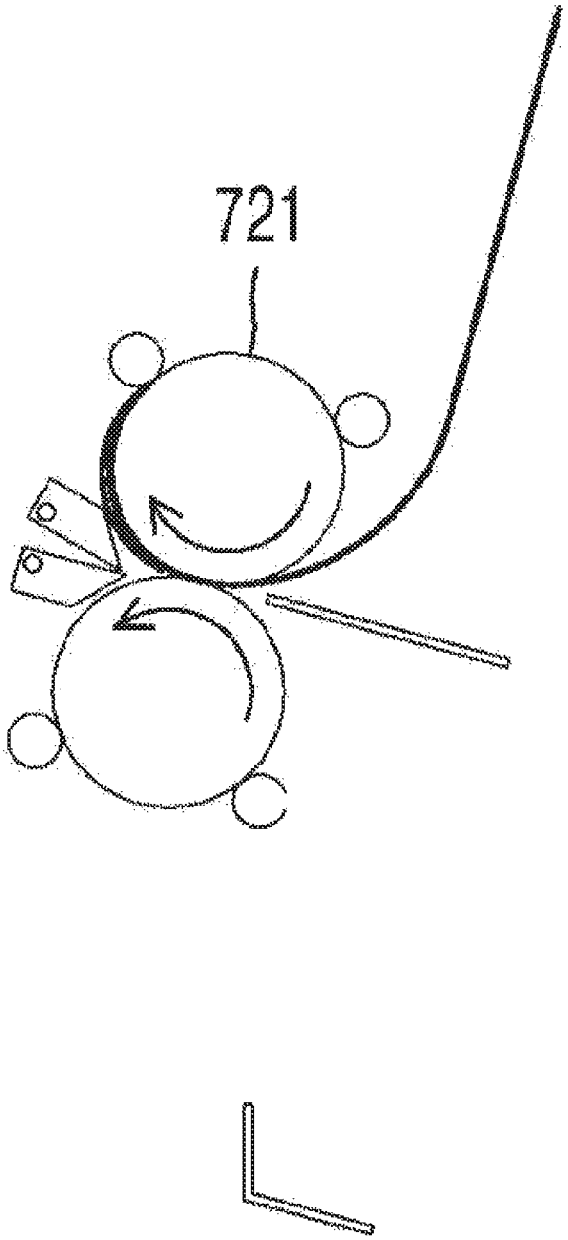
Figure 9D:
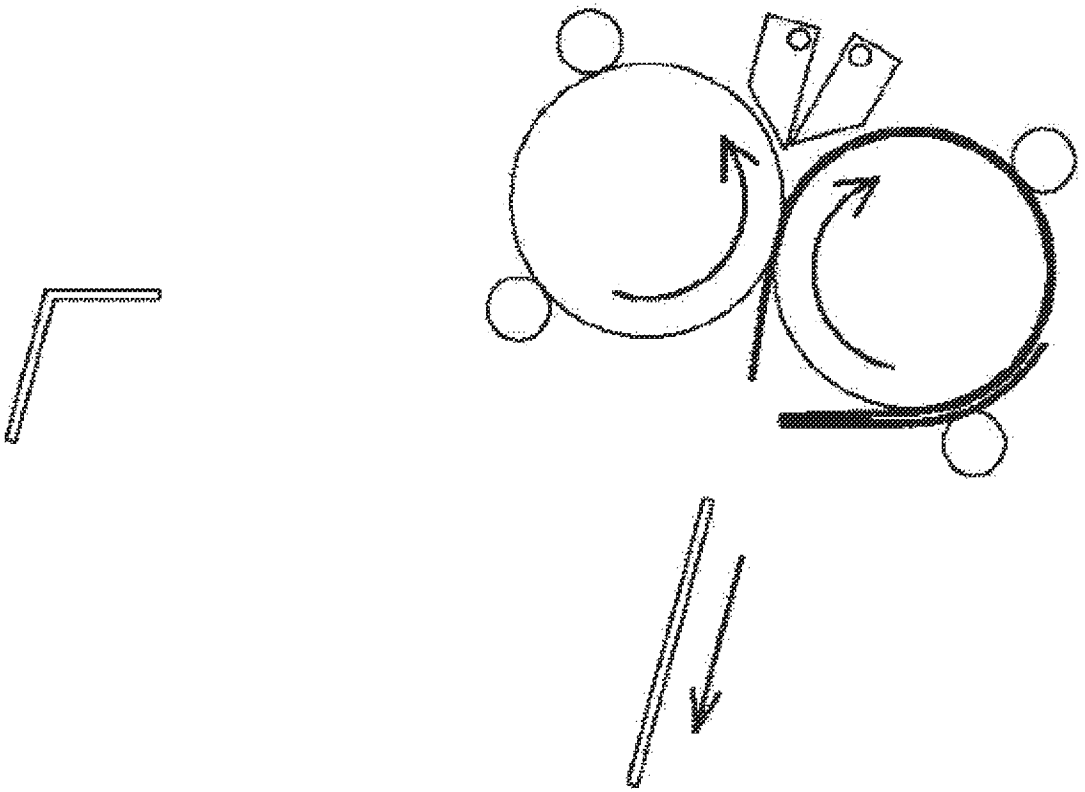
Figure 9E:
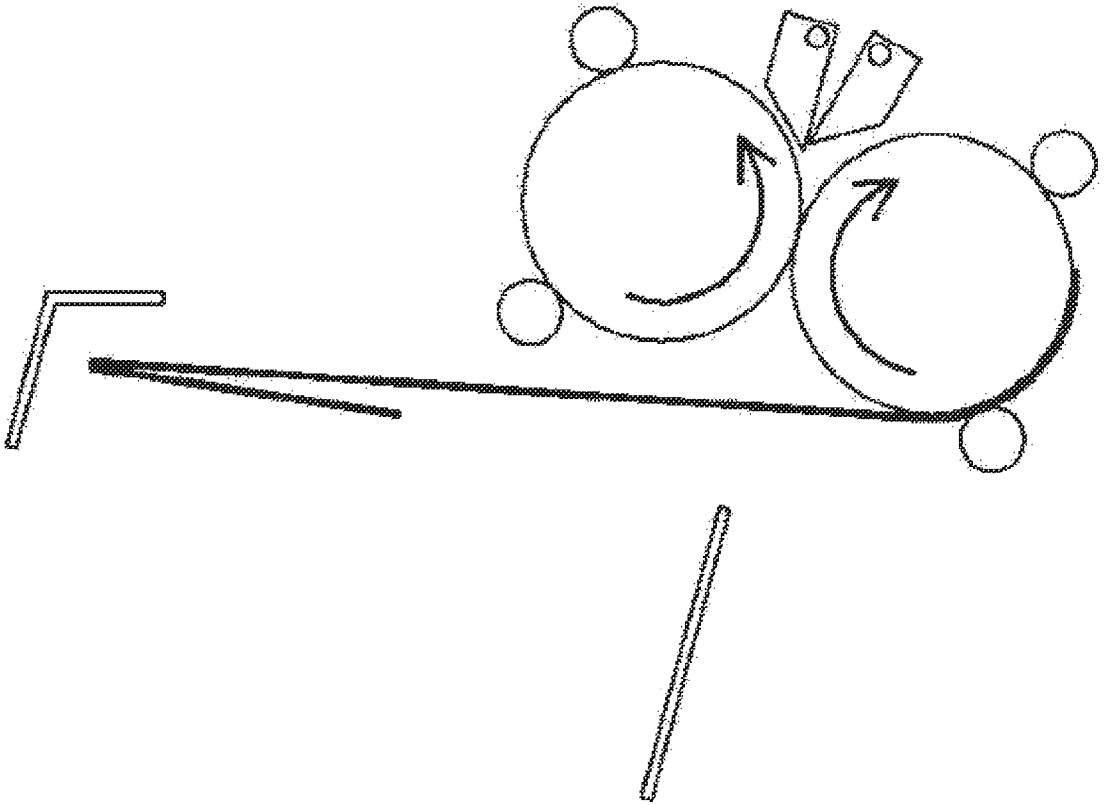
Figure 9F:
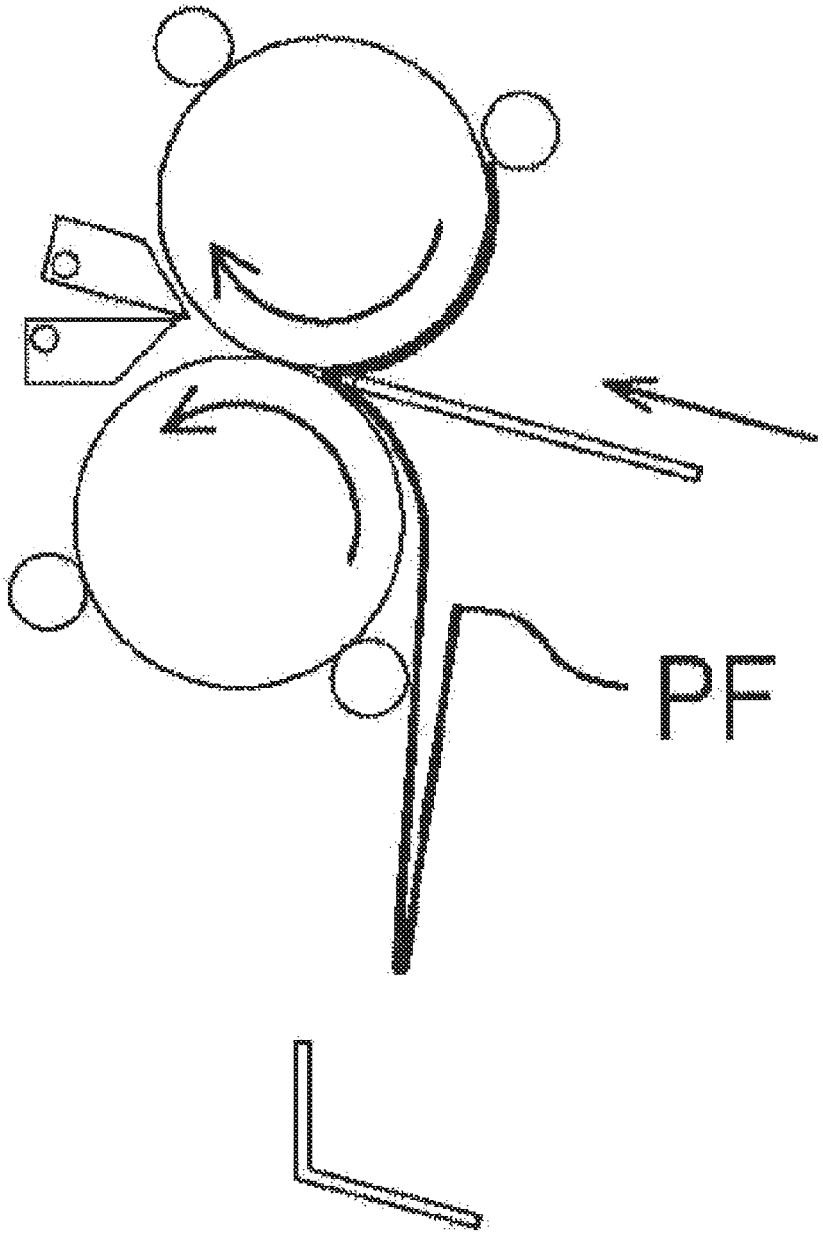

The paper P having passed through the folding nip N is fed around a roller on an opposite side of the first end PF of the paper P from among the first and second rollers 721 and 722, that is, the first roller 721, and is returned to the entrance of the folding nip N. To achieve this, the first shift member 731 is placed in a first shift location, and the paper P having passed through the folding nip N is returned to the entrance of the folding nip N along the first guide path 761 (FIG. 9C and FIG. 9D). When the paper P is fed along the folding path 710 in a forward direction, and a ¾L point of the paper P reaches the vicinity of the folding nip N (FIG. 9E), the ¾L point of the paper P is pushed into the folding nip N by moving the push member 750 to the insertion location (FIG. 9F). The push member 750 returns to the retreat location.

Figure 9G:
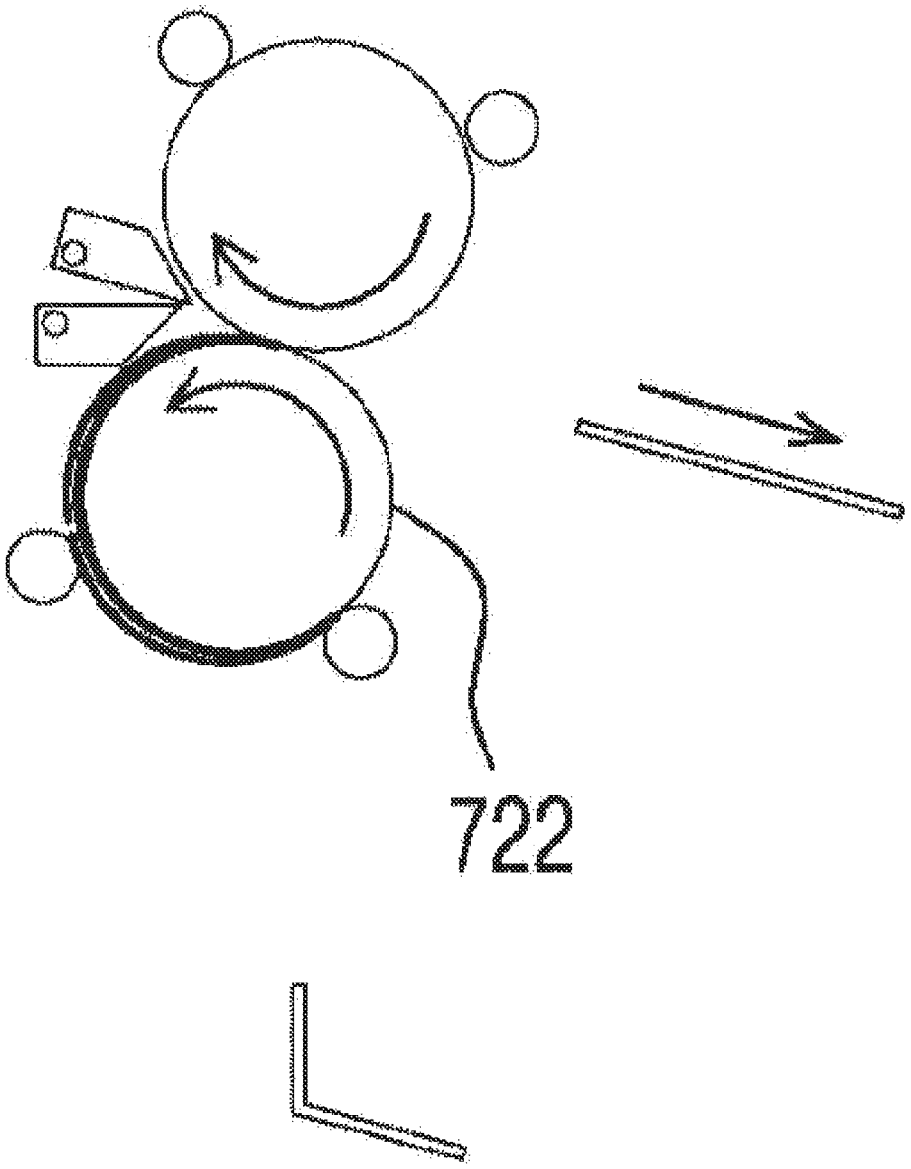
Figure 9H:
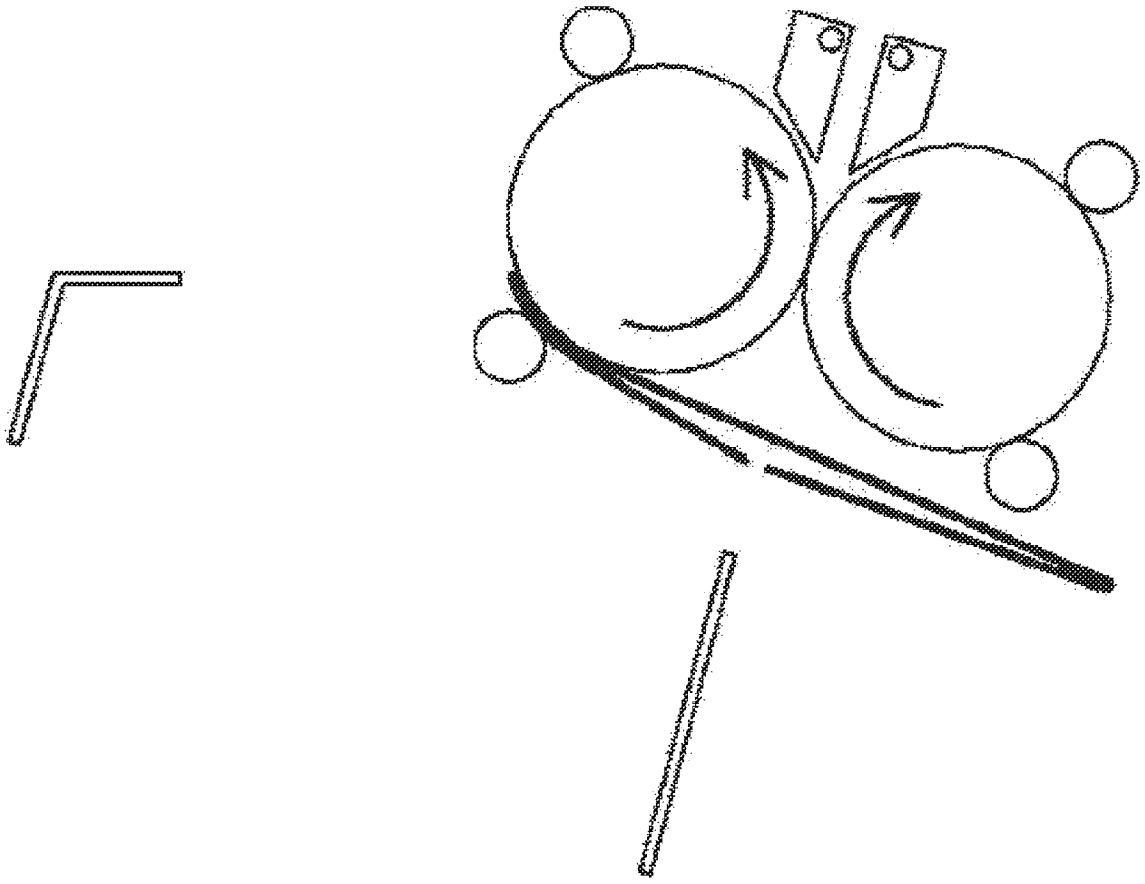
Figure 9I:
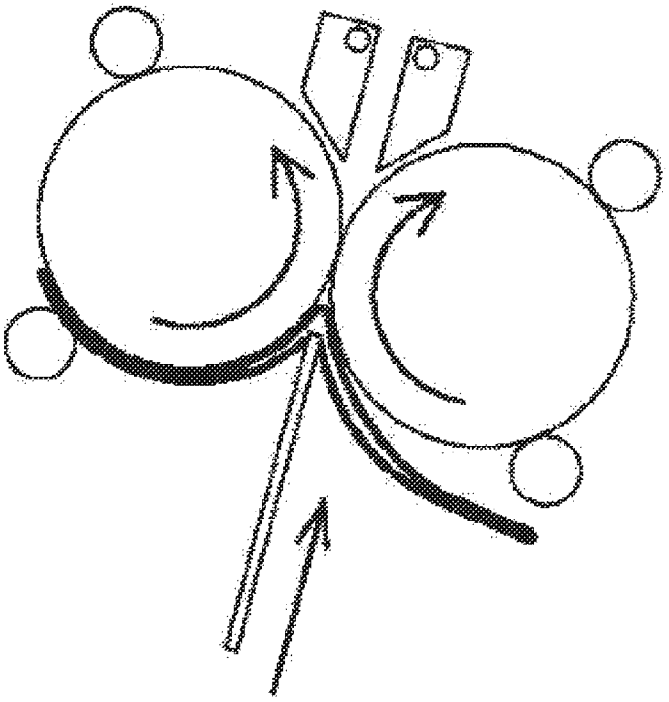
Figure 9I:
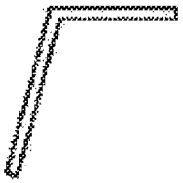
Figure 9J:
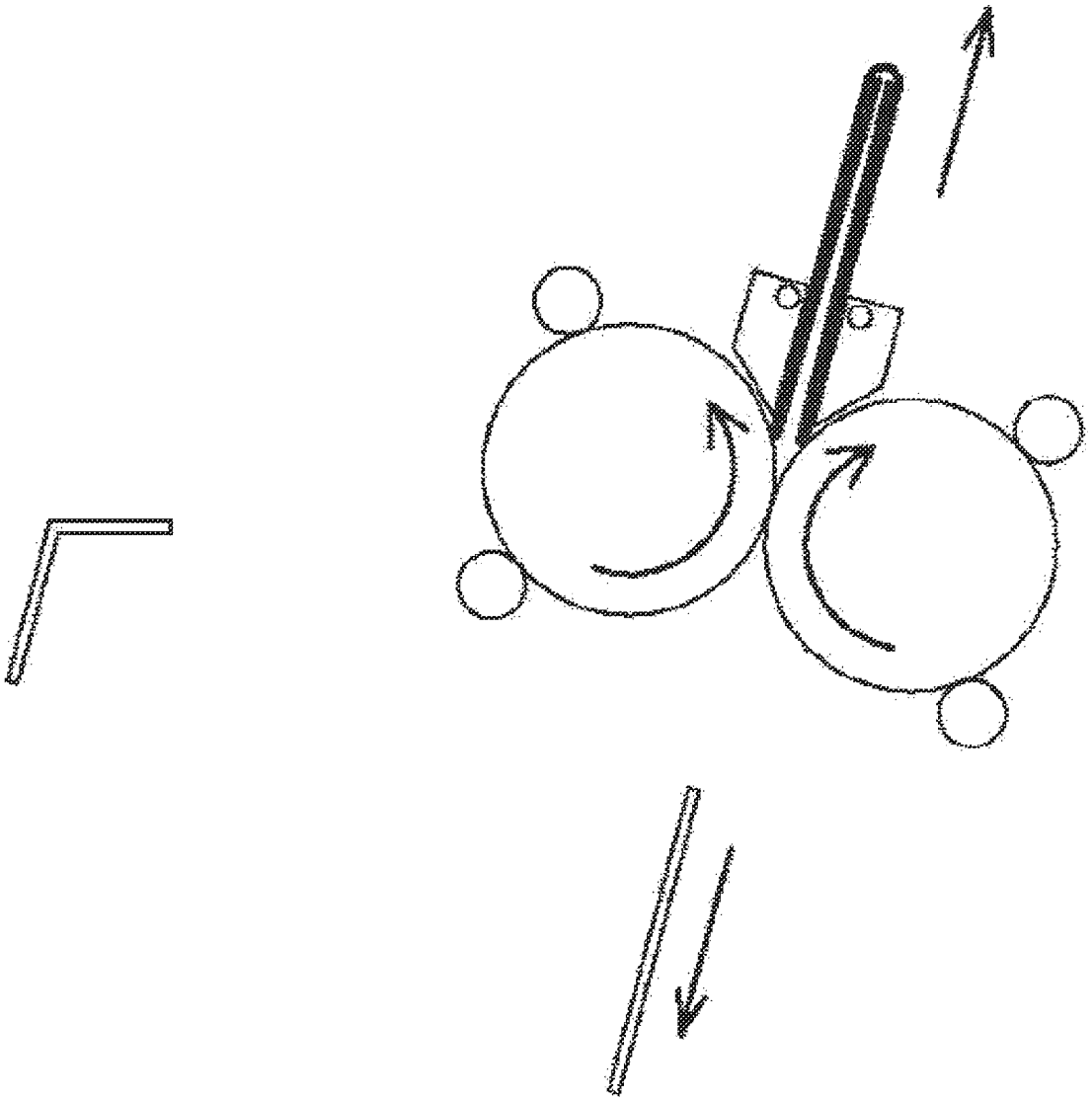

The paper P having passed through the folding nip N for the second time is fed around a roller on an opposite side of the first end PF of the paper P from among the first and second rollers 721 and 722, that is, the second roller 722, and is returned to the entrance of the folding nip N. To achieve this, the second shift member 732 is placed in a second shift location, and the paper P having passed through the folding nip N for the second time is returned to the entrance of the folding nip N along the second guide path 762 (FIG. 9G). When the paper P is fed along the folding path 710 in a reverse direction, and a ½L point of the paper P reaches the vicinity of the folding nip N (FIG. 9H), the ½L point of the paper P is pushed into the folding nip N by moving the push member 750 to the insertion location (FIG. 9I). The first and second shift members 731 and 732 are placed in discharge locations. Accordingly, the paper P folded in the form of a double gate is discharged by the discharge roller 760 (FIG. 9J). The push member 750 returns to the retreat location.

[Roll-Fold]

FIGS. 10A-10J show an example of a roll-fold process. In FIGS. 10A-10J, the first and second rollers 721 and 722, the positioning member 740, the push member 750, and the first and second shift members 731 and 732 are illustrated.

Figure 10A:
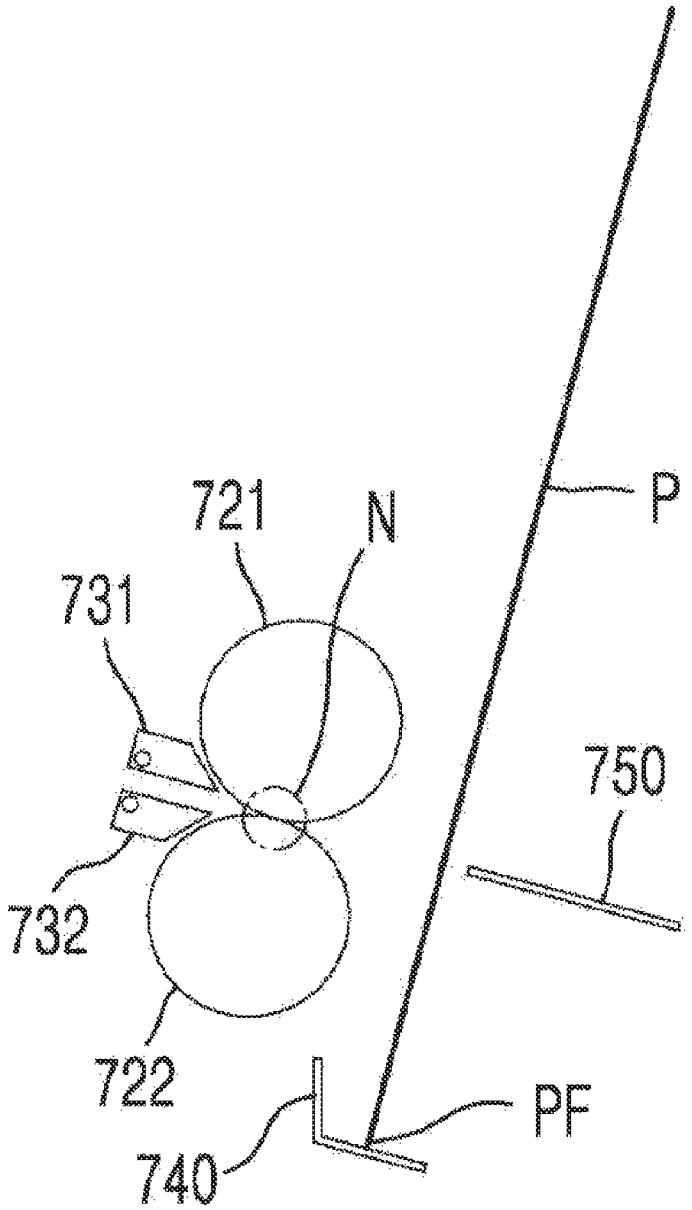
FIGS. 10A-10J show an example of a roll-fold process.
Figure 10B:
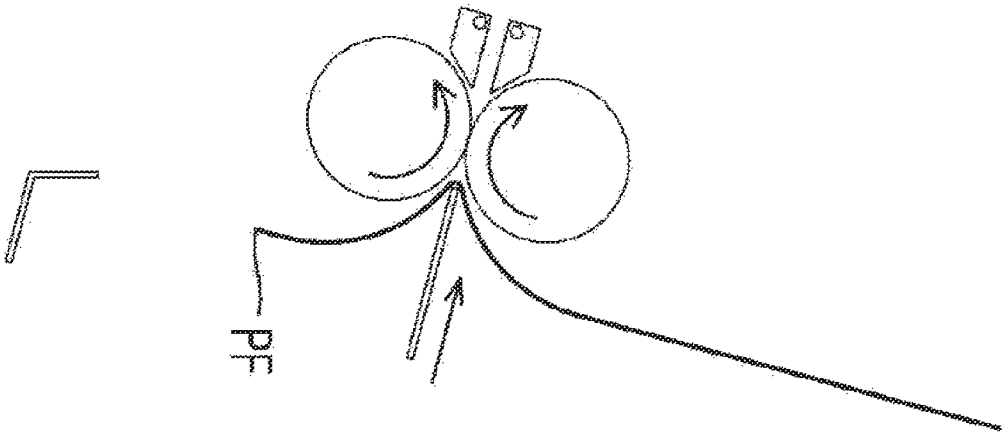
Figure 10C:
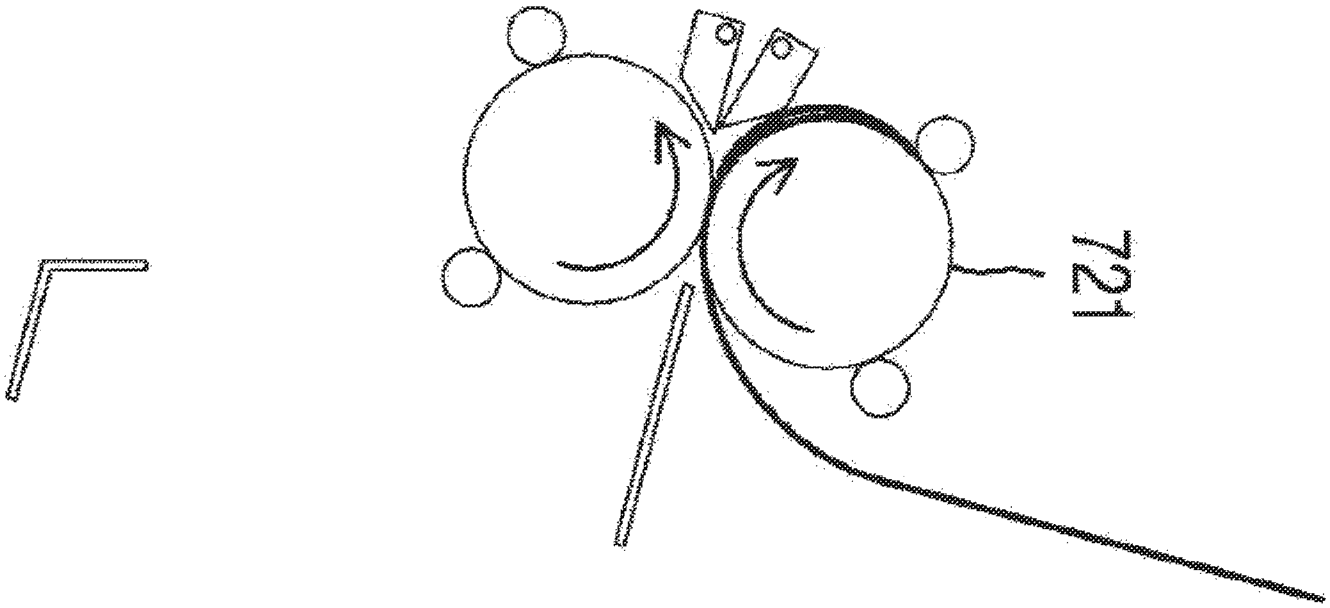

As illustrated in FIG. 10A, the positioning member 740 is located such that a ¼L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ¼L point of the paper P is pushed into the folding nip N by moving the push member 750 to an insertion location (FIG. 10B). As the paper P passes through the folding nip N, the ¼L point is folded. The push member 750 returns to a retreat location.

Figure 10D:
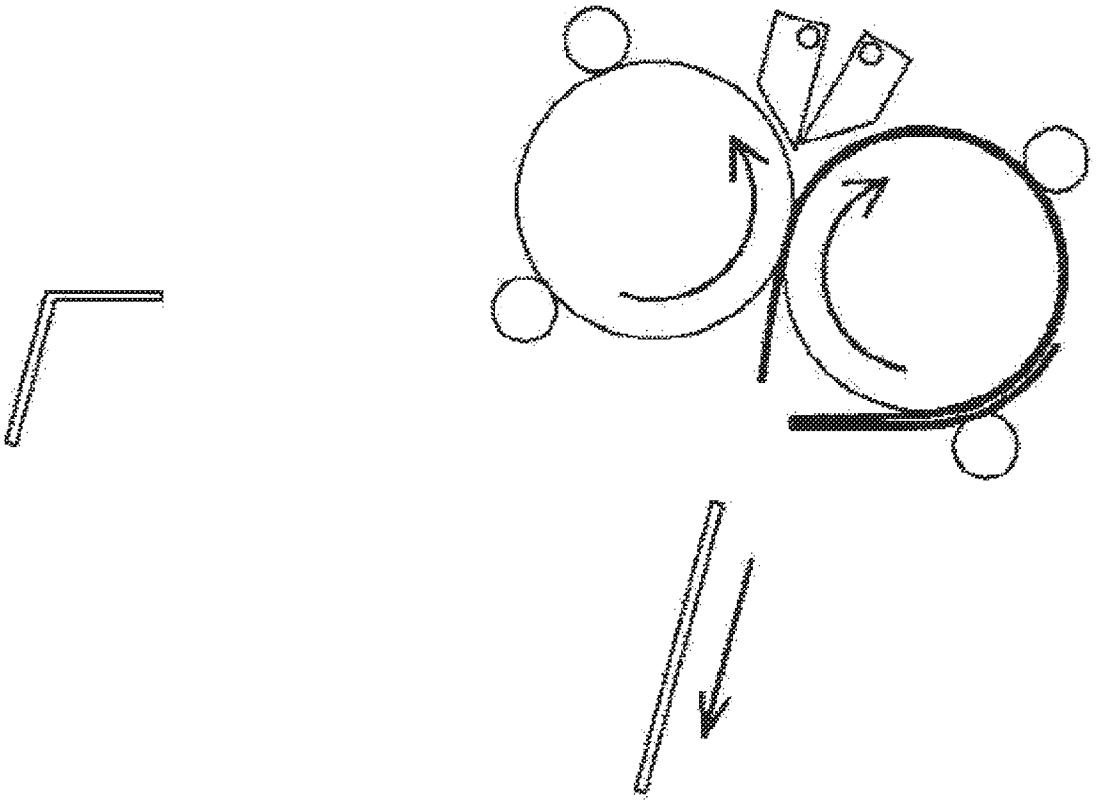
Figure 10E:
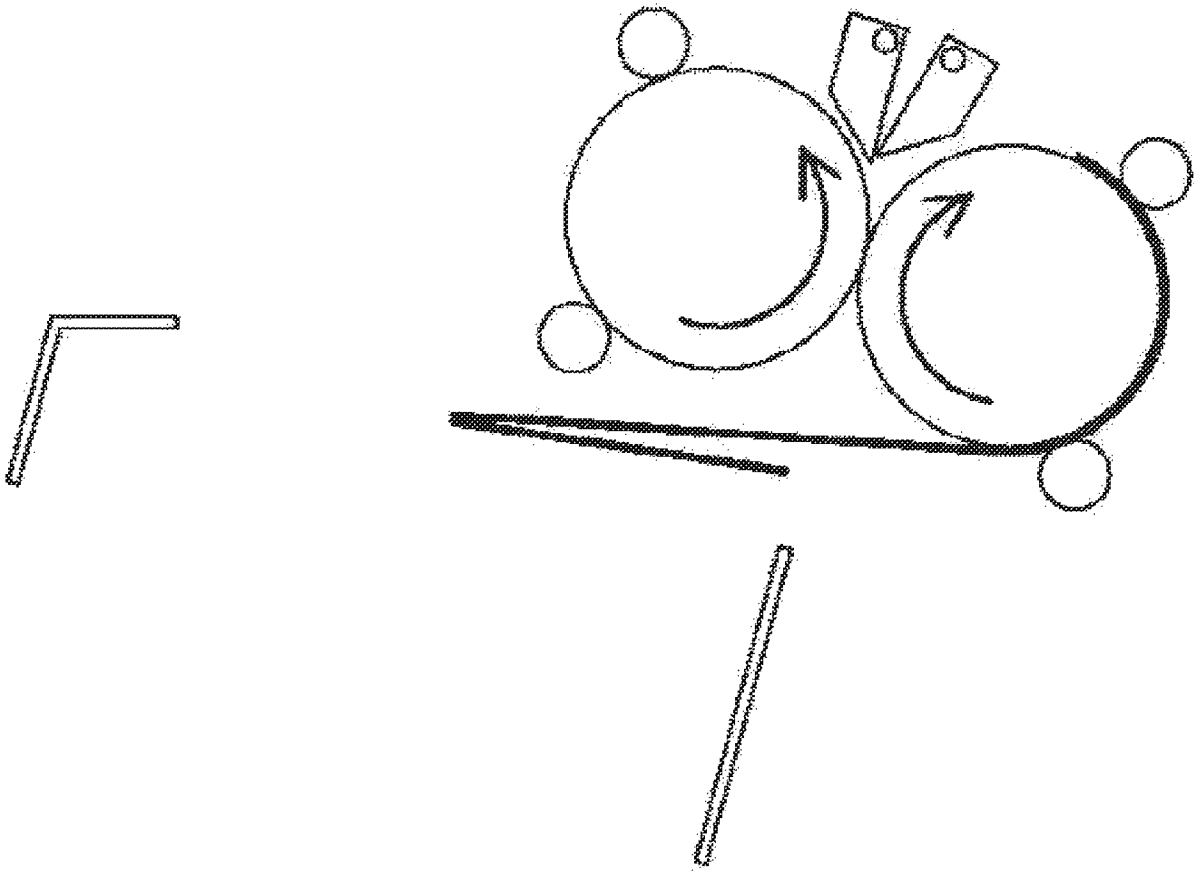
Figure 10F:
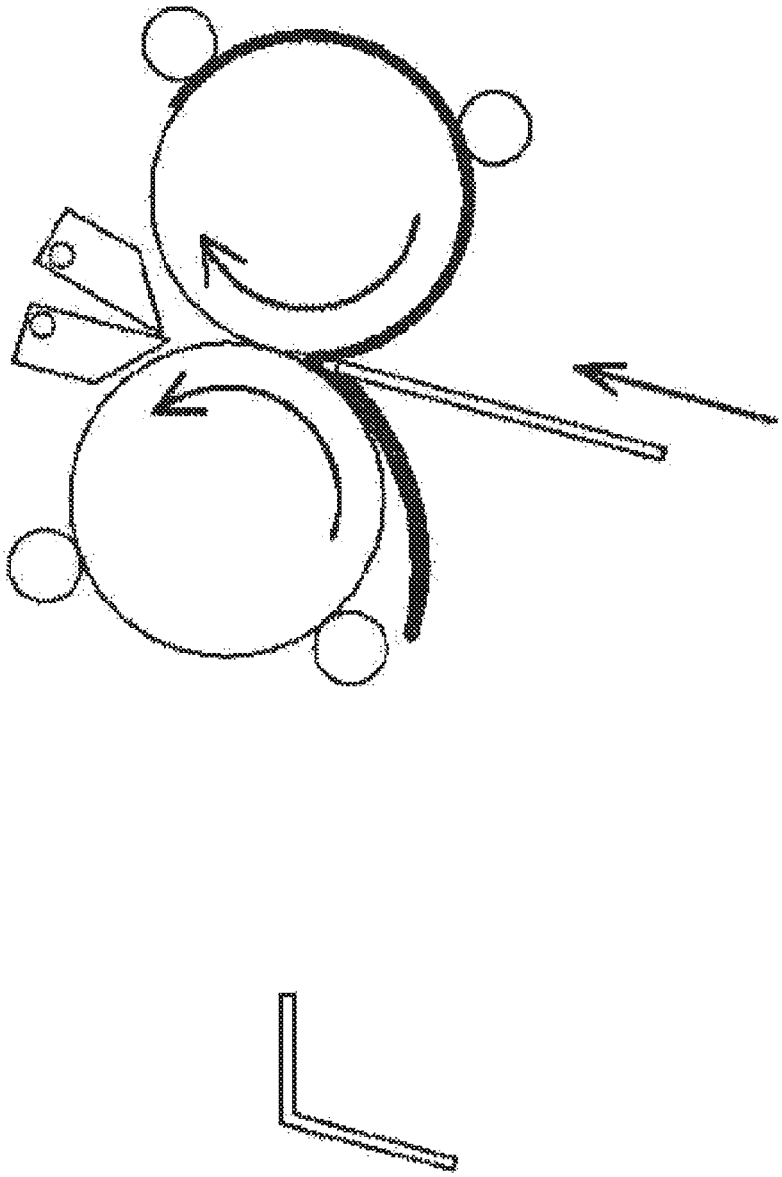

The paper P having passed through the folding nip N is fed around a roller on an opposite side of the first end PF of the paper P from among the first and second rollers 721 and 722, that is, the first roller 721, and is returned to the entrance of the folding nip N. To achieve this, the first shift member 731 is placed in a first shift location, and the paper P having passed through the folding nip N is returned to the entrance of the folding nip N along the first guide path 761 (FIG. 100 and FIG. 10D). When the paper P is fed along the folding path 710 in a forward direction, and a ½L point of the paper P reaches the vicinity of the folding nip N (FIG. 10E), the ½L point of the paper P is pushed into the folding nip N by moving the push member 750 to the insertion location (FIG. 10F). The push member 750 returns to the retreat location.

Figure 10G:
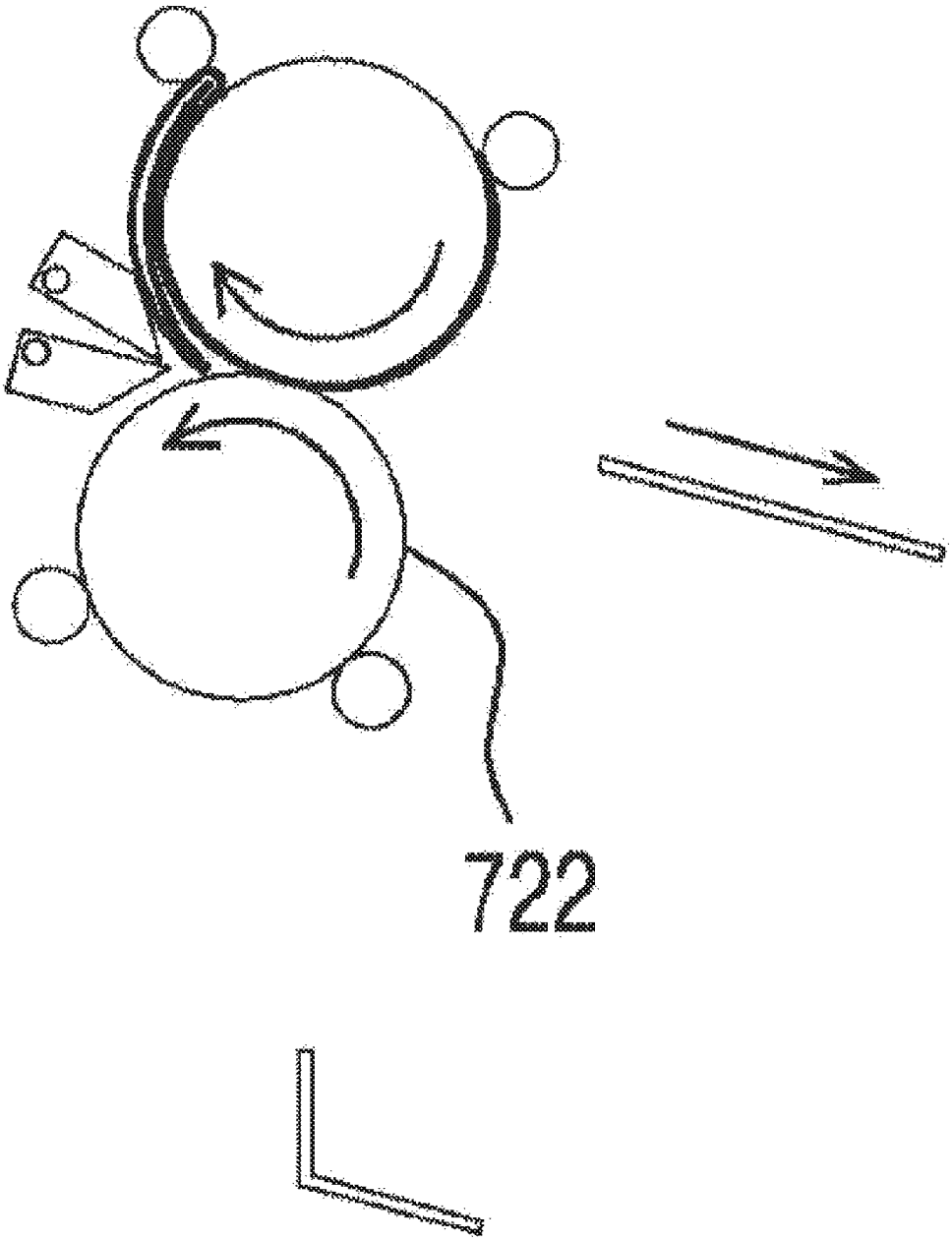
Figure 10H:
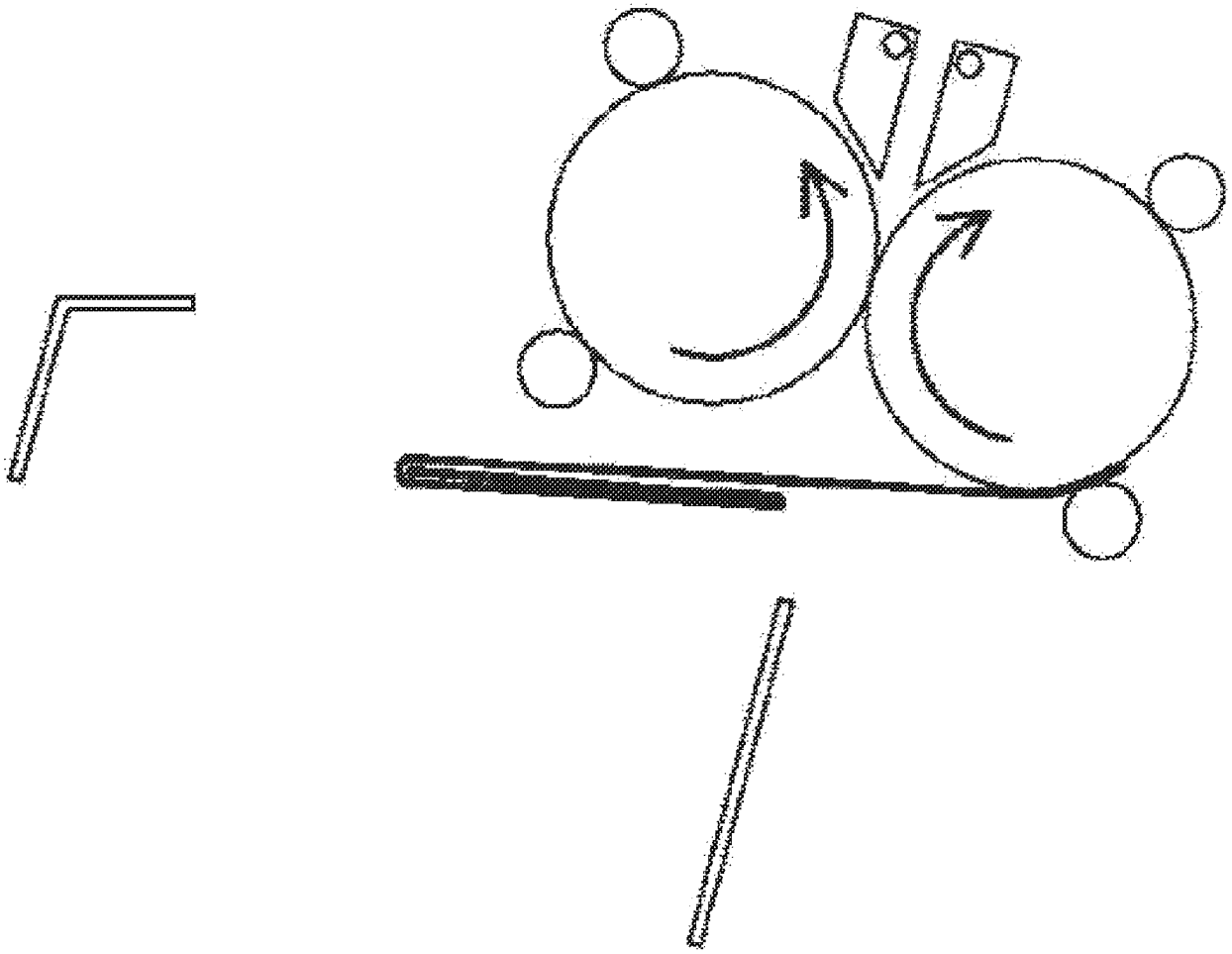
Figure 10I:
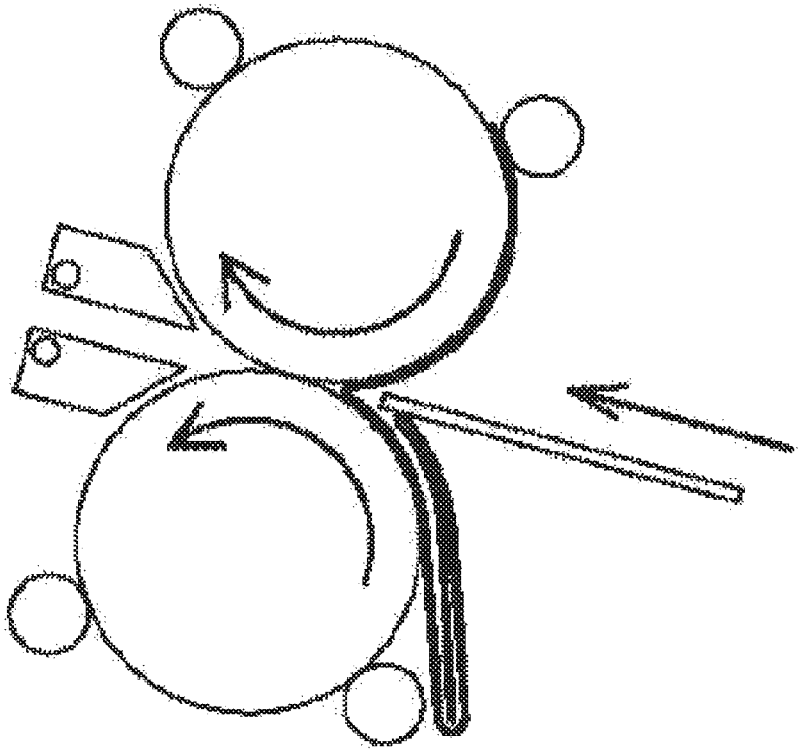
Figure 10I:
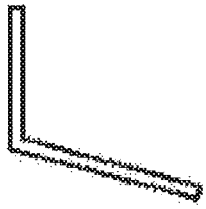
Figure 10J:
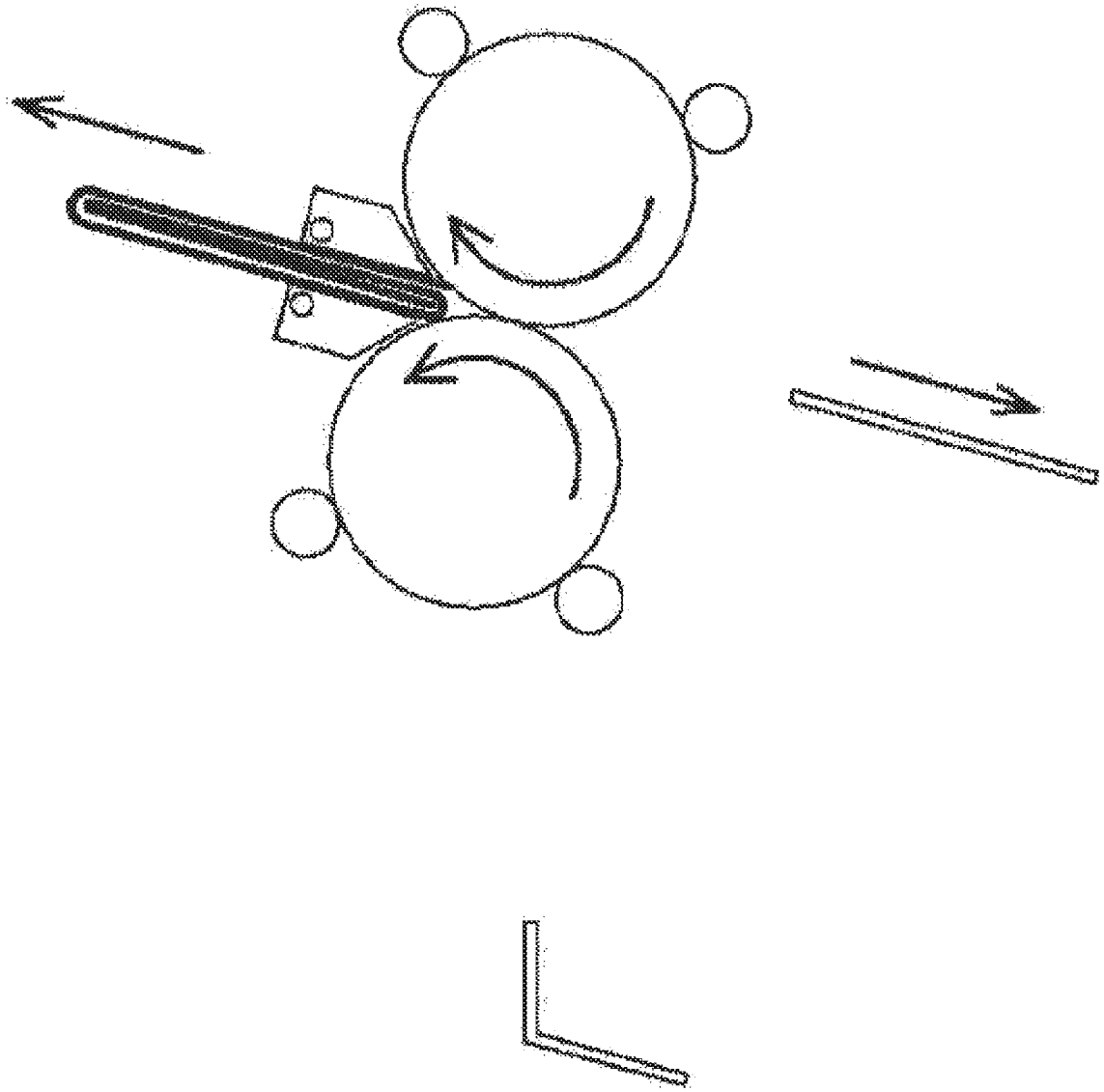

The paper P having passed through the folding nip N for the second time is fed around the first roller 721 again, and is returned to the entrance of the folding nip N. To achieve this, the first shift member 731 is maintained at the first shift location. The paper P having passed through the folding nip N for the second time is returned to the entrance of the folding nip N along the first guide path 761 (FIG. 10G). When the paper P is fed along the folding path 710 in the forward direction, and a ¾L point of the paper P reaches the vicinity of the folding nip N (FIG. 10H), the ¾L point of the paper P is pushed into the folding nip N by moving the push member 750 to the insertion location (FIG. 10I). The first and second shift members 731 and 732 are placed in discharge locations. Accordingly, the paper P folded in the form of a roll is discharged by the discharge roller 760 (FIG. 10J). The push member 750 returns to the retreat location.

[W-Fold]

FIGS. 11A-11J shows an example of a W-fold process. In FIGS. 11A-11J, the first and second rollers 721 and 722, the positioning member 740, the push member 750, and the first and second shift members 731 and 732 are illustrated.

Figure 11A:
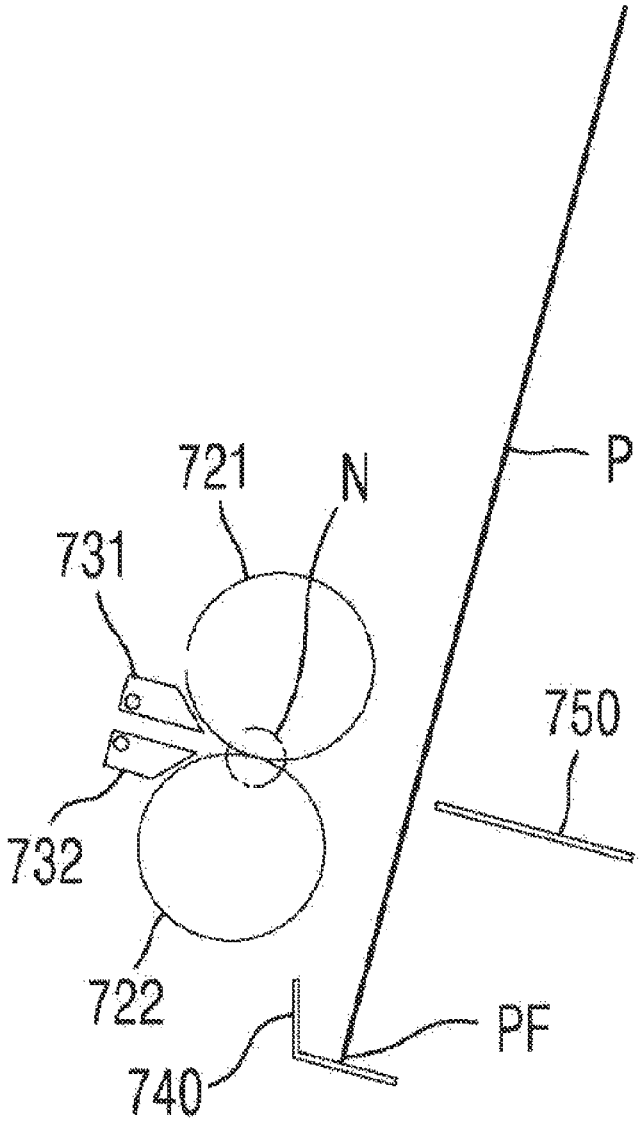
FIGS. 11A-11J show an example of a W-fold process.
Figure 11B:
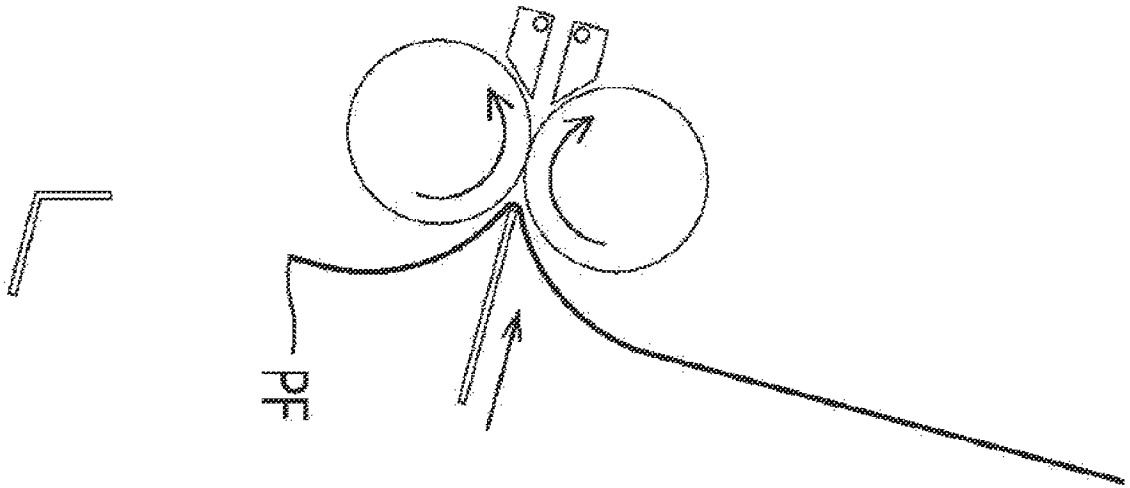

As illustrated in FIG. 11A, the positioning member 740 is located such that a ¼L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ¼L point of the paper P is pushed into the folding nip N by moving the push member 750 to an insertion location (FIG. 11B). As the paper P passes through the folding nip N, the ¼L point is folded. The push member 750 returns to a retreat location.

Figure 11C:
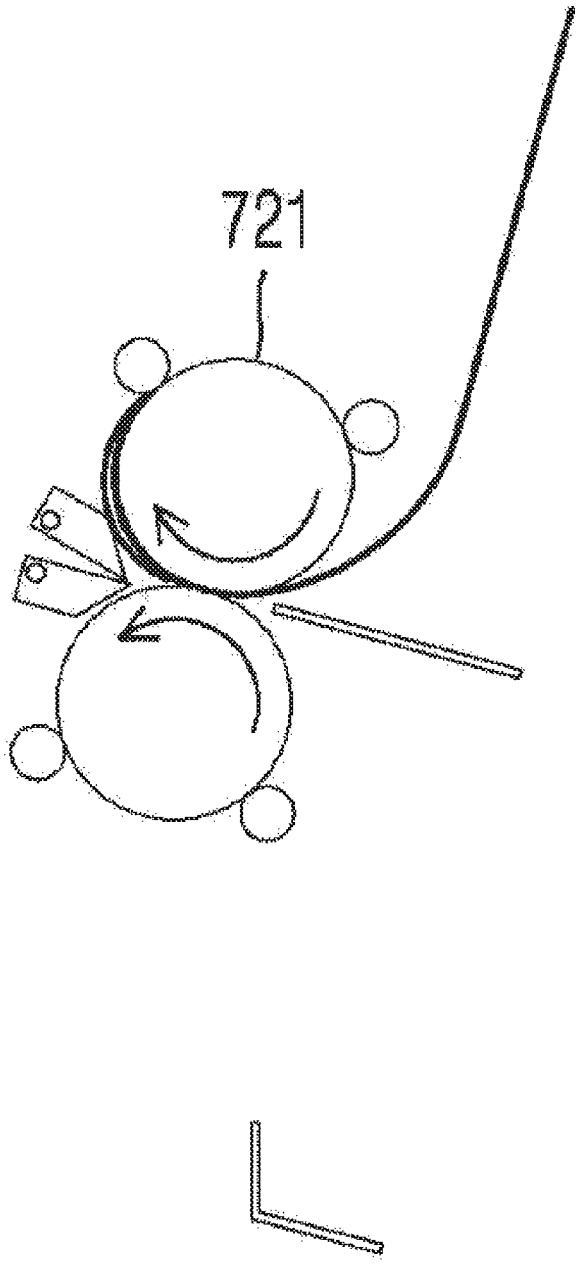
Figure 11D:
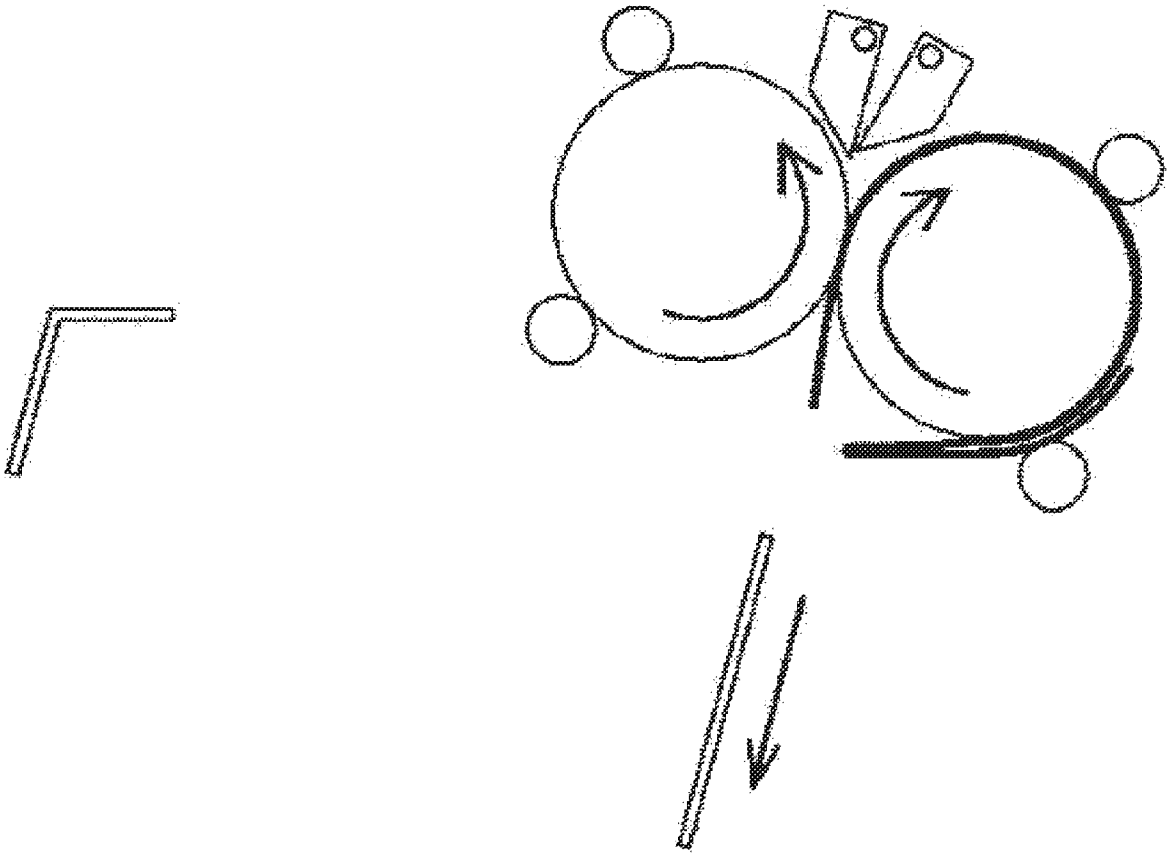
Figure 11E:
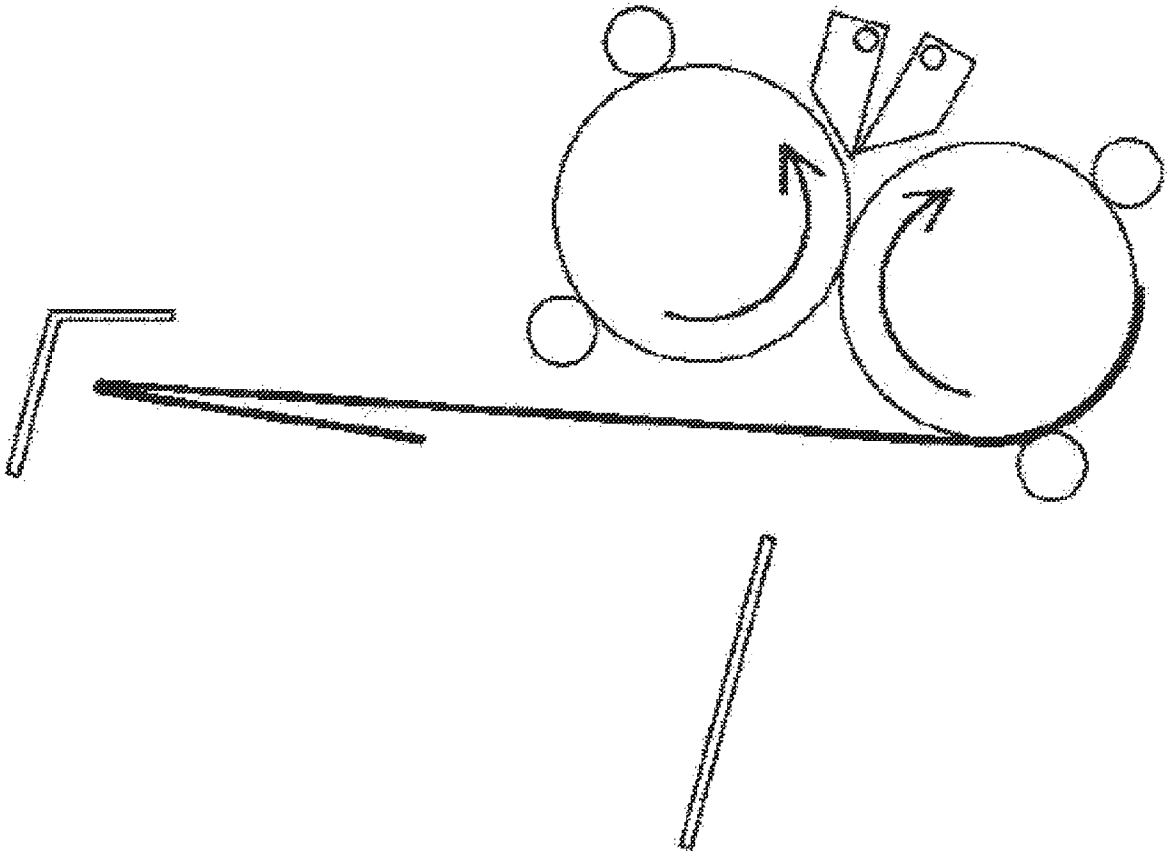
Figure 11F:
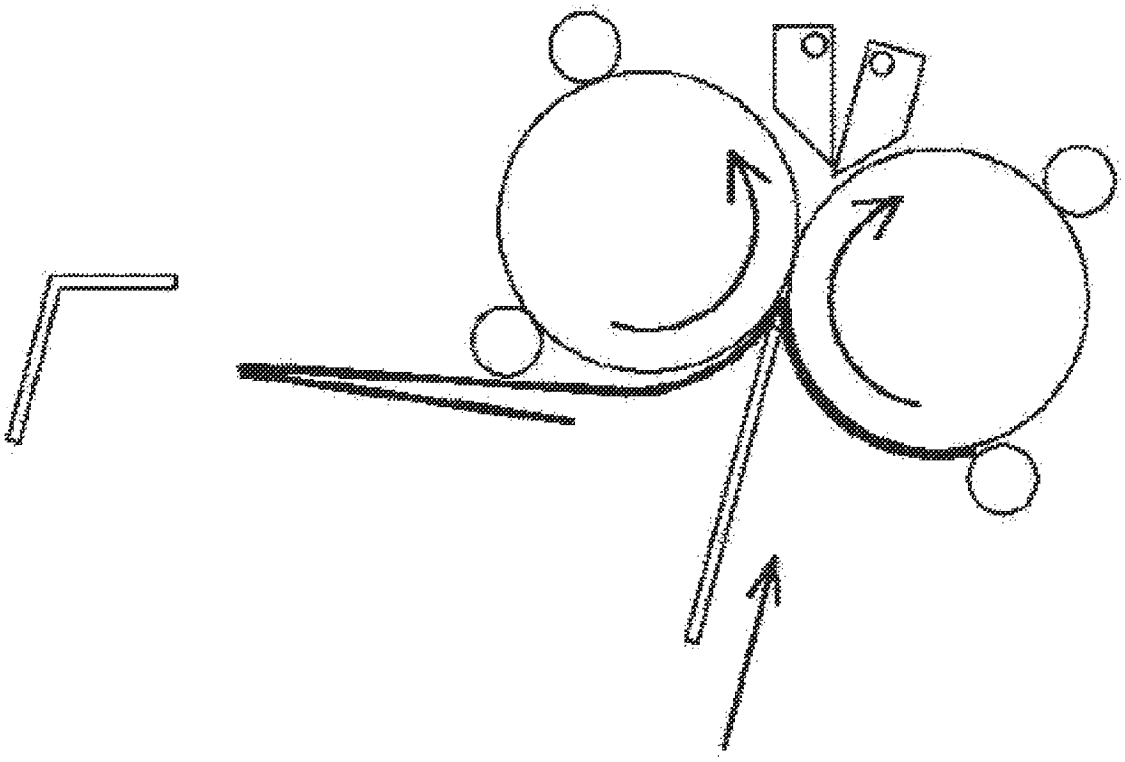

The paper P having passed through the folding nip N is fed around a roller on an opposite side of the first end PF of the paper P from among the first and second rollers 721 and 722, that is, the first roller 721, and is returned to the entrance of the folding nip N. To achieve this, the first shift member 731 is placed in a first shift location, and the paper P having passed through the folding nip N is returned to the entrance of the folding nip N along the first guide path 761 (FIG. 11C and FIG. 11D). When the paper P is fed along the folding path 710 in a forward direction, and a ¾L point of the paper P reaches the vicinity of the folding nip N (FIG. 11E), the ¾L point of the paper P is pushed into the folding nip N by moving the push member 750 to the insertion location (FIG. 11F). The push member 750 returns to the retreat location.

Figure 11G:
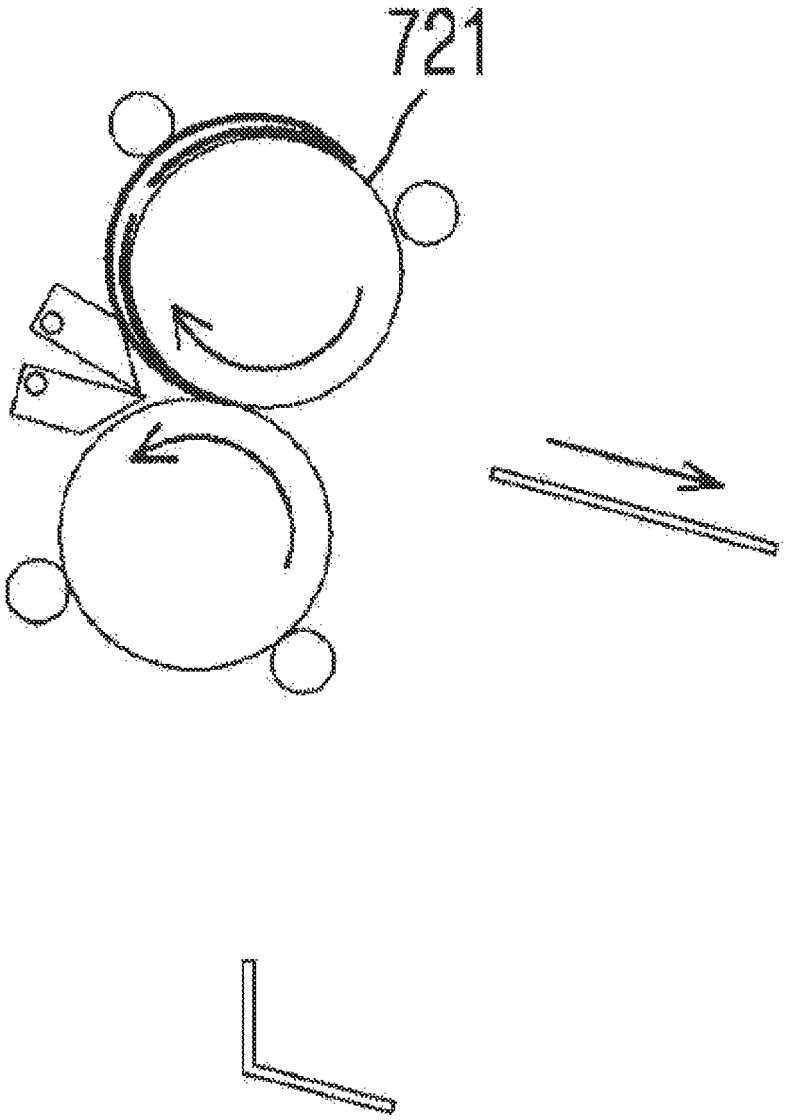
Figure 11H:
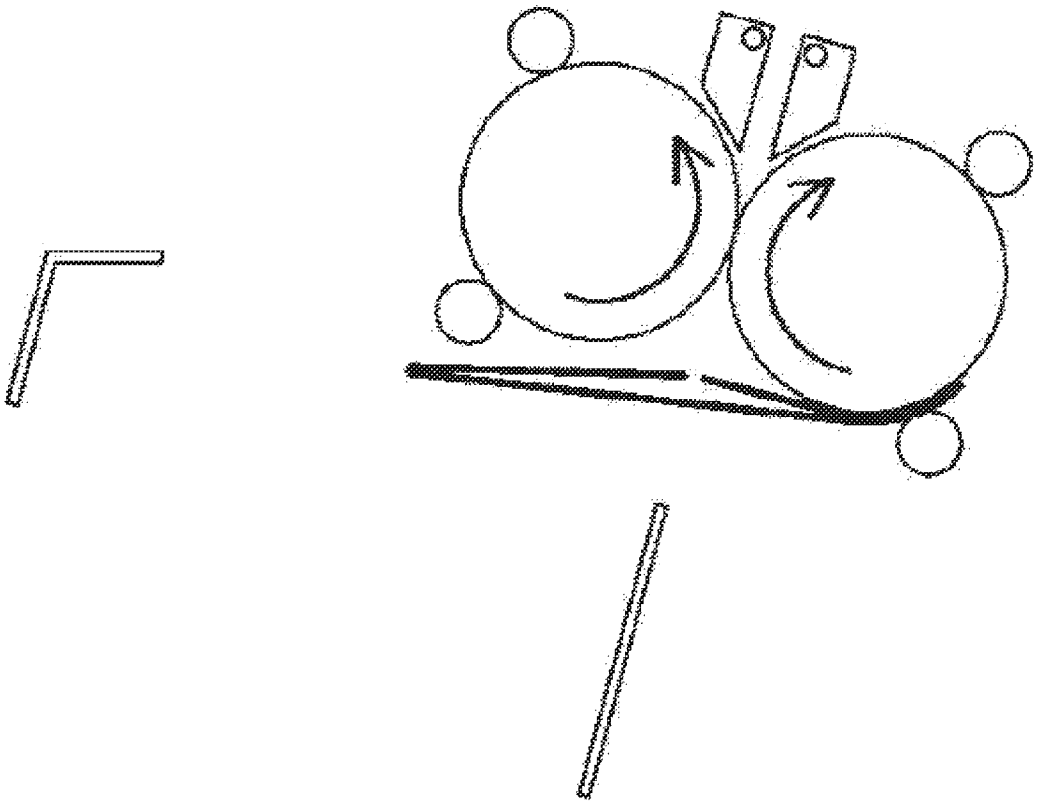
Figure 11I:
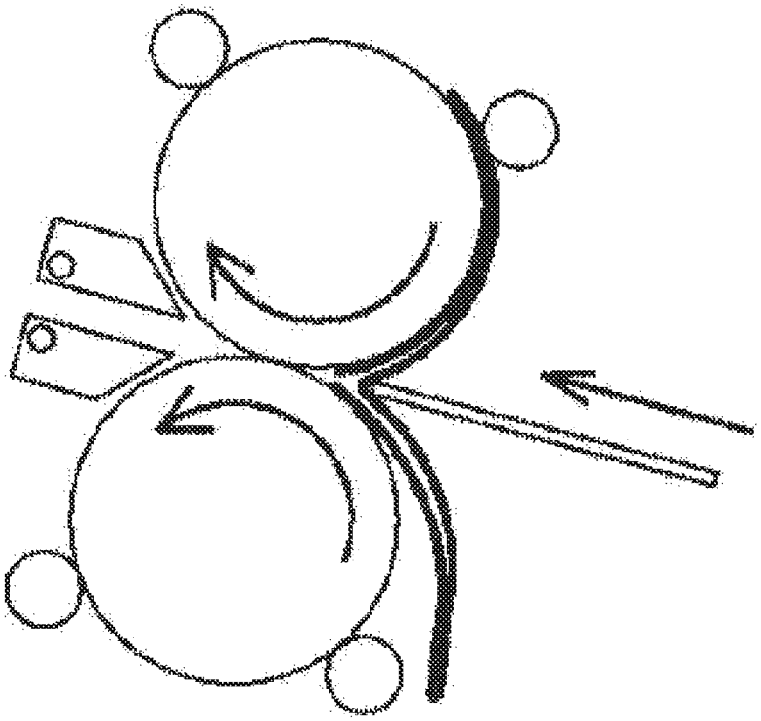
Figure 11I:
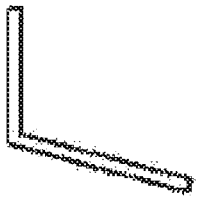
Figure 11J:
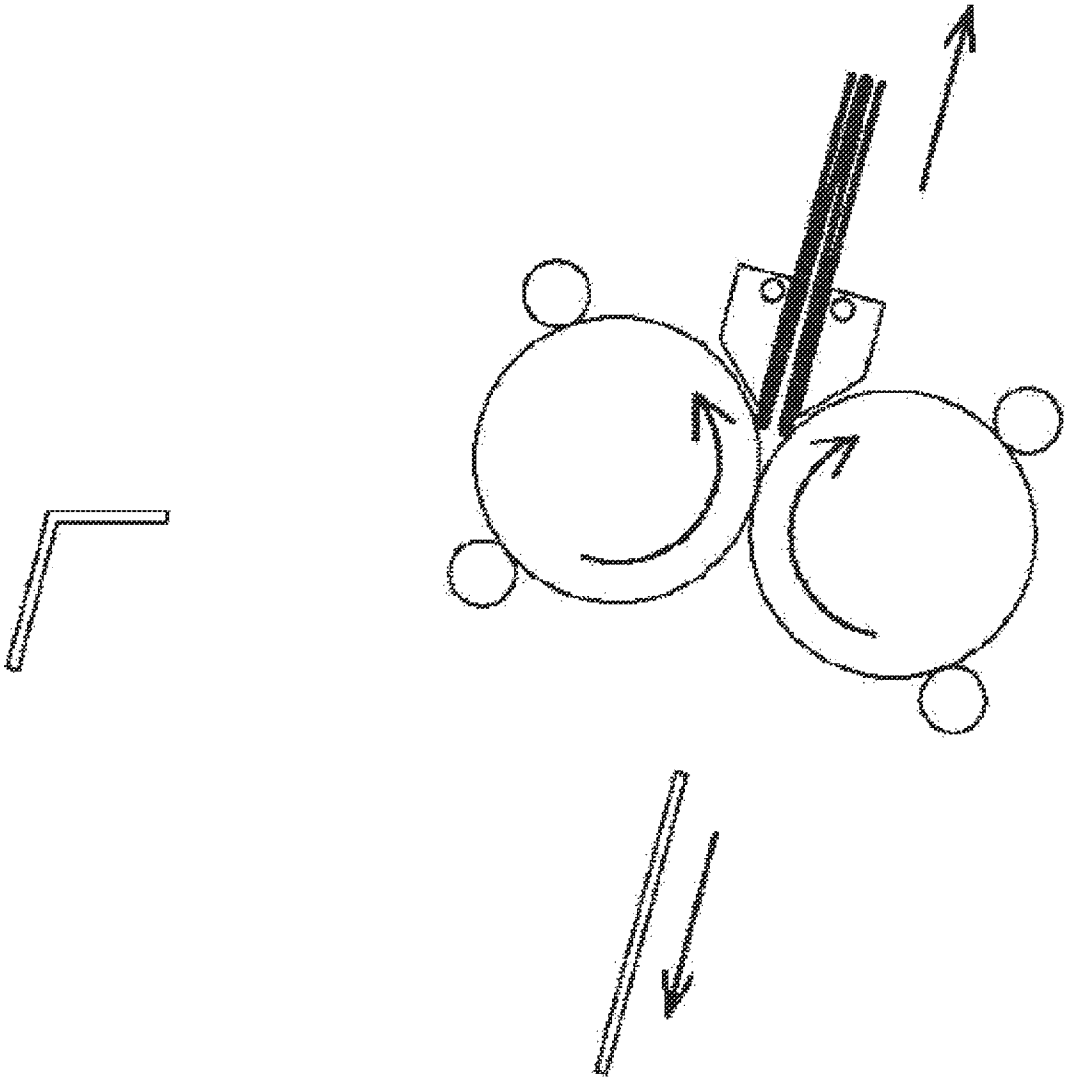

The paper P having passed through the folding nip N for the second time is fed around the first roller 721 again, and is returned to the entrance of the folding nip N. To achieve this, the first shift member 731 is maintained at the first shift location. The paper P having passed through the folding nip N for the second time is returned to the entrance of the folding nip N along the first guide path 761 (FIG. 11G). When the paper P is fed along the folding path 710 in the forward direction, and a ½L point of the paper P reaches the vicinity of the folding nip N (FIG. 11H), the ½L point of the paper P is pushed into the folding nip N by moving the push member 750 to the insertion location (FIG. 11I). The first and second shift members 731 and 732 are placed in discharge locations. Accordingly, the paper P folded in the form of a W is discharged by the discharge roller 760 (FIG. 11J). The push member 750 returns to the retreat location.

[Another W-Fold Method]

FIGS. 12A-12J show another example of a W-fold process. In FIGS. 12A-12J, the first and second rollers 721 and 722, the positioning member 740, the push member 750, and the first and second shift members 731 and 732 are briefly illustrated.

Figure 12A:
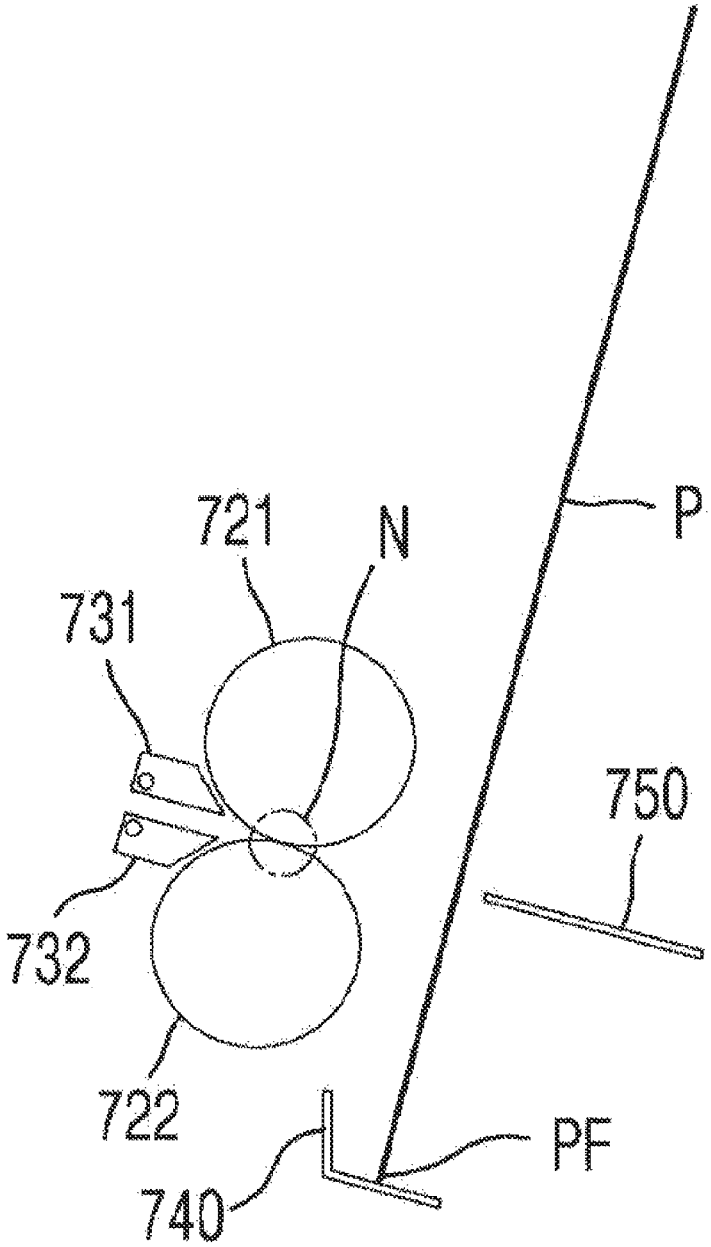
FIGS. 12A-12J show another example of a W-fold process.
Figure 12B:
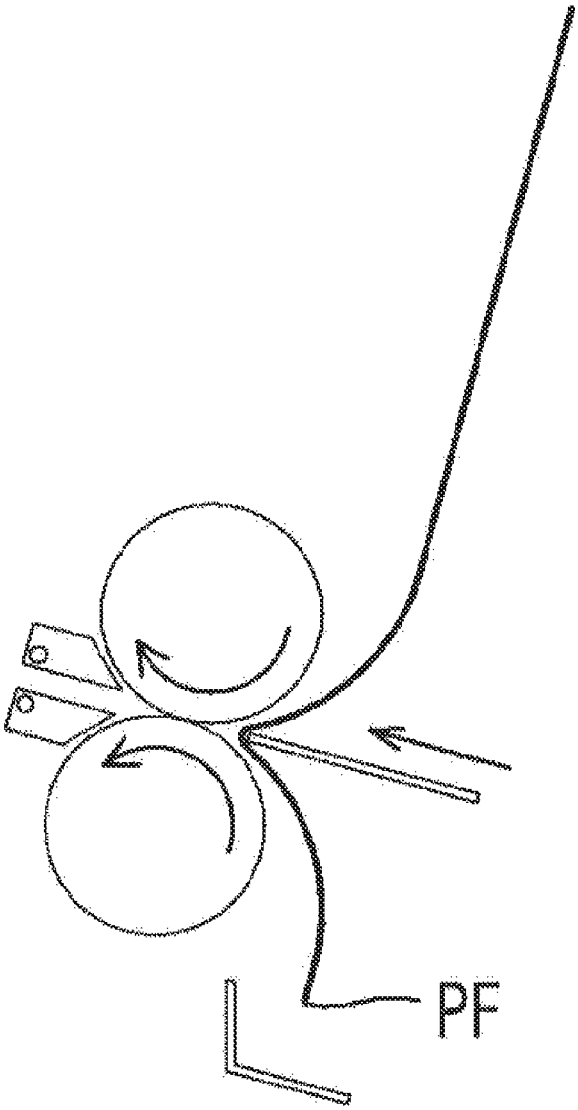

As illustrated in FIG. 12A, the positioning member 740 is located such that a ¼L point of the paper P is located at an entrance of the folding nip N. The paper P is fed along the folding path 710. In an example, the paper P may be discharged from a printer, such as printer 100, and fed along the folding path 710. The first end PF of one piece or a plurality of pieces of paper P is supported by the positioning member 740. The ¼L point of the paper P is pushed into the folding nip N by moving the push member 750 to an insertion location (FIG. 12B). As the paper P passes through the folding nip N, the ¼L point is folded. The push member 750 returns to a retreat location.

Figure 12C:
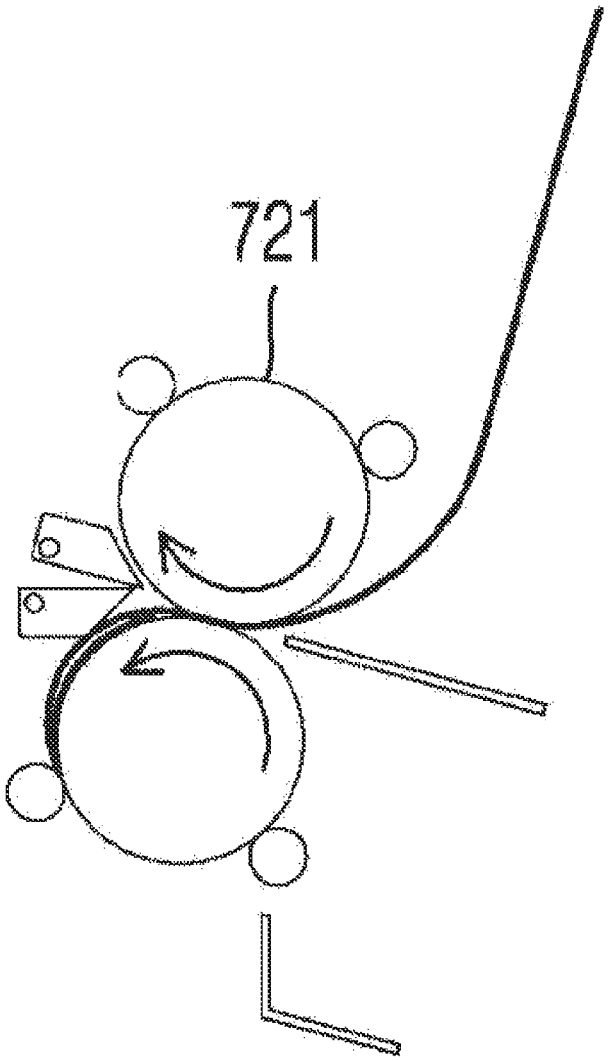
Figure 12D:
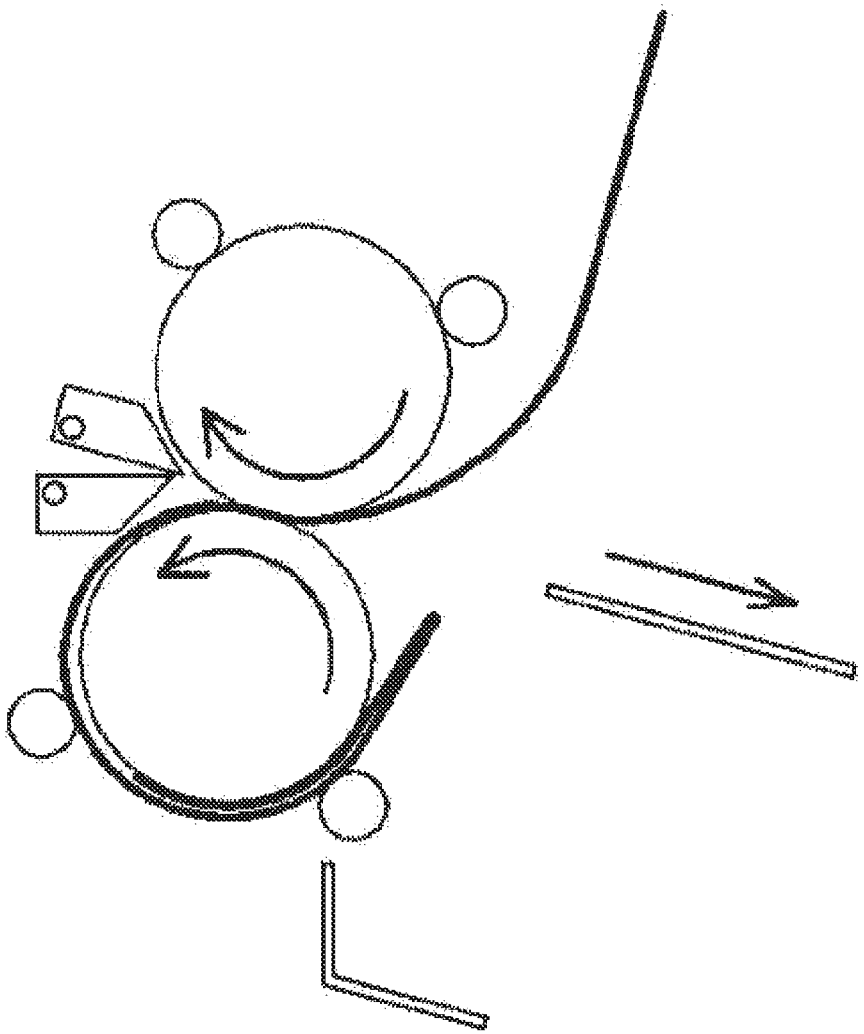
Figure 12E:
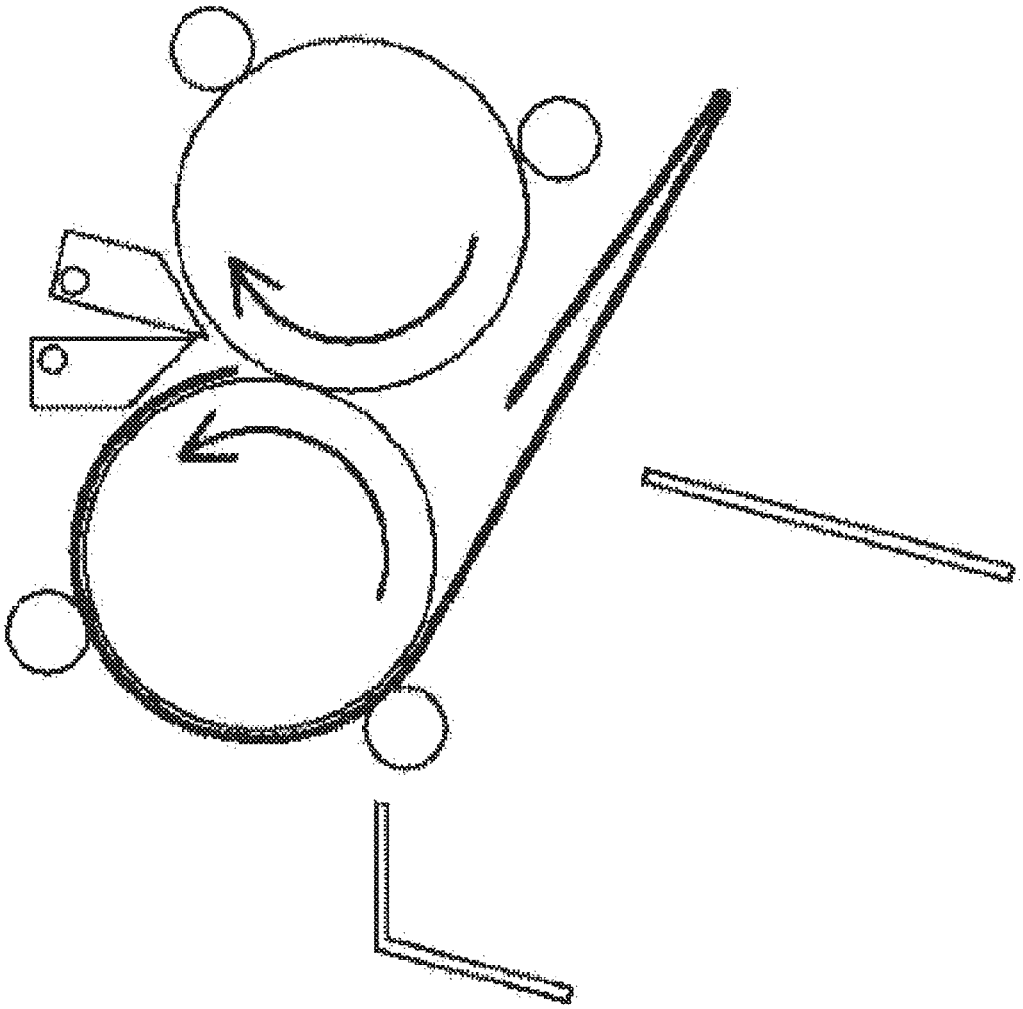
Figure 12F:
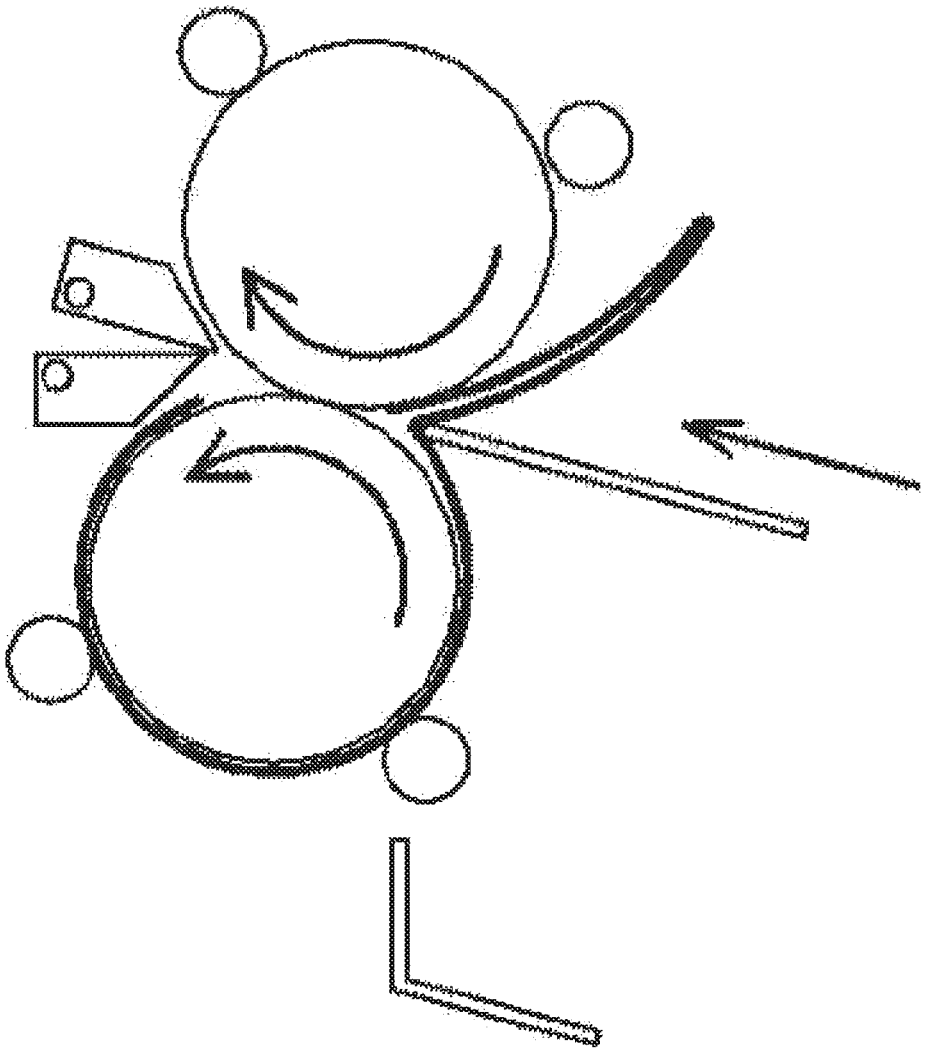

The paper P having passed through the folding nip N is fed around a roller on a side of the first end PF of the paper P from among the first and second rollers 721 and 722, that is, the second roller 722, and is returned to the entrance of the folding nip N. To achieve this, the second shift member 732 is placed in a second shift location, and the paper P having passed through the folding nip N is returned to the entrance of the folding nip N along the second guide path 762 (FIG. 12C and FIG. 12D). When the paper P is fed along the folding path 710 in a reverse direction, and a ½L point of the paper P reaches the vicinity of the folding nip N (FIG. 12E), the ½L point of the paper P is pushed into the folding nip N by moving the push member 750 to the insertion location (FIG. 12F). The push member 750 returns to the retreat location.

Figure 12G:
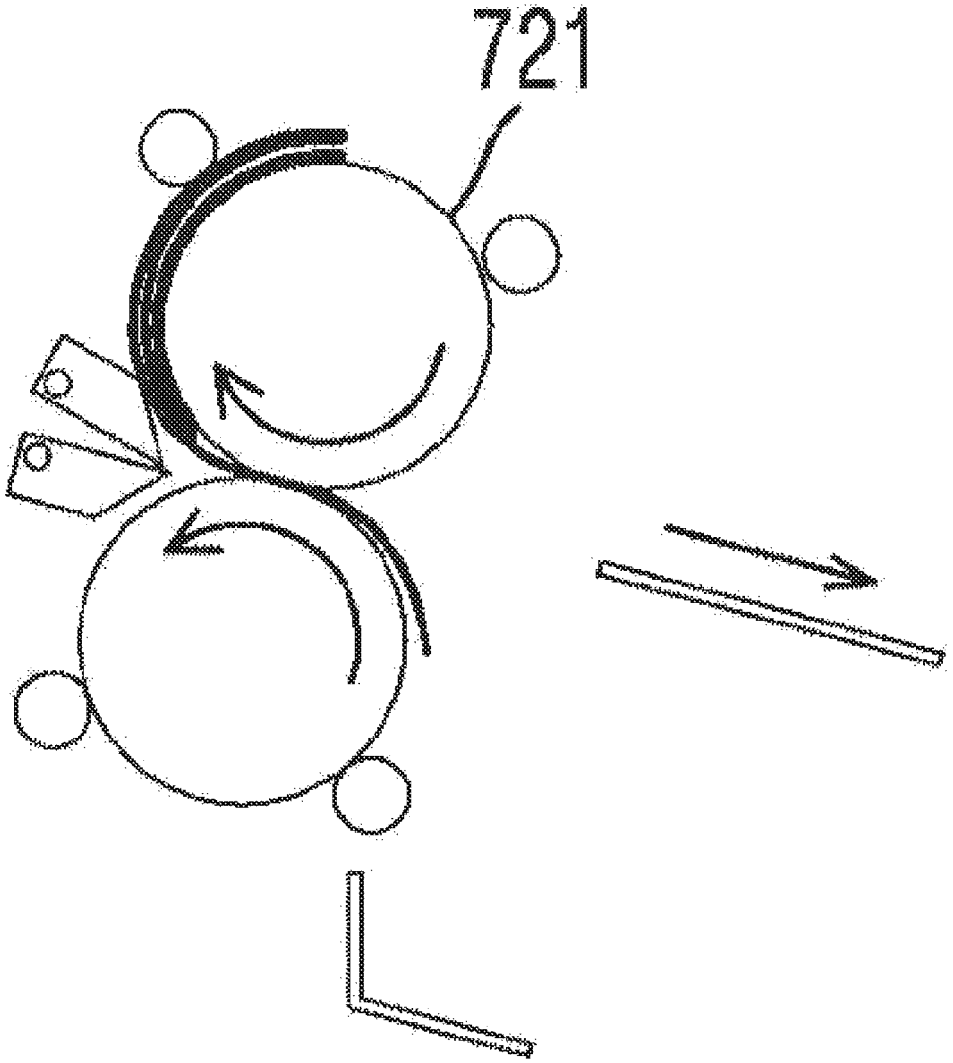
Figure 12H:
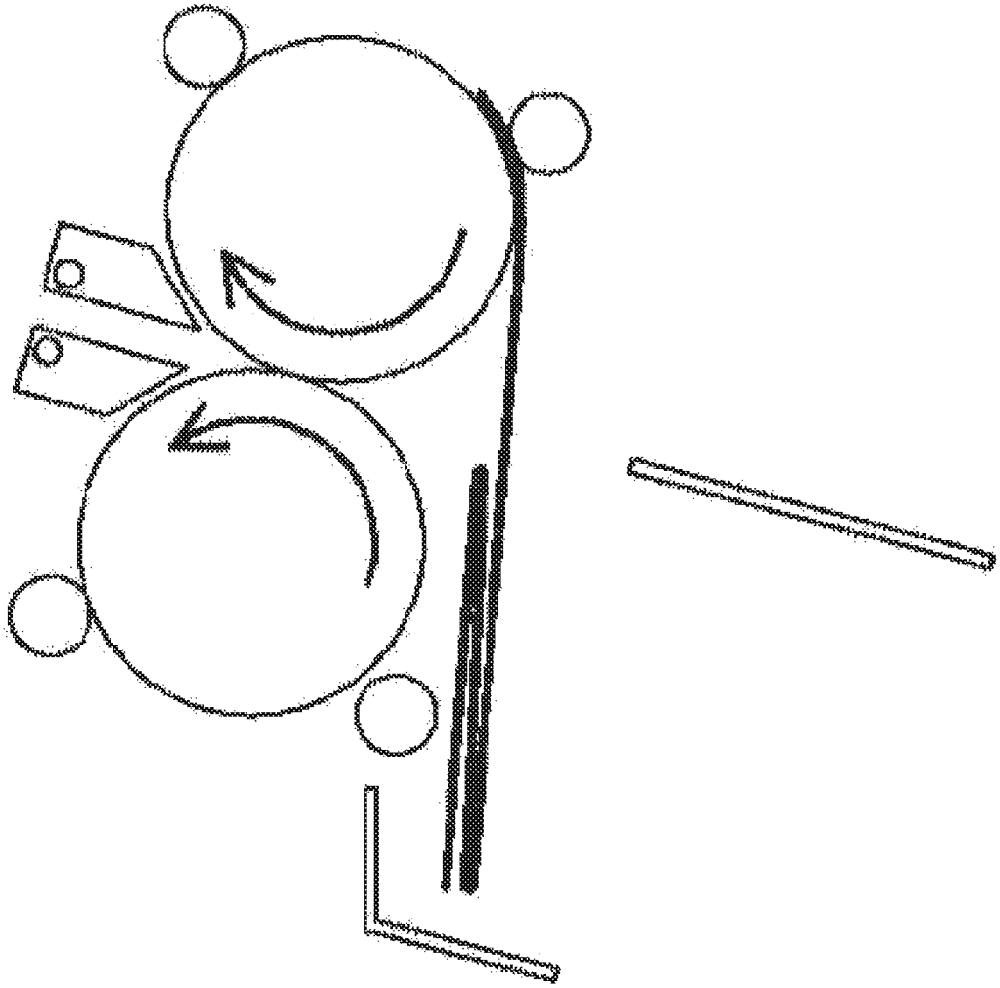
Figure 12I:
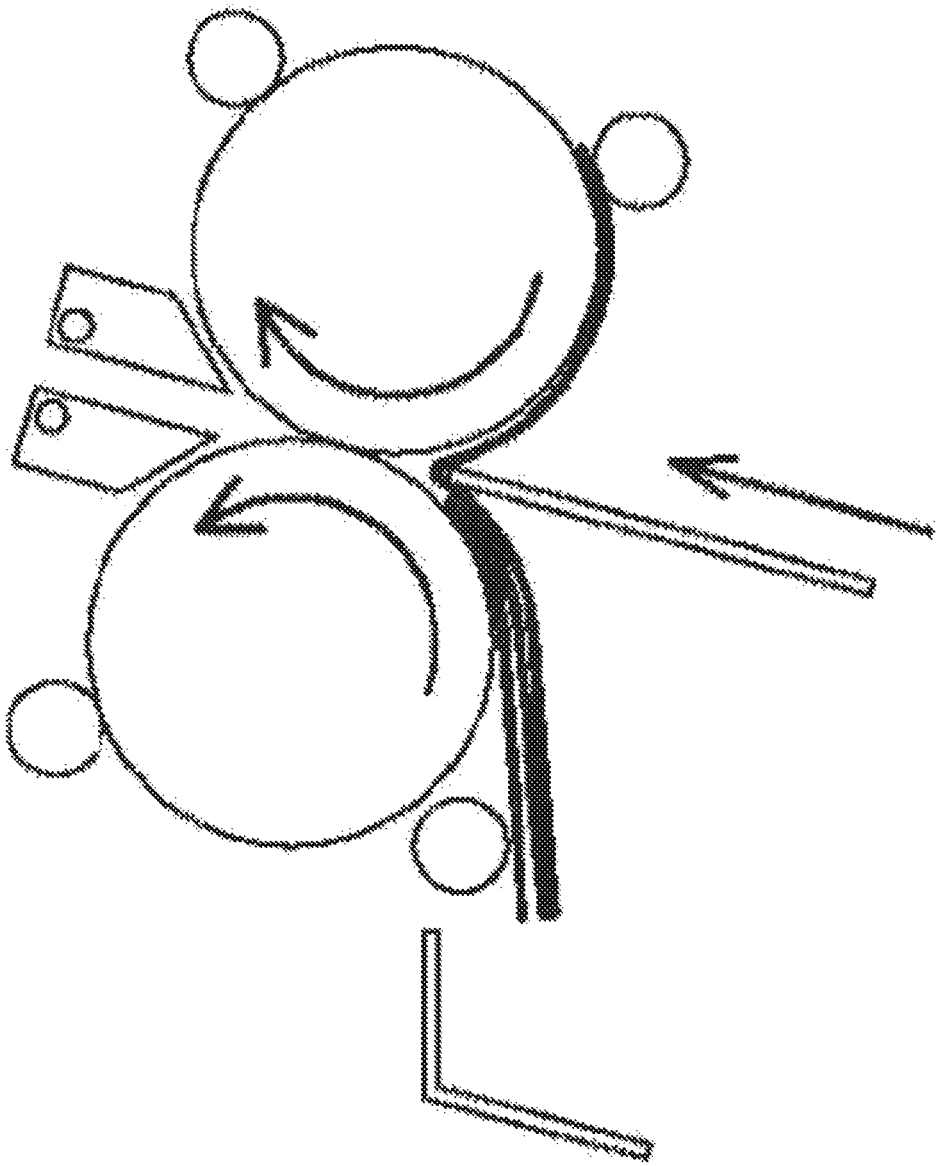
Figure 12J:
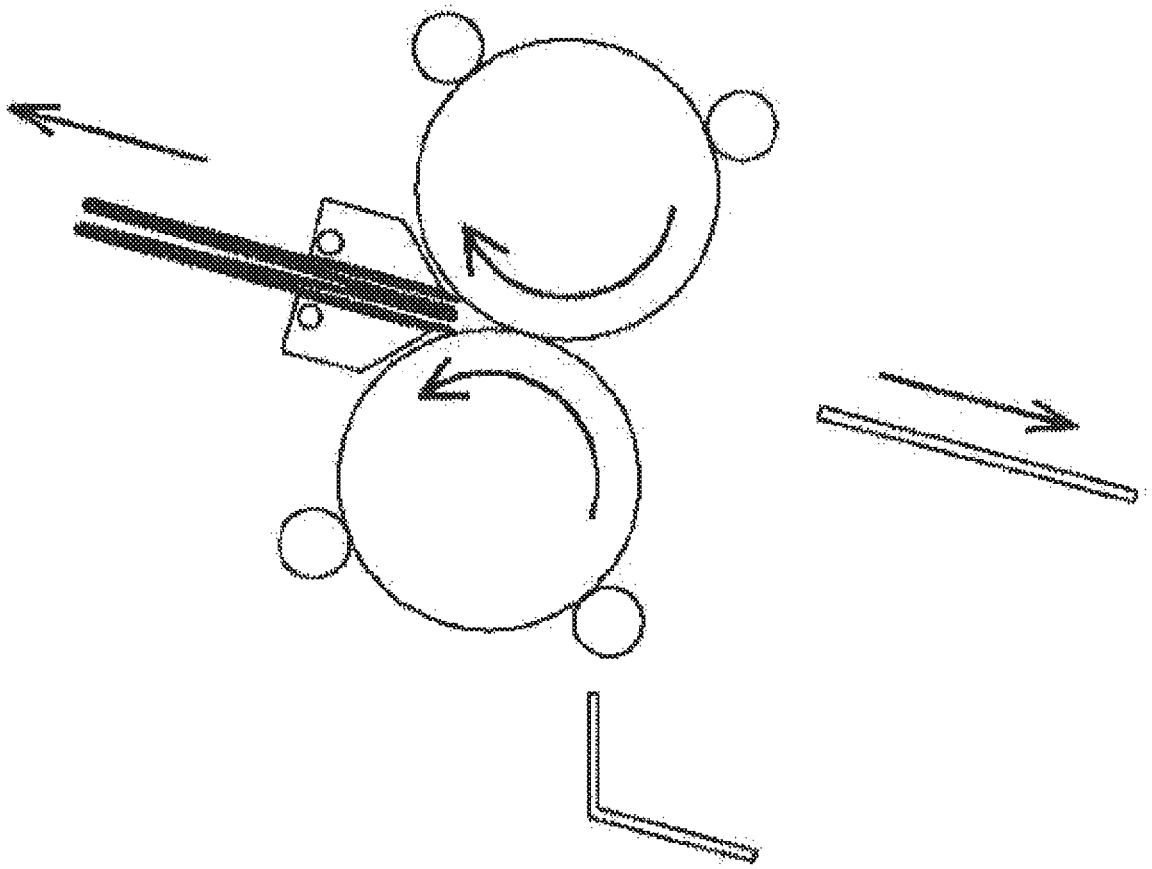

The paper P having passed through the folding nip N for the second time is fed around the first roller 721 and is returned to the entrance of the folding nip N. To achieve this, the first shift member 731 is maintained at a first shift location. The paper P having passed through the folding nip N for the second time is returned to the entrance of the folding nip N along the first guide path 761 (FIG. 12G). When the paper P is fed along the folding path 710 in a forward direction, and a ¾L point of the paper P reaches the vicinity of the folding nip N (FIG. 12H), the ¾L point of the paper P is pushed into the folding nip N by moving the push member 750 to the insertion location (FIG. 12I). The first and second shift members 731 and 732 are placed in discharge locations. Accordingly, the paper P folded in the form of a W is discharged by the discharge roller 760 (FIG. 12J). The push member 750 returns to the retreat location.

In order to enable performance of the 4-fold, Z-fold, and W-fold processes (the first method), lengths of the first and second guide paths 761 and 762 should be equal to or greater than ½ of the length L of applicable maximum paper P. The lengths of the first and second guide paths 761 and 762 refer to lengths over which the paper P having passed through the folding nip N reaches the folding nip N again along the first and second guide paths 761 and 762. In the present example, since the first and second rollers 721 and 722 define side guides (inner guides) of the first and second guide paths 761 and 762, outer circumferential lengths of the first and second rollers 721 and 722 should be equal to or greater than ½ of the length L of the applicable maximum paper P.

In order to enable 3-fold, lengths of the first and second guide paths 761 and 762 should be equal to or greater than ⅓ of the length L of applicable maximum paper P. In the present example, since the first and second rollers 721 and 722 define side guides (inner guides) of the first and second guide paths 761 and 762, outer circumferential lengths of the first and second rollers 721 and 722 should be equal to or greater than ⅓ of the length L of the applicable maximum paper P.

In order to enable C-fold, lengths of the first and second guide paths 761 and 762 should be equal to or greater than ⅔ of the length L of applicable maximum paper P. In the present example, since the first and second rollers 721 and 722 define side guides (inner guides) of the first and second guide paths 761 and 762, outer circumferential lengths of the first and second rollers 721 and 722 should be equal to or greater than ⅔ of the length L of the applicable maximum paper P.

In order to enable double gate fold, roll-fold, and W-fold (the second method), lengths of the first and second guide paths 761 and 762 should be equal to or greater than ¾ of the length L of applicable maximum paper P. In the present example, since the first and second rollers 721 and 722 define side guides (inner guides) of the first and second guide paths 761 and 762, outer circumferential lengths of the first and second rollers 721 and 722 should be equal to or greater than ¾ of the length L of the applicable maximum paper P.

By taking the above relationships into account, lengths of the first and second guide paths 761 and 762 may be at least equal to or greater than ⅓ of the length L of applicable maximum paper P, and when the first and second rollers 721 and 722 define side guides (inner guides) of the first and second guide paths 761 and 762, outer circumferential lengths of the first and second rollers 721 and 722 may be equal to or greater than ⅓ of the length L of the applicable maximum paper P.

Figure 13:
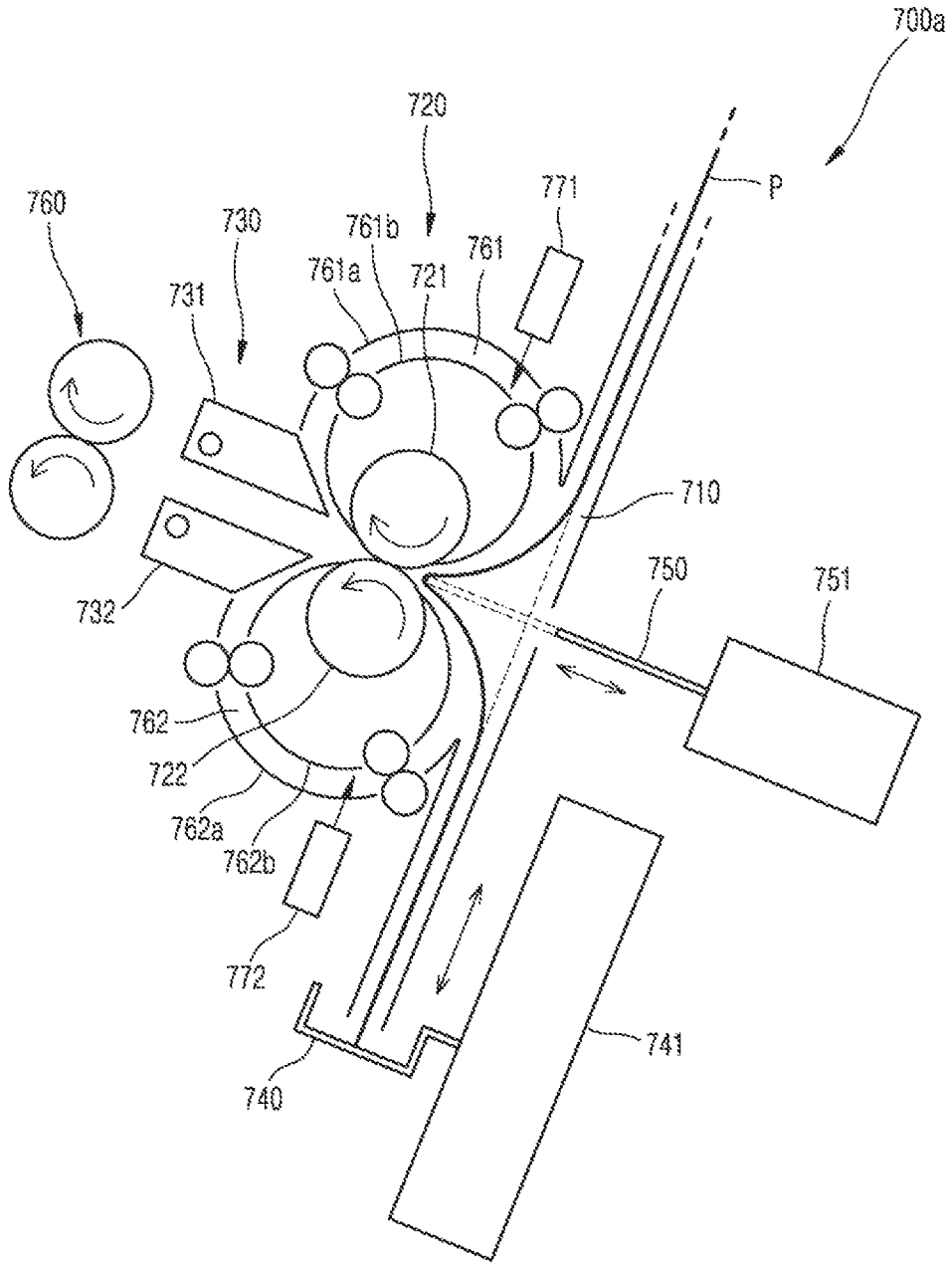
FIG. 13 is a configuration diagram of a sheet folding apparatus according to an example.

FIG. 13 is a schematic configuration diagram of a sheet folding apparatus 700*a* according to an example. The sheet folding apparatus 700*a* according to the present example is different from the sheet folding apparatus 700 illustrated in FIG. 2 in that the first and second guide paths 761 and 762 are respectively defined by a first outer guide 761*a* and a first inner guide 761*b*, and a second outer guide 762*a* and a second inner guide 762*b*. Although not denoted by reference numerals, pairs of feed rollers rotatably engaging with each other, and feeding the paper P along the first and second guide paths 761 and 762 may be provided in the first and second guide paths 761 and 762.

According to the above configuration, limitation on outer circumferential lengths of the first and second rollers 721 and 722 applied to the sheet folding apparatus 700 illustrated in FIG. 2 is not applied to the sheet folding apparatus 700*a* according to the present example. Accordingly, sizes of the first and second rollers 721 and 722 may be large. However, lengths of the first and second guide paths 761 and 762 should satisfy the above condition according to a folding method.

Figure 14:
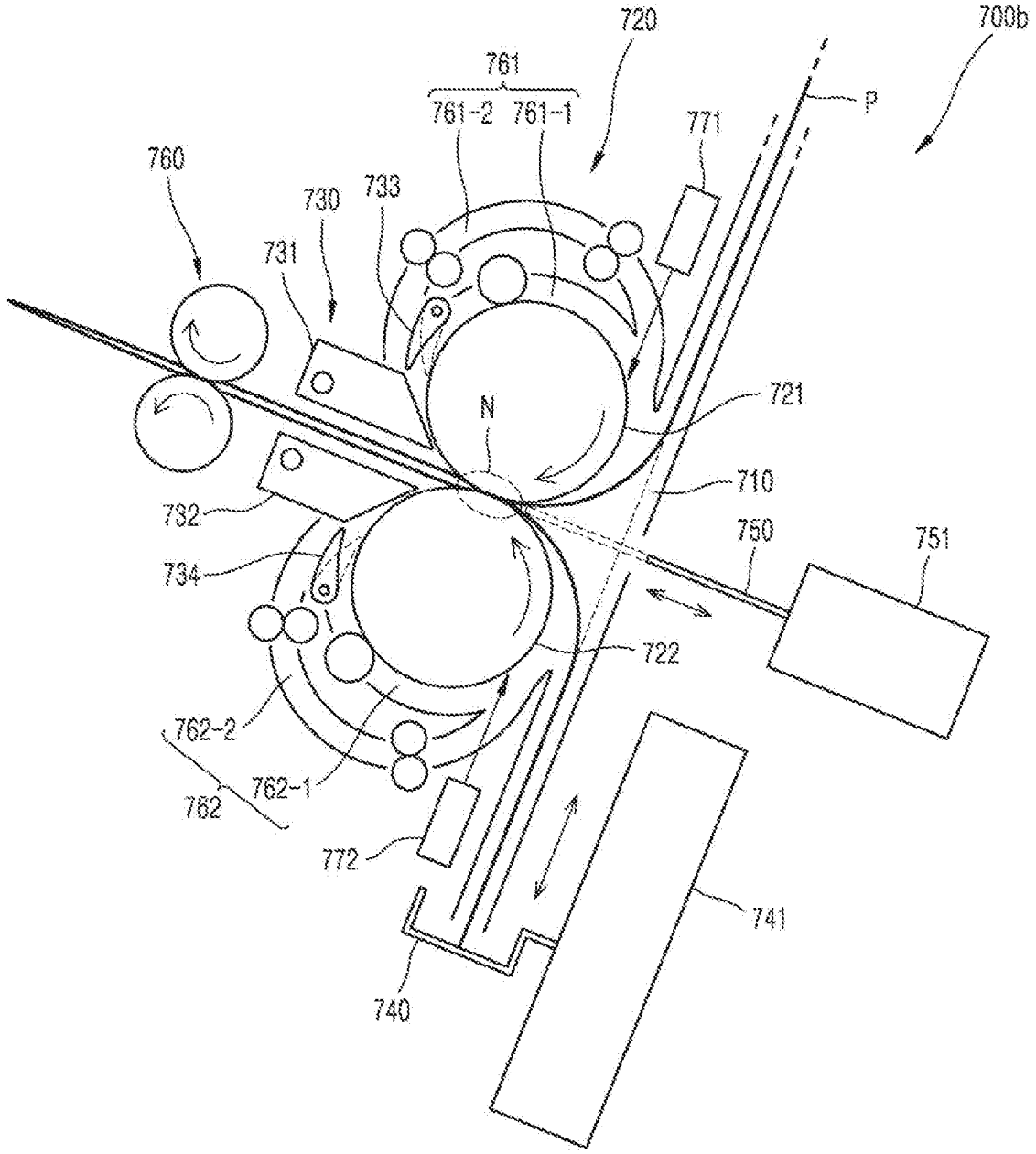
FIG. 14 is a configuration diagram of a sheet folding apparatus according to an example.

FIG. 14 is a schematic configuration diagram of a sheet folding apparatus 700*b* according to an example. The sheet folding apparatus 700*b* according to the present example is different from the sheet folding apparatus 700 illustrated in FIG. 2 in that a guide path includes an inner guide path and an outer guide path and a gate member for selectively guiding paper having passed through the folding nip N and been guided to the guide path by a shift member to the inner guide path or the outer guide path is provided.

Referring to FIG. 14, the first guide path 761 includes a first inner guide path 761-1 and a first outer guide path 761-2. The first inner guide path 761-1 is a path adjacent to the first roller 721, and the first outer guide path 761-2 is at an outer side of the first inner guide path 761-1. The outer circumference of the first roller 721 may define a side guide (inner guide) of the first inner guide path 761-1.

A feed distance of the paper P when the paper P having passed through the folding nip N returns to an entrance of the folding nip N is longer along the first outer guide path 761-2 than along the first inner guide path 761-1. A first gate member 733 selectively guides the paper P guided to the first guide path 761 by the first shift member 731 to the first inner guide path 761-1 or the first outer guide path 761-2. For example, the first gate member 733 may rotate to a location (denoted by solid lines) for guiding the paper P to the first inner guide path 761-1 and a location (denoted by dashed lines) for guiding the paper P to the first outer guide path 761-2. Although not illustrated, the first gate member 733 may be driven by an actuator such as solenoid.

Likewise, the second guide path 762 includes a second inner guide path 762-1 and a second outer guide path 762-2. The second inner guide path 762-1 is a path adjacent to the second roller 722, and the second outer guide path 762-2 is at an outer side of the second inner guide path 762-1. The outer circumference of the second roller 722 may define a side guide (inner guide) of the second inner guide path 762-1.

A feed distance of the paper P when the paper P having passed through the folding nip N returns to the entrance of the folding nip N is longer along the second outer guide path 762-2 than along the second inner guide path 762-1. A second gate member 734 selectively guides the paper P guided to the second guide path 762 by the second shift member 732 to the second inner guide path 762-1 or the second outer guide path 762-2. For example, the second gate member 734 may rotate to a location (denoted by solid lines) for guiding the paper P to the second inner guide path 762-1 and a location (denoted by dashed lines) for guiding the paper P to the second outer guide path 762-2. Although not illustrated, the second gate member 734 may be driven by an actuator such as solenoid.

Although not denoted by reference numerals in FIG. 14, but denoted with numeral 770 in FIGS. 6D, 6E, 6F, etc., driven rollers rotatably engaging with the first and second rollers 721 and 722, and feeding the paper P along the first and second inner guide paths 761-1 and 762-1 may be provided in the first and second inner guide paths 761-1 and 762-1. In addition, although not denoted by reference numerals, pairs of feed rollers rotatably engaging with each other, and feeding the paper P along the first and second outer guide paths 761-2 and 762-2 may be provided in the first and second outer guide paths 761-2 and 762-2.

According to the above configuration, a path satisfying a length condition of the guide path according to a folding method may be selected, and thus, folding may be performed in various ways. Also, the paper P having a small length may be guided to the first and second inner guide paths 761-1 and 762-1, and the paper P having a large length may be guided to the first and second outer guide paths 761-2 and 762-2. Accordingly, the paper P having various lengths may be folded in various ways.

A radius of curvature of the first and second outer guide paths 761-2 and 762-2 may be greater than that of the first and second inner guide paths 761-1 and 762-1. According to the above configuration, the paper P may be guided to a proper guide path according to a thickness or rigidity of the paper P. For example, the paper P having a large thickness or rigidity may be guided to the first and second outer guide paths 761-2 and 762-2 having a large radius of curvature, and the paper P having a small thickness or rigidity may be guided to the first and second inner guide paths 761-1 and 762-1 having a small radius of curvature.

Figure 15:
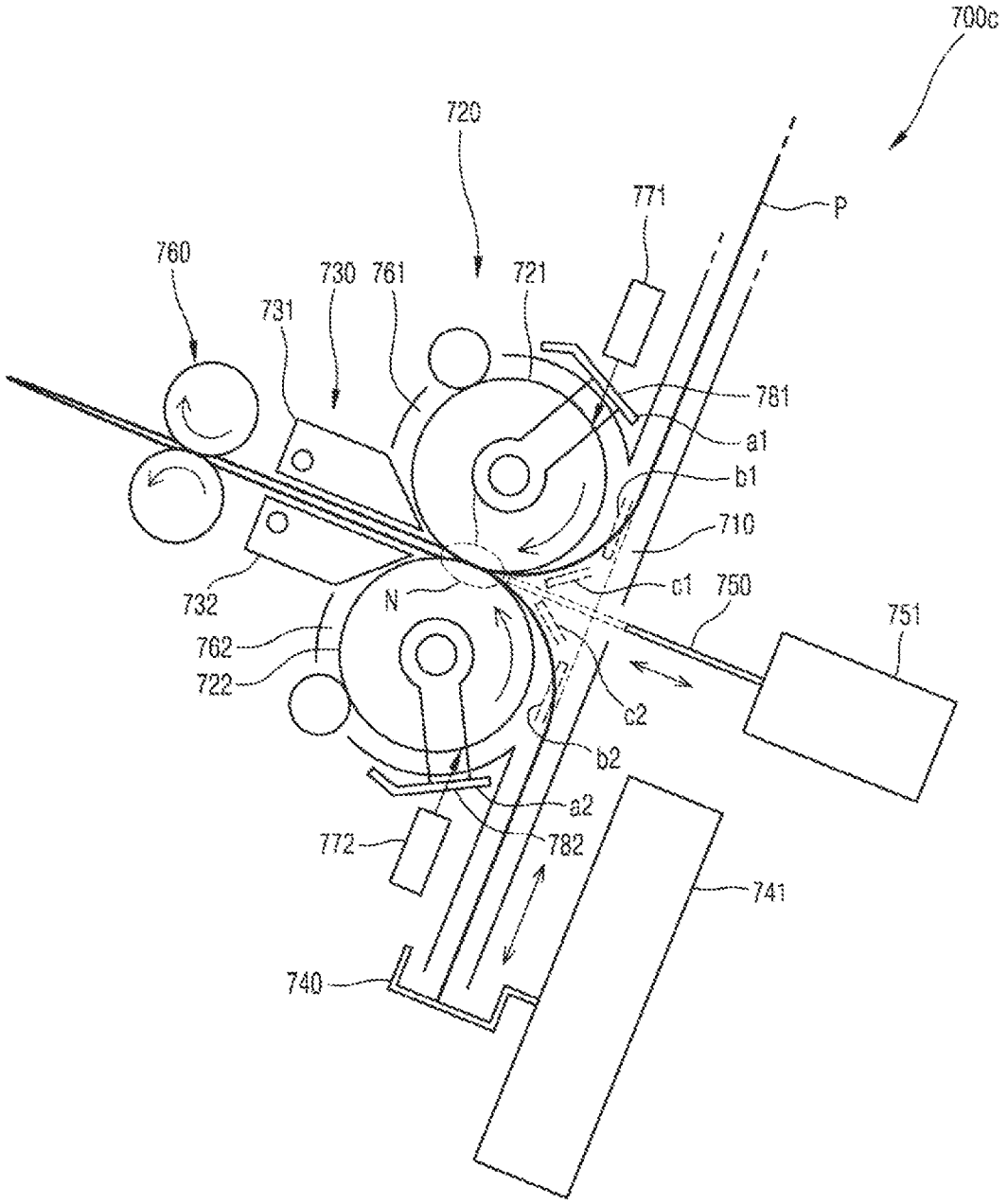
FIG. 15 is a configuration diagram of a sheet folding apparatus according to an example.

FIG. 15 is a configuration diagram of a sheet folding apparatus 700*c* according to an example. The sheet folding apparatus 700*c* according to the present example is different from the sheet folding apparatus 700 illustrated in FIG. 2 in that the sheet folding apparatus 700*c* includes a guide member installed at an exit of a guide path that is capable of moving to a guide location for guiding the paper P to the folding path 710 and an escape location for escaping from the guide location.

Referring to FIG. 15, a first guide member 781 is at an exit of the first guide path 761. The first guide member 781 may move from a first escape location a1 to a first guide location b1. For example, the first guide member 781 may be installed at a rotation axis of the first roller 721 so as to be capable of rotating to the first escape location a1 and the first guide location b1. Although not illustrated, the first guide member 781 is rotated to the first escape location a1 and the first guide location b1 by an actuator. The actuator may be, for example, a rotation motor. The rotation motor may be connected to the first guide member 781, for example, by a gear. At the first guide location b1, the first guide member 781 guides the paper P so that the paper P fed along the first guide path 761 may stably enter the folding path 710.

A second guide member 782 is at an exit of the second guide path 762. The second guide member 782 may move from a second escape location a2 to a second guide location b2. For example, the second guide member 782 may be installed at a rotation axis of the second roller 722 so as to be capable of rotating to the second escape location a2 and the second guide location b2. Although not illustrated, the second guide member 782 is rotated to the second escape location a2 and the second guide location b2 by an actuator. The actuator may be, for example, a rotation motor. The rotation motor may be connected to the second guide member 782, for example, by a gear. At the second guide location b2, the second guide member 782 guides the paper P so that the paper P fed along the second guide path 762 may stably enter the folding path 710.

According to the above configuration, the paper P having come out from the guide path may stably enter the folding path 710, and thus, a second or subsequent folding operation may be stably performed.

The first guide member 781 may further have a first blocking location c1. The first blocking location c1 is a location for blocking the paper P that comes out from the second guide path 762 and is fed along the folding path 710 in a reverse direction from reversely entering the first guide path 761 via an exit of the first guide path 761. Likewise, the second guide member 782 may further have a second blocking location c2. The second blocking location c2 is a location for blocking the paper P that comes out from the first guide path 761 and is fed along the folding path 710 in a forward direction from reversely entering the second guide path 762 via an exit of the second guide path 762.

According to the above configuration, the paper P having come out from the first and second guide paths 761 and 762 may be blocked from reversely entering the second and first guide paths 762 and 761. Thus, an operational error of a sheet folding apparatus may be prevented, and operation reliability of the sheet folding apparatus may be improved.

FIG. 16A-16J show an example of a double gate fold process using the sheet folding apparatus 700*c* illustrated in FIG. 15. In FIGS. 16A-16J, the first and second rollers 721 and 722, the positioning member 740, the push member 750, the first and second shift members 731 and 732, and the first and second guide members 781 and 782 are briefly illustrated.

Figure 16A:
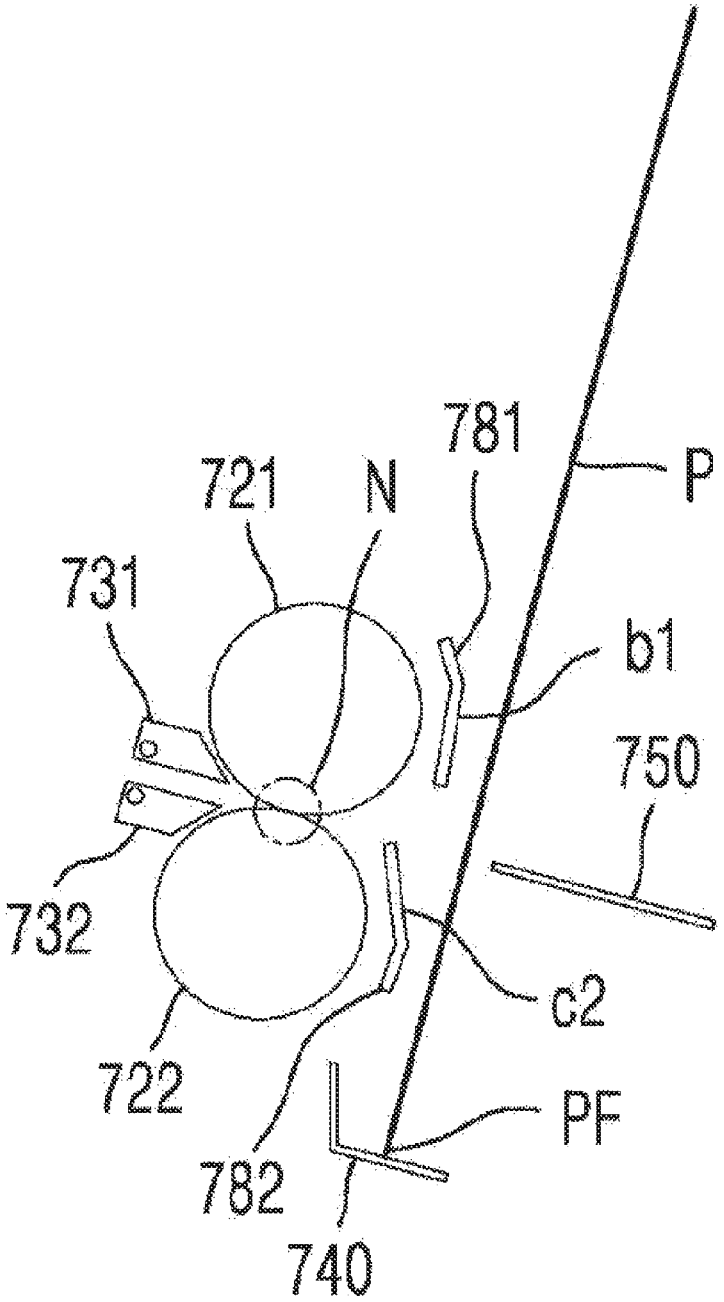
FIGS. 16A-16J show an example of a double gate fold process using the sheet folding apparatus of FIG. 15.
Figure 16B:
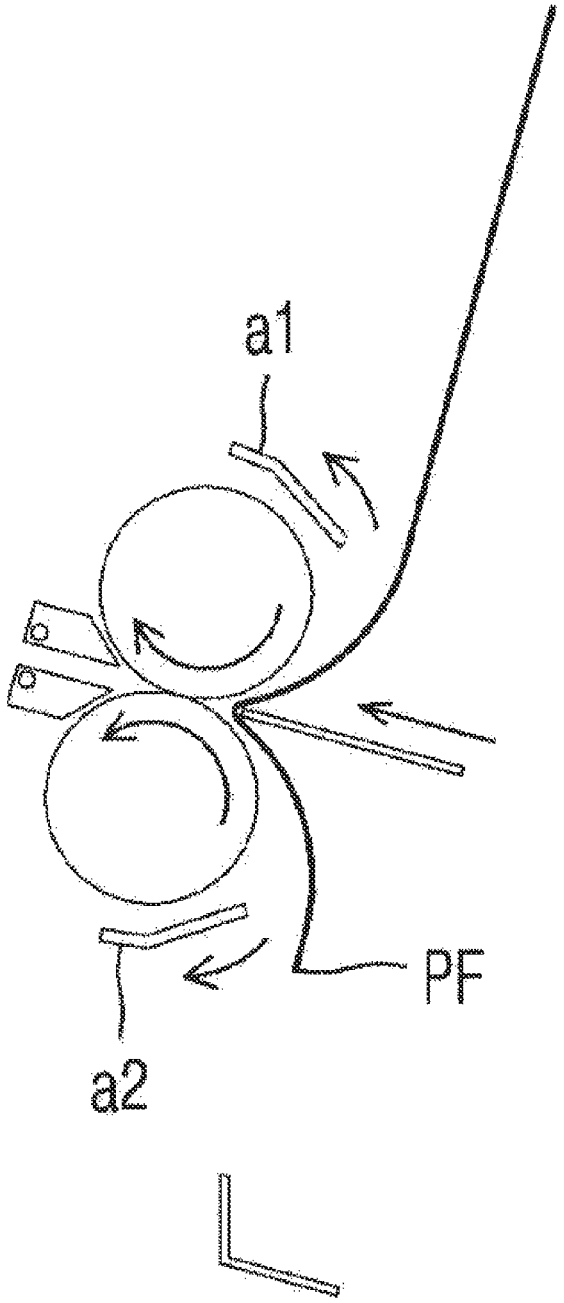

As illustrated in FIG. 16A, the positioning member 740 is located such that a ¼L point of the paper P is located at an entrance of the folding nip N. The first guide member 781 is placed in the first guide location b1, and the second guide member 782 is placed in the second blocking location c2 for blocking the paper P that is fed along the folding path 710 in a forward direction from entering the second guide path 762 via an exit thereof. The paper P is fed along the folding path 710. In an example, the paper P may be discharged from a printer, such as printer 100, and fed along the folding path 710. The first end PF of one piece or a plurality of pieces of paper P is supported by the positioning member 740. The first guide member 781 is moved to the first escape location a1, and the second guide member 782 is moved to the second escape location a2. The ¼L point of the paper P is pushed into the folding nip N by moving the push member 750 to an insertion location (FIG. 16B). As the paper P passes through the folding nip N, the ¼L point is folded. The push member 750 returns to a retreat location.

Figure 16C:
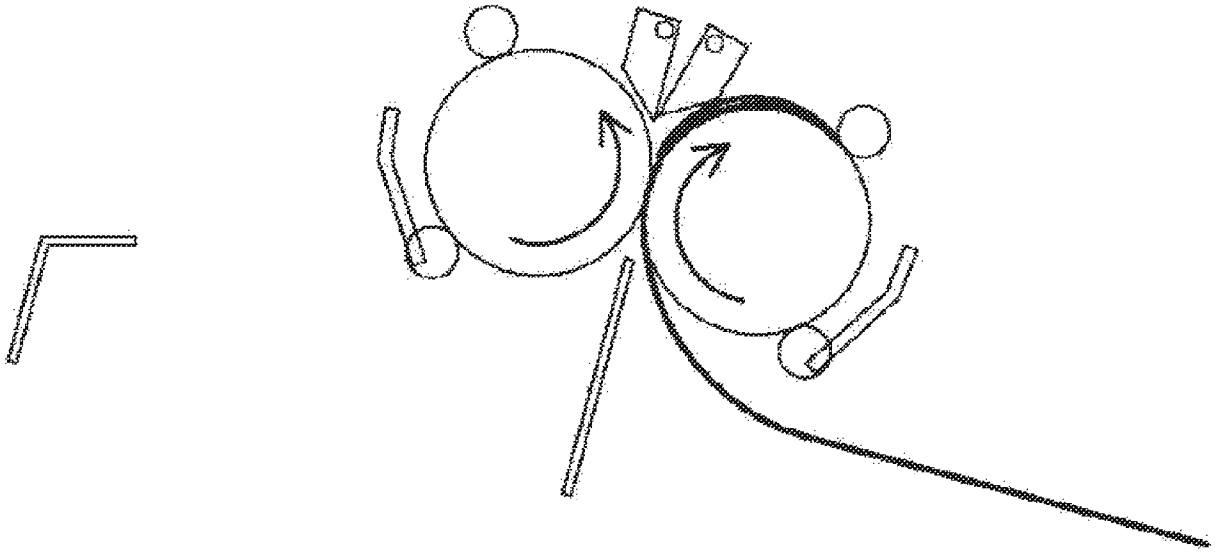
Figure 16D:
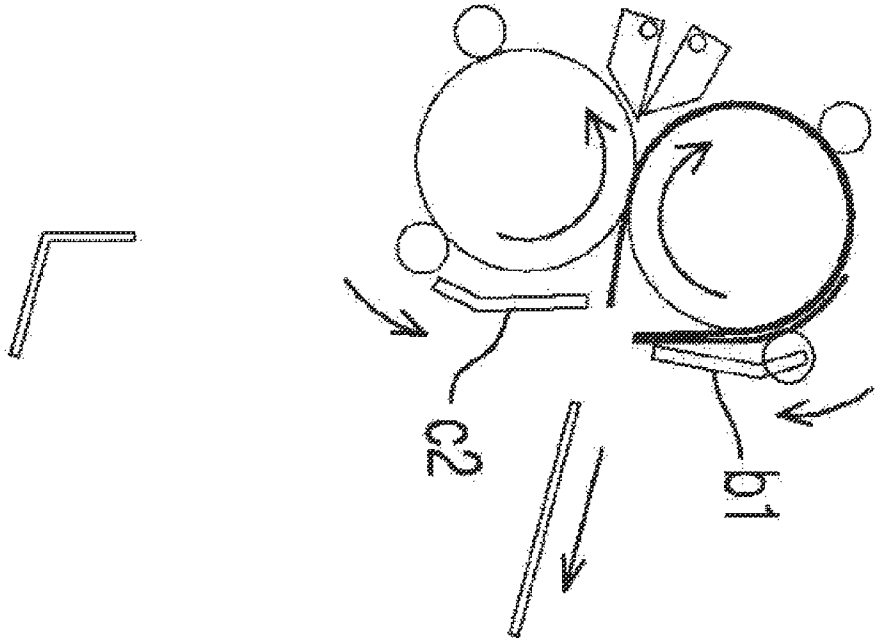
Figure 16E:
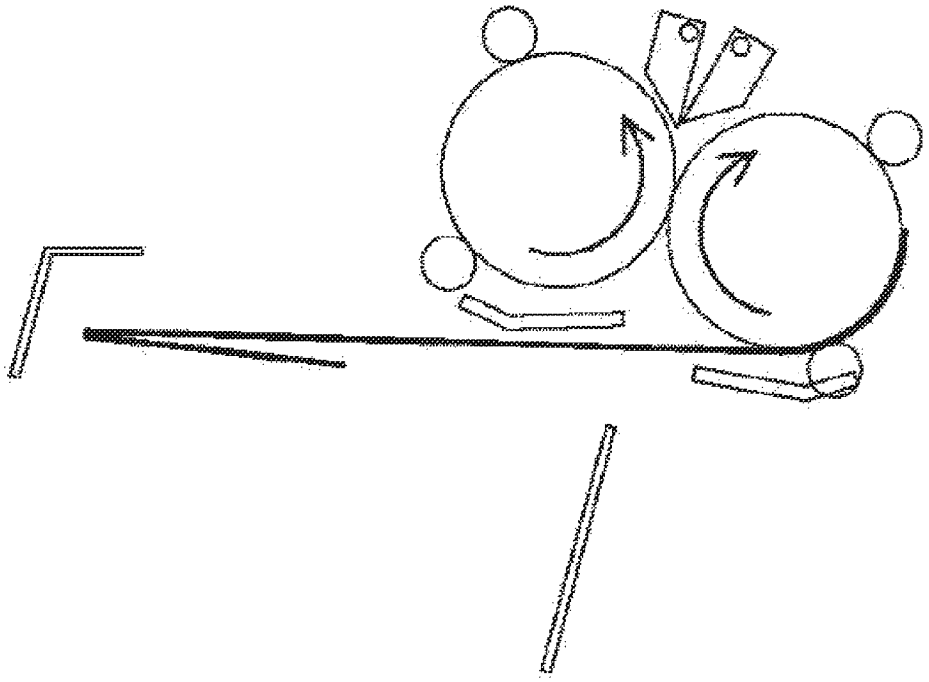
Figure 16F:
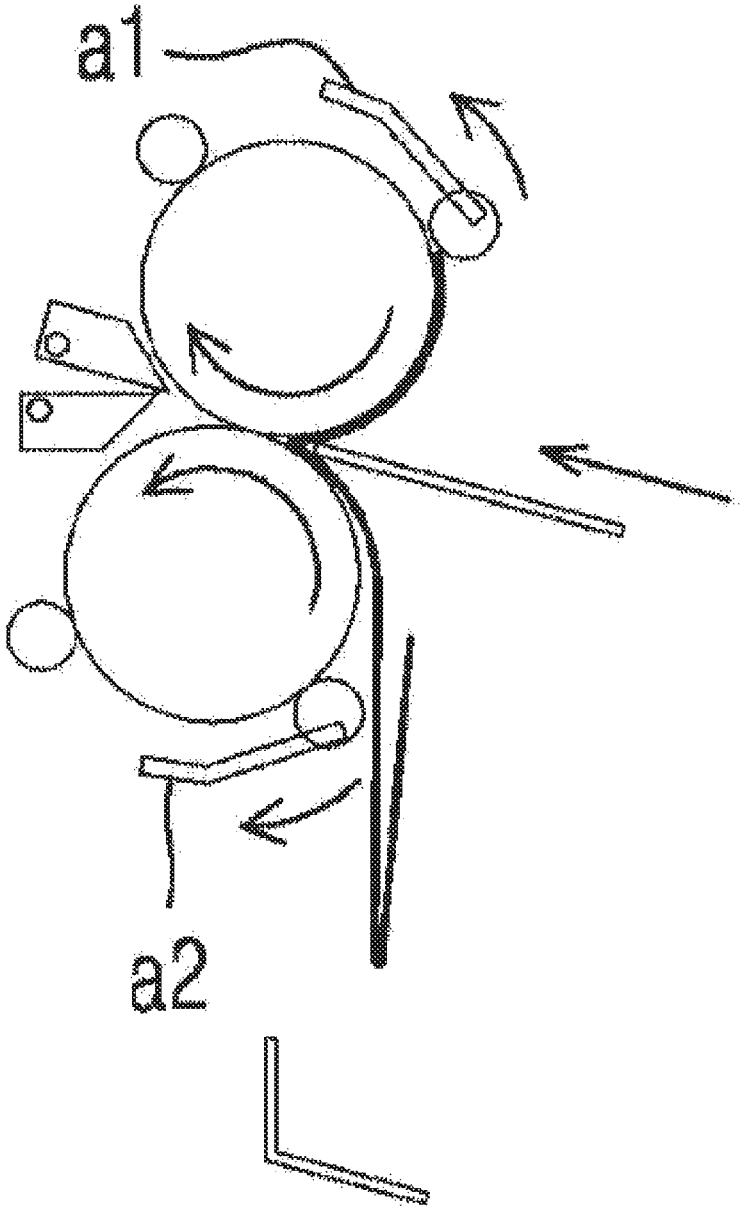

The paper P having passed through the folding nip N is fed around a roller on an opposite side of the first end PF of the paper P from among the first and second rollers 721 and 722, that is, the first roller 721, and is returned to the entrance of the folding nip N. To achieve this, the first shift member 731 is placed in a first shift location, and the paper P having passed through the folding nip N is returned to the entrance of the folding nip N along the first guide path 761. In this regard, the first guide member 781 is placed in the first guide location b1 for guiding the paper P to the folding path 710, and the second guide member 782 is placed in the second blocking location c2 for blocking the paper P that is fed along the folding path 710 in the forward direction from entering the second guide path 762 (FIG. 16C and FIG. 16D). When the paper P is fed along the folding path 710 in the forward direction, and a ¾L point of the paper P reaches the vicinity of the folding nip N (FIG. 16E), the first and second guide members 781 and 782 are respectively moved to the first and second escape locations a1 and a2, and the ¾L point of the paper P is pushed into the folding nip N by moving the push member 750 to the insertion location (FIG. 16F). The push member 750 returns to the retreat location.

Figure 16G:
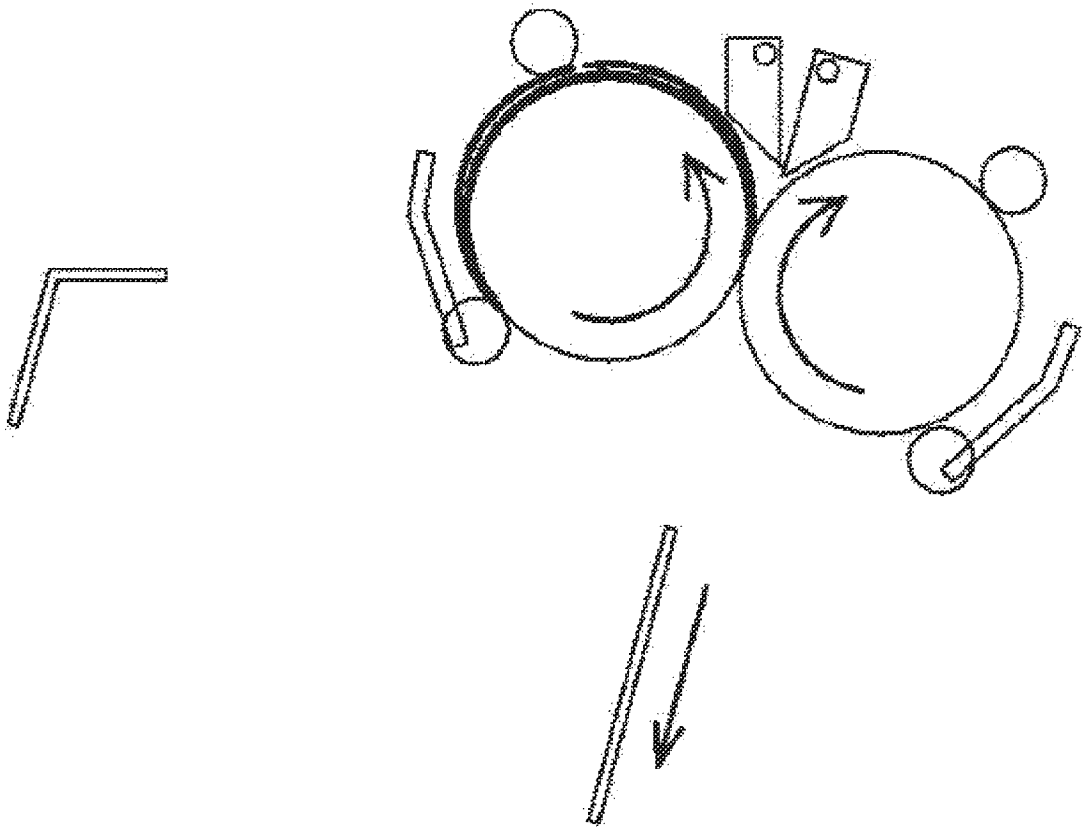
Figure 16H:
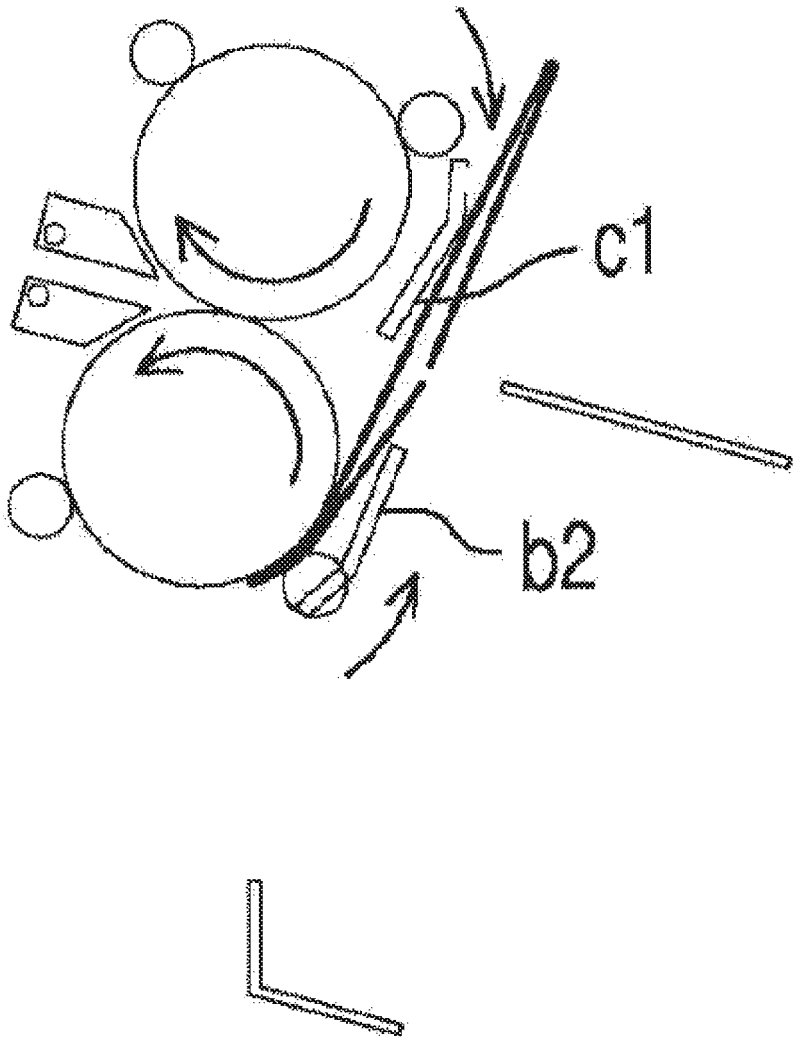
Figure 16I:
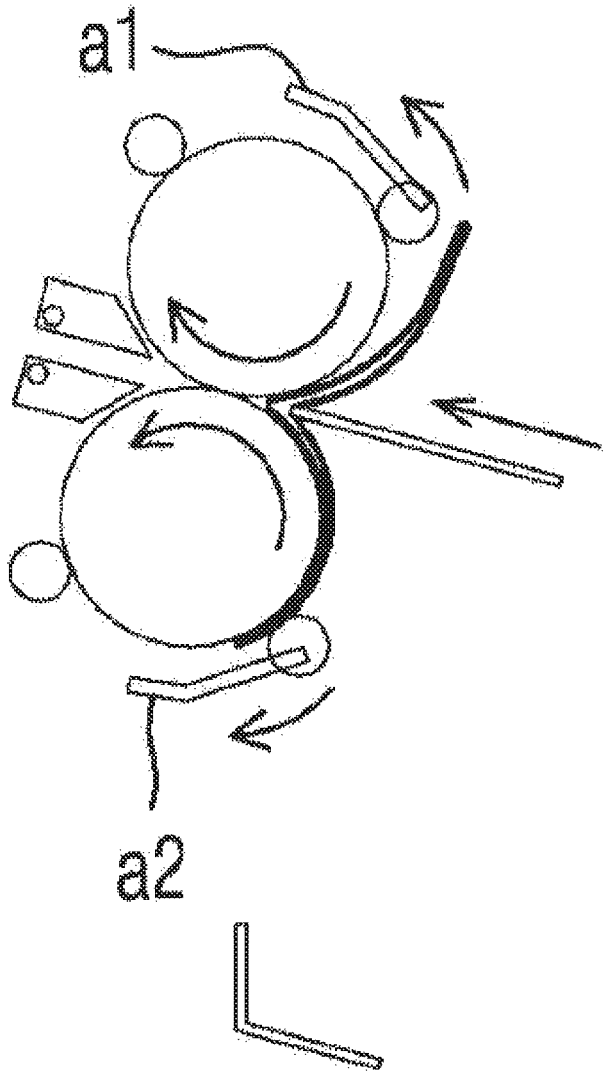
Figure 16J:
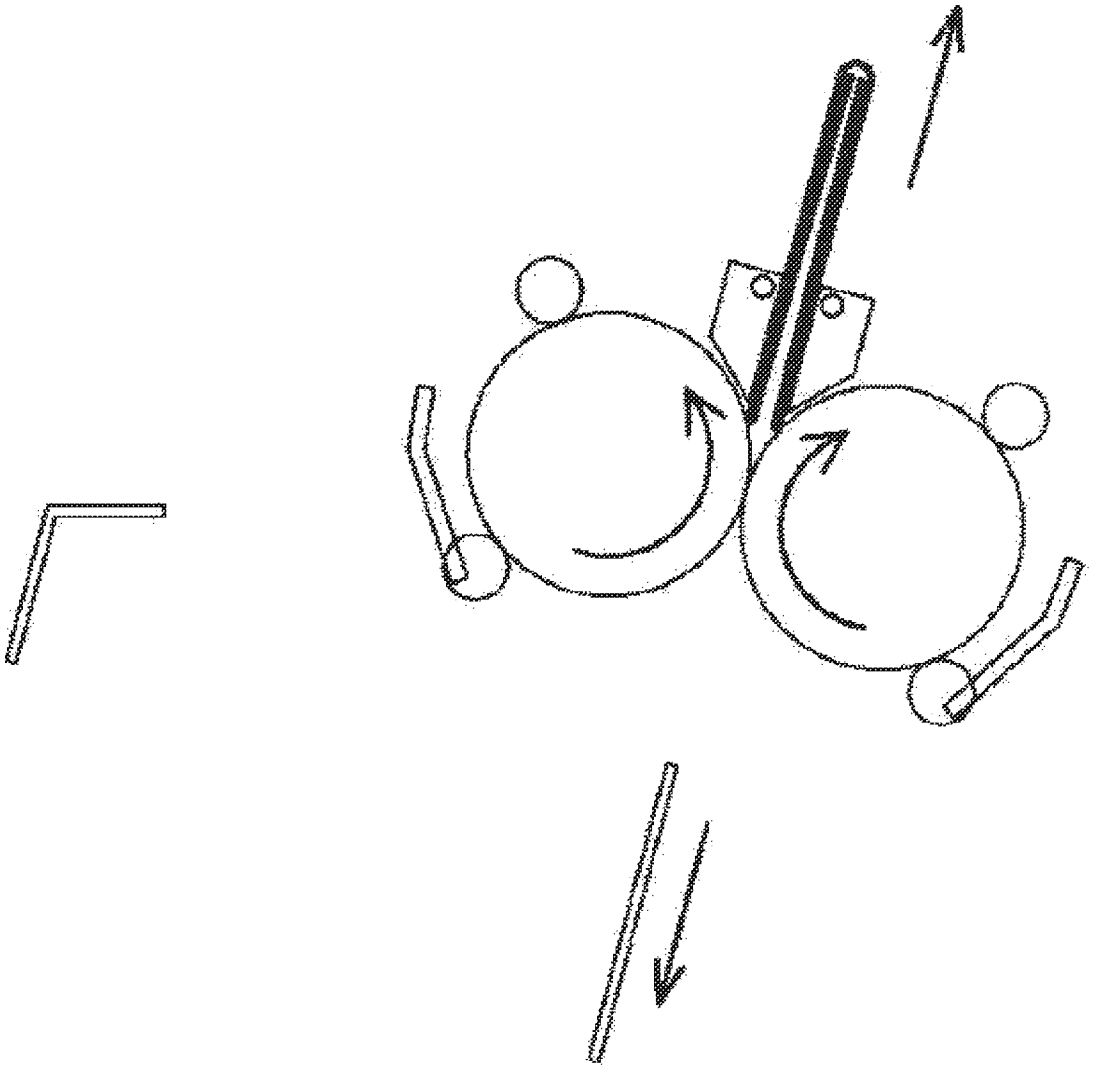

The paper P having passed through the folding nip N for the second time is fed around the second roller 722 and is returned to the entrance of the folding nip N. To achieve this, the second shift member 732 is placed in a second shift location, and the paper P having passed through the folding nip N for the second time is returned to the entrance of the folding nip N along the second guide path 762 (FIG. 16G). The second guide member 782 is placed in the second guide location b2, and the first guide member 781 is placed in the first blocking location c1 for blocking the paper P that is fed along the folding path 710 in a reverse direction from entering the first guide path 761 via an exit thereof. When the paper P is fed along the folding path 710 in the reverse direction, and a ½L point of the paper P reaches the vicinity of the folding nip N (FIG. 16H), the first and second guide members 781 and 782 are respectively moved to the first and second escape locations a1 and a2, and the ½L point of the paper P is pushed into the folding nip N by moving the push member 750 to the insertion location (FIG. 16I). The first and second shift members 731 and 732 are placed in discharge locations. Accordingly, the paper P folded in the form of a double gate is discharged by the discharge roller 760 (FIG. 16J). The push member 750 returns to the retreat location.

The first and second blocking locations c1 and c2 of the first and second guide members 781 and 782 may be respectively locations for guiding the paper P having come out from the first and second guide paths 761 and 762 to go into the folding nip N again. Independently of the first and second blocking locations c1 and c2, the first and second guide members 781 and 782 may further have first and second re-entry locations for guiding the paper P having come out from the first and second guide paths 761 and 762 to go into the folding nip N again.

When the paper P re-enters the folding nip N as described above, the folded paper P may be pressed between the first and second rollers 721 and 722 one more time, and thus, a vivid folding line may be obtained.

Figure 17A:
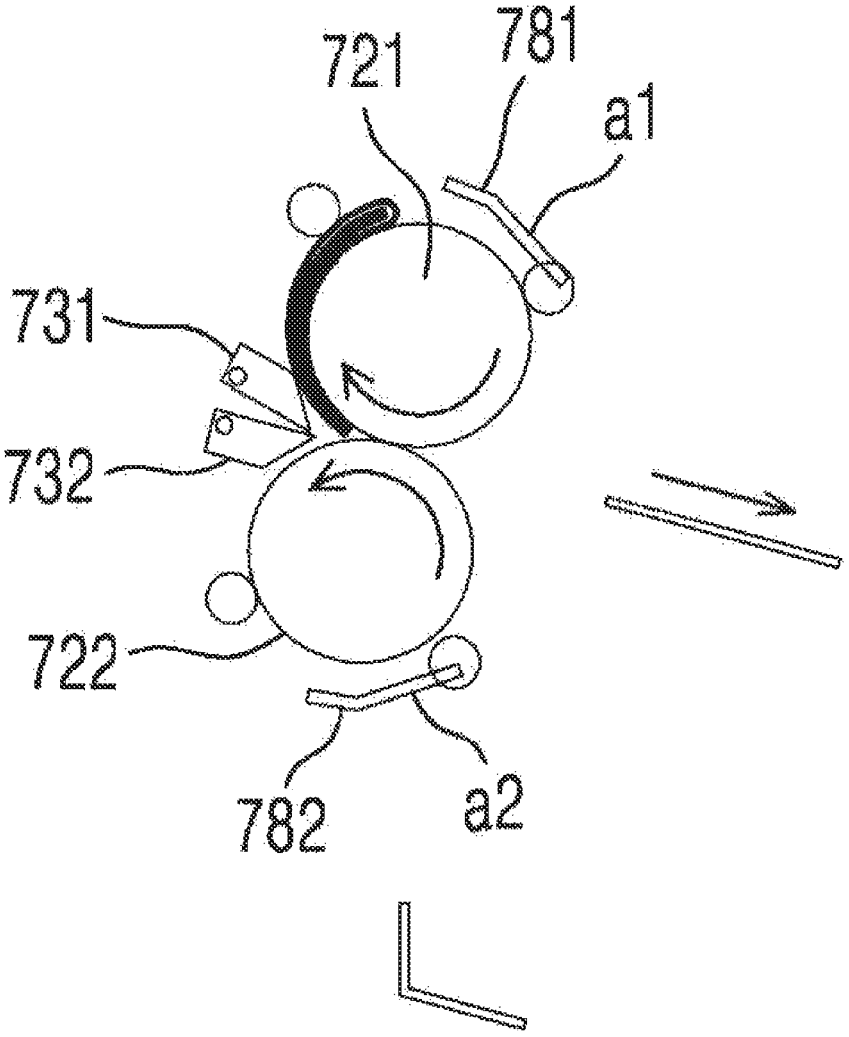
FIGS. 17A-17D show a process of allowing paper folded in the form of a double gate to re-enter a folding nip.
Figure 17B:
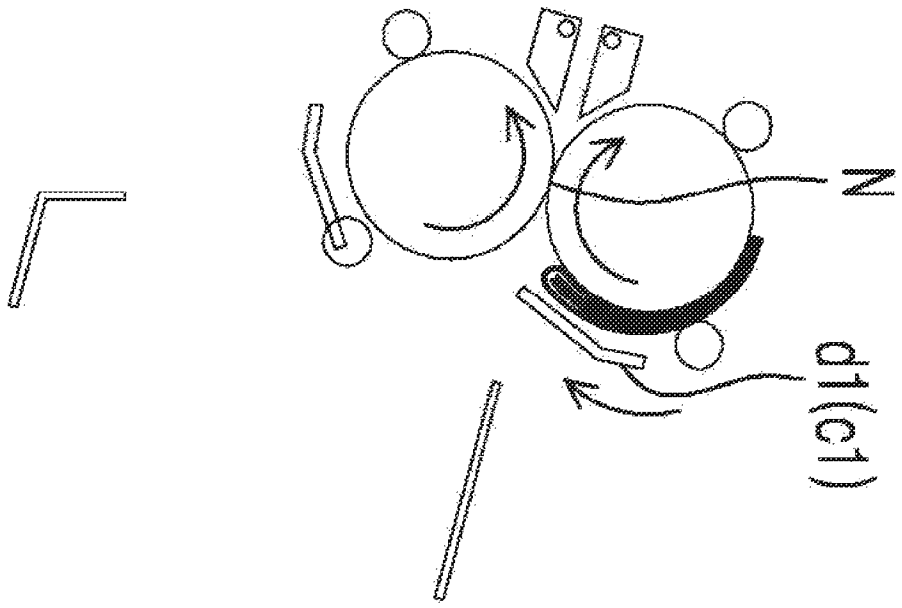
Figure 17C:
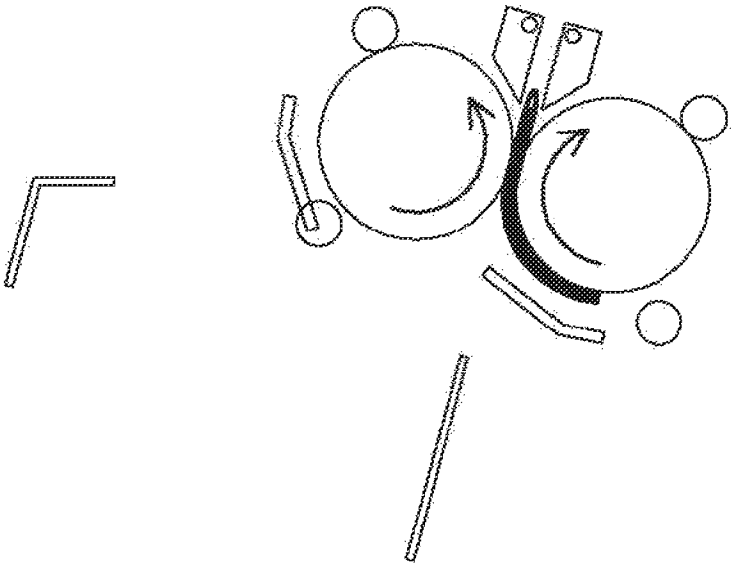
Figure 17D:
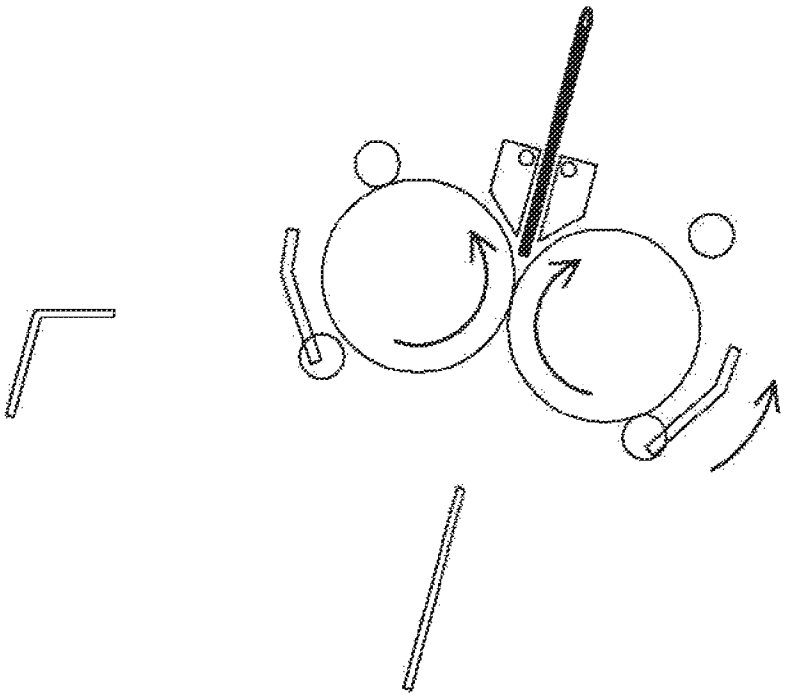

FIGS. 17A-17D show a process of allowing paper P folded in the form of a double gate to re-enter a folding nip N. After the process of FIG. 16I, as illustrated in FIG. 17A, for example, the first shift member 731 is shifted to the first shift location so that the paper P folded in the form of a double gate enters the first guide path 761. The first guide member 781 is moved to the first blocking location c1 (or a first re-entry location d1) (FIG. 17B). As a result, as illustrated in FIG. 17C, the paper P having come out from the first guide path 761 re-enters the folding nip N. In this regard, the first and second shift members 731 and 732 are placed in the discharge locations, and the paper P is discharged by the discharge roller 760 (FIG. 17D). If necessary, the operations of FIGS. 17A to 17C may be performed two or more times.

The above re-entry process may be applied to 4-fold, Z-fold, W-fold, 3-fold outside, C-fold, double gate fold, and roll-fold.

It should be understood that examples described herein should be considered in a descriptive sense and not for limitation. Descriptions of features within each example may be considered as available for other similar features in other examples.

While examples have been described with reference to the figures, it will be understood by those of ordinary skill in the art that various changes in form and details may be made therein without departing from the spirit and scope of the inventive concept as defined by the following claims.

The invention claimed is:

1. A sheet folding apparatus comprising:

a folding roller including a pair of rollers to rotatably engage with each other to form a folding nip;

a positioning member to support a first end of a printing medium which is fed along a folding path and to arrange the printing medium in an initial folding location;

a push member to move to an insertion location to push the printing medium on the folding path into the folding nip, and to move to a retreat location to escape from the folding path;

a shift member, located at an exit of the folding nip, to selectively guide the printing medium to a guide path to return the printing medium having passed through the folding nip to the folding path, the guide path being provided around at least one of the pair of rollers; and a guide member selectively moveable to a plurality of locations including a guide location to guide the printing medium coming out from the guide path to the folding path, an escape location to escape from the guide location, and a re-entry location to allow the printing medium coming out from the guide path to re-enter the folding nip.

2. The sheet folding apparatus of claim 1, wherein a length of the guide path is equal to or greater than ⅓ of a printing medium length.

3. The sheet folding apparatus of claim 1, wherein the at least one of the pair of rollers defines an inner guide of the guide path, and wherein an outer circumferential length of a roller from among the pair of rollers defining the inner guide of the guide path is equal to or greater than ⅓ of a printing medium length.

4. The sheet folding apparatus of claim 1, wherein the guide path comprises an inner guide path adjacent to the folding roller, and an outer guide path located at an outer side of the inner guide path.

5. The sheet folding apparatus of claim 4, further comprising a gate member to selectively guide the printing medium to the inner guide path or the outer guide path.

6. The sheet folding apparatus of claim 1, wherein the guide member is to rotate on an axis of a roller from among the pair of rollers around which the guide path is disposed.

7. The sheet folding apparatus of claim 1, wherein the guide member is further movable to a blocking location to block the printing medium on the folding path from reversely entering the guide path.

8. The sheet folding apparatus of claim 1, wherein the pair of rollers includes a first roller and a second roller, wherein the guide path includes a first guide path around the first roller and a second guide path around the second roller, wherein the shift member includes a first shift member to selectively guide the printing medium having passed through the folding nip to the first guide path and a second shift member to selectively guide the printing medium having passed through the folding nip to the second guide path, and wherein a length of each of the first guide path and second guide path is equal to or greater than ⅓ of a printing medium length.

9. The sheet folding apparatus of claim 8, wherein the first roller defines an inner guide of the first guide path and the second roller defines an inner guide of the second guide path, and wherein an outer circumferential length of each of the first roller and the second roller is equal to or greater than ⅓ of a printing medium length.

10. The sheet folding apparatus of claim 8, further comprising first and second guide members to selectively move to a guide location to guide the printing medium coming out from the first and second guide paths to the folding path or an escape location to escape from the guide location.

11. The sheet folding apparatus of claim 10, wherein the first and second guide members are to move to a re-entry location to allow the printing medium coming out from the first guide path and the second guide path to re-enter the folding nip.

12. The sheet folding apparatus of claim 10, wherein the first guide member and the second guide member are to move to a blocking location to block the printing medium on the folding path from reversely entering the first and second guide paths.

13. A sheet folding apparatus comprising:

a folding roller including a pair of rollers to rotatably engage with each other to form a folding nip;

a positioning member to support a first end of a printing medium which is fed along a folding path and to arrange the printing medium in an initial folding location;

a push member to move to an insertion location to push the printing medium on the folding path into the folding nip, and to move to a retreat location to escape from the folding path;

a shift member, located at an exit of the folding nip, to selectively guide the printing medium to a guide path to return the printing medium having passed through the folding nip to the folding path, the guide path being provided around at least one of the pair of rollers; and a gate member, wherein the pair of rollers includes a first roller and a second roller, wherein the guide path includes a first guide path around the first roller and a second guide path around the second roller, wherein at least one of the first guide path or the second guide path comprises an inner guide path adjacent to a corresponding roller, and an outer guide path located at an outer side of the inner guide path, and wherein the gate member is to selectively guide the printing medium to the inner guide path or the outer guide path.

* * * * *